US009914630B2

(12) United States Patent
Takei et al.

(10) Patent No.: US 9,914,630 B2
(45) Date of Patent: Mar. 13, 2018

(54) TAP, SERVER, POURING MEMBER, AND ATTACHMENT/DETACHMENT TOOL

(71) Applicant: Sapporo Holdings Limited, Shibuya-ku (JP)

(72) Inventors: Yoshiaki Takei, Shibuya-ku (JP); Hisaaki Sugiyama, Shibuya-ku (JP); Hidekazu Narita, Shibuya-ku (JP)

(73) Assignee: Sapporo Holdings Limited, Shibuya-ku (JP)

( * ) Notice: Subject to any disclaimer, the term of this patent is extended or adjusted under 35 U.S.C. 154(b) by 93 days.

(21) Appl. No.: 14/766,235

(22) PCT Filed: Feb. 6, 2014

(86) PCT No.: PCT/JP2014/052784
§ 371 (c)(1),
(2) Date: Sep. 30, 2015

(87) PCT Pub. No.: WO2014/123195
PCT Pub. Date: Aug. 14, 2014

(65) Prior Publication Data

US 2016/0039655 A1 Feb. 11, 2016

(30) Foreign Application Priority Data

Feb. 6, 2013 (JP) ..... 2013-021665
Feb. 6, 2013 (JP) ..... 2013-021667
(Continued)

(51) Int. Cl.
*B22D 37/00* (2006.01)
*B67D 1/14* (2006.01)
*B67D 1/04* (2006.01)

(52) U.S. Cl.
CPC ..... *B67D 1/1416* (2013.01); *B67D 1/04* (2013.01); *B67D 1/1466* (2013.01); *B67D 2210/0006* (2013.01); *B67D 2210/00047* (2013.01)

(58) Field of Classification Search
CPC .. B67D 1/1416; B67D 1/1411; B67D 1/1466; B67D 1/04; B67D 1/1405; B67D 2210/00047
(Continued)

(56) References Cited

U.S. PATENT DOCUMENTS 2,919,762 A * 1/1960 Alford ..... E06C 1/18 182/175
3,434,632 A * 3/1969 Batrow ..... B67D 1/0412 222/400.5
(Continued)

FOREIGN PATENT DOCUMENTS

DE 10-2007-001215 A1 10/2008
EP 1 138 628 A1 10/2001
(Continued)

OTHER PUBLICATIONS

Office Action dated Dec. 20, 2016 in Japanese Patent Application No. 2013-261258.
(Continued)

*Primary Examiner* — Lien Ngo
(74) *Attorney, Agent, or Firm* — Oblon, McClelland, Maier & Neustadt, L.L.P.

(57) ABSTRACT

A tap to pour beer foam onto a liquid has a flow path through which the beer foam flows. A folded section and a second extension section of the flow path are curved along a liquid surface of the liquid.

10 Claims, 63 Drawing Sheets

(30) Foreign Application Priority Data

Feb. 28, 2013 (JP) ..... 2013-039978
Feb. 28, 2013 (JP) ..... 2013-039991
May 10, 2013 (JP) ..... 2013-100658
Oct. 30, 2013 (JP) ..... 2013-225741

(58) Field of Classification Search
USPC .... 222/509, 400.7, 517, 518, 457, 564, 565, 222/567, 556, 526, 527
See application file for complete search history.

(56) References Cited

U.S. PATENT DOCUMENTS

| | | | | |
|---|---|---|---|---|
| 4,380,306 | A * | 4/1983 | Knopf | B65D 1/12 220/606 |
| 4,605,225 | A * | 8/1986 | Zimmermann | A47G 19/145 215/13.1 |
| 4,869,396 | A * | 9/1989 | Horino | B67D 1/06 222/146.6 |
| 6,345,735 | B1 | 2/2002 | Harvey et al. | |
| 7,815,078 | B2 | 10/2010 | Robinson | |
| 7,946,219 | B2 * | 5/2011 | Marconi | A47J 31/4485 99/293 |
| 8,869,847 | B2 * | 10/2014 | Browne-Wilkinson | B67D 1/0085 141/392 |
| 2003/0006254 | A1 | 1/2003 | Itou et al. | |
| 2003/0070446 | A1 | 4/2003 | Scullion et al. | |
| 2003/0192615 | A1 | 10/2003 | Smith et al. | |
| 2005/0095341 | A1 | 5/2005 | Sher et al. | |
| 2005/0194399 | A1 * | 9/2005 | Proctor | B67D 1/0881 222/1 |
| 2005/0238768 | A1 | 10/2005 | Sher et al. | |
| 2011/0036451 | A1 * | 2/2011 | Maas | B67D 1/0431 141/2 |

FOREIGN PATENT DOCUMENTS

| | | | |
|---|---|---|---|
| GB | 2 359 065 | A | 8/2001 |
| JP | 3-69699 | U | 7/1991 |
| JP | 8-71944 | A | 3/1996 |
| JP | 9-95395 | A | 4/1997 |
| JP | 2907343 | B2 | 4/1999 |
| JP | 11-187962 | A | 7/1999 |
| JP | 2001-167350 | A | 6/2001 |
| JP | 2002-284295 | | 10/2002 |
| JP | 2002-362692 | A | 12/2002 |
| JP | 2003-170998 | A | 6/2003 |
| JP | 2004-75086 | A | 3/2004 |
| JP | 2004-535854 | A | 12/2004 |
| JP | 2005-88935 | | 4/2005 |
| JP | 2005-512901 | A | 5/2005 |
| JP | 2006-513936 | A | 4/2006 |
| JP | 2006-206150 | A | 8/2006 |
| JP | 2006-298461 | A | 11/2006 |
| JP | 2007-513838 | A | 5/2007 |
| JP | 2009-527713 | A | 7/2009 |
| JP | 4394863 | B2 | 10/2009 |
| JP | 4988968 | B1 | 5/2012 |
| JP | 5654188 | B1 | 11/2014 |
| WO | 03/045832 | A1 | 5/2003 |
| WO | WO 03/051762 | A2 | 6/2003 |
| WO | WO 2004/083789 | A1 | 9/2004 |
| WO | WO 2006/010941 | A2 | 2/2006 |
| WO | WO 2007/120984 | A2 | 10/2007 |

OTHER PUBLICATIONS

International Search Report date Apr. 28, 2014 in PCT/JP2014/052784.
International Preliminary Report on Patentability and Written Opinion dated Aug. 20, 2015 in PCT/JP2014/052784 filed Feb. 6, 2014 (submitting English translation only).
Written Opinion dated May 17, 2016 in Singaporean Patent Application No. 11201507021T.
Office Action dated Mar. 28. 2017 in Korean Patent Application No. 10-2015-7023777.
Japanese Office Action dated Oct. 24, 2017 in Japanese Application No. 2014-234982 (3 pages).

* cited by examiner (a)

(b)

(a)

(b)

(a)

(b)

(a)

(b)

(c)

(a)

(b)

(a)

(b)

(a)

(b)

(a)

(b)

(a)

(b)

(a)

(b)

(a)

(b)

(a)

Angle with respect to liquid surface

| | | |
|---|---|---|
| Example 8 | 0° | S |
| Example 9 | 15° | S |
| Example 10 | 30° | S |
| Example 11 | 45° | S |
| Comparative example 3 | 60° | S |

| | | |
|---|---|---|
| Example 12 | -15° | S |
| Example 13 | -30° | S |
| Example 14 | -45° | S |
| Comparative example 4 | -60° | S |

(b)

(a)

(b)

(c)

(a)

(b)

TAP, SERVER, POURING MEMBER, AND ATTACHMENT/DETACHMENT TOOL

TECHNICAL FIELD

The present invention relates to a tap, a server, a pouring member, and an attachment/detachment tool, which are used when a beverage is poured.

BACKGROUND ART

In general, when a beverage is provided in a restaurant or the like, a tap is manipulated in a state in which a beverage container such as a beer mug, a glass, or the like, is disposed below the tap, and the beverage is poured into the beverage container. As a tap and a server used when a beverage is provided, a tap and a server each including a nozzle for a liquid configured to pour a liquid such as a beer liquid or the like and a nozzle for a foam body configured to pour a foam are known.

Patent Literature 1 discloses a draft beer dispenser including a beer liquid pouring nozzle and a beer foam pouring nozzle, wherein a front end of the beer liquid pouring nozzle is curved in a lateral direction. In Patent Literature 2, a tap in which a lower end of a nozzle of a liquid configured to pour a beer liquid is curved by about 45 degrees and further an end surface of the nozzle for the liquid is cut in a vertical direction is disclosed, and because the end surface of the nozzle is opposite to a wall surface of a beer mug, generation of a foam upon pouring of the beer liquid is suppressed. In Patent Literature 3, a bubble dispensing device configured to pour bubbles of a frozen foam body (a frozen foam) from a bubble pouring port of the bubble dispensing device is disclosed. The bubble dispensing device disclosed in Patent Literature 3 pours the frozen foam body from the bubble pouring port into a beverage container when the bubble pouring lever of the bubble dispensing device is manipulated.

CITATION LIST

Patent Literature

[Patent Literature 1] Japanese Unexamined Patent Application, First Publication No. H09-95395
[Patent Literature 2] Japanese Patent No. 2907343
[Patent Literature 3] Japanese Patent No. 4988968

SUMMARY OF INVENTION

Technical Problem

Incidentally, when a beverage is poured into a beverage container, first, a liquid such as a beer liquid or the like is poured into a beverage container, and then a foam body such as a liquid foam body, a frozen foam body, or the like, is generated at an upper section of the poured liquid. However, when the above-mentioned tap is used and the foam body is generated at the upper section of the liquid, the foam body is poured perpendicular to the liquid surface. When the foam body is poured perpendicular to the liquid surface, the foam body is mixed into the liquid, and a ratio of the liquid to the foam body in the beverage container cannot be easily adjusted.

Accordingly, the present invention is directed to provide a tap, a server, a pouring member and an attachment/detachment tool that are capable of suppressing a foam body from being mixed with a liquid.

Solution to Problem

A tap according to an aspect of the present invention is a tap configured to pour a foam body of a beverage onto a liquid, the tap having a flow path through which the foam body flows, wherein a front end section of the flow path is curved along a liquid surface of the liquid.

According to the tap of the aspect of the present invention, the flow path through which the foam body flows is curved along the liquid surface. Accordingly, when the foam body is poured onto the liquid to generate a foam body on an upper section of the liquid, the foam body is poured along the liquid surface. Accordingly, since the foam body is poured along the liquid surface of the liquid, the foam body is not easily mixed with the liquid, and the foam body can be suppressed from being mixed with the liquid.

In addition, the front end section of the flow path may be curved to form an angle of 0° or more and 45° or less upward and downward with respect to the liquid surface of the liquid. In this way, as the angle of the front end section of the flow path with respect to the liquid surface is 0° or more and 45° or less upward and downward with respect to the liquid surface, the foam body is poured along the liquid surface. Accordingly, the foam body can be suppressed from being mixed with the liquid.

A tap according to another aspect of the present invention is a tap configured to pour a foam body of a beverage onto a liquid, the tap having a flow path through which the foam body flows, wherein the flow path is formed such that a pouring angle of the foam body is an angle of 0° or more and 45° or less upward and downward with respect to a liquid surface of the liquid. In this way, the flow path of the foam body is formed such that the pouring angle of the foam body is 0° or more and 45° or less upward and downward with respect to the horizontal direction. Accordingly, since the foam body can be poured along the liquid surface, the foam body is not easily mixed with the liquid.

A tap according to another aspect of the present invention is a tap configured to pour a foam body of a beverage onto a liquid, the tap having a flow path through which the foam body flows, wherein a front end section of the flow path is oriented in a direction of 0° or more and 45° or less upward and downward with respect to a liquid surface of the liquid. Since the front end section of the flow path configured to pour the foam body is oriented in a direction of 0° or more and 45° or less with respect to the liquid surface, as the foam body is poured along the liquid surface, the foam body is not easily mixed with the liquid.

In addition, a liquid guide section in which at least a lower side of an outlet port of the foam body protrudes outward may be provided. When the above-mentioned liquid guide section is installed, the foam body does not easily hang on a side surface of the tap. In addition, since the foam body can be suppressed from being attached to the tap and dropping downward, the foam body can be more securely poured in a lateral direction.

In addition, the tap may further include a flow path for a liquid through which the beverage is poured.

A server according to an aspect of the present invention includes the above-mentioned tap; and a supply device configured to supply the beverage into the tap. In this way, since the server according to the present invention includes the above-mentioned tap, a phenomenon in which the foam body is mixed with the liquid can be suppressed.

A pouring member according to an aspect of the present invention is a pouring member attached to a tap configured to pour a foam body of a beverage onto a liquid, and configured to pour the foam body, the pouring member having a flow path through which the foam body flows, wherein a front end section of the flow path is curved along a liquid surface of the liquid. The pouring member is attached to the tap of the related art, and the foam body can be poured along the liquid surface. Accordingly, a configuration in which the foam body is not easily mixed with the liquid can be easily realized.

A pouring member according to another aspect of the present invention is a pouring member attached to a tap configured to pour a foam body of a beverage onto a liquid, and configured to pour the foam body, the pouring member having a flow path through which the foam body flows, wherein the flow path is formed such that a pouring angle of the foam body is an angle of 0° or more and 45° or less upward and downward with respect to a liquid surface of the liquid. In this way, the flow path in the pouring member is formed such that the pouring angle of the foam body is 0° or more and 45° or less upward and downward with respect to the liquid surface. Accordingly, since the foam body can be poured along the liquid surface, the foam body is not easily mixed with the liquid.

A pouring member according to another aspect of the present invention is a pouring member attached to a tap configured to pour a foam body of a beverage onto a liquid, and configured to pour the foam body, the pouring member having a flow path through which the foam body flows, wherein a front end section of the flow path is oriented in a direction of 0° or more and 45° or less upward and downward with respect to a liquid surface of the liquid. Since the front end section of the flow path in the pouring member configured to pour the foam body is oriented in the direction of 0° or more and 45° or less with respect to the liquid surface, as the foam body is poured along the liquid surface, the foam body is not easily mixed with the liquid.

In addition, a liquid guide section in which at least a lower side of an outlet port of the foam body protrudes outward may be provided. As the pouring member is installed at the liquid guide section in this way, the foam body does not easily hang on a side surface of the pouring member. In addition, since the foam body can be suppressed from being attached to the pouring member and dropping downward, the foam body can be more securely poured in a lateral direction.

In addition, the pouring member may be attached such that a pouring direction of the foam body is a desired direction. In this case, the pouring direction of the foam body can be set to the desired direction by attaching the pouring member. Accordingly, a configuration in which the foam body is not easily mixed with the foam body can be easily realized.

An attachment/detachment tool according to an aspect of the present invention is an attachment/detachment tool comprising a pair of clipping sections configured to sandwich a pouring member attached to a tap configured to pour a foam body of a beverage onto a liquid, wherein the pouring member is detachably attached to the tap while the pouring member is sandwiched between the pair of clipping sections. Accordingly, since the pouring member can be pushed into the tap or extracted from the tap while the pouring member is sandwiched between the pair of clipping sections installed at the attachment/detachment tool, attachment/detachment of the pouring member with respect to the tap can be easily performed.

Advantageous Effects of Invention

According to the present invention, the tap, the server, the pouring member and the attachment/detachment tool that are capable of suppressing the foam body from being mixed with the liquid can be provided.

DESCRIPTION OF EMBODIMENTS

Figure 1:
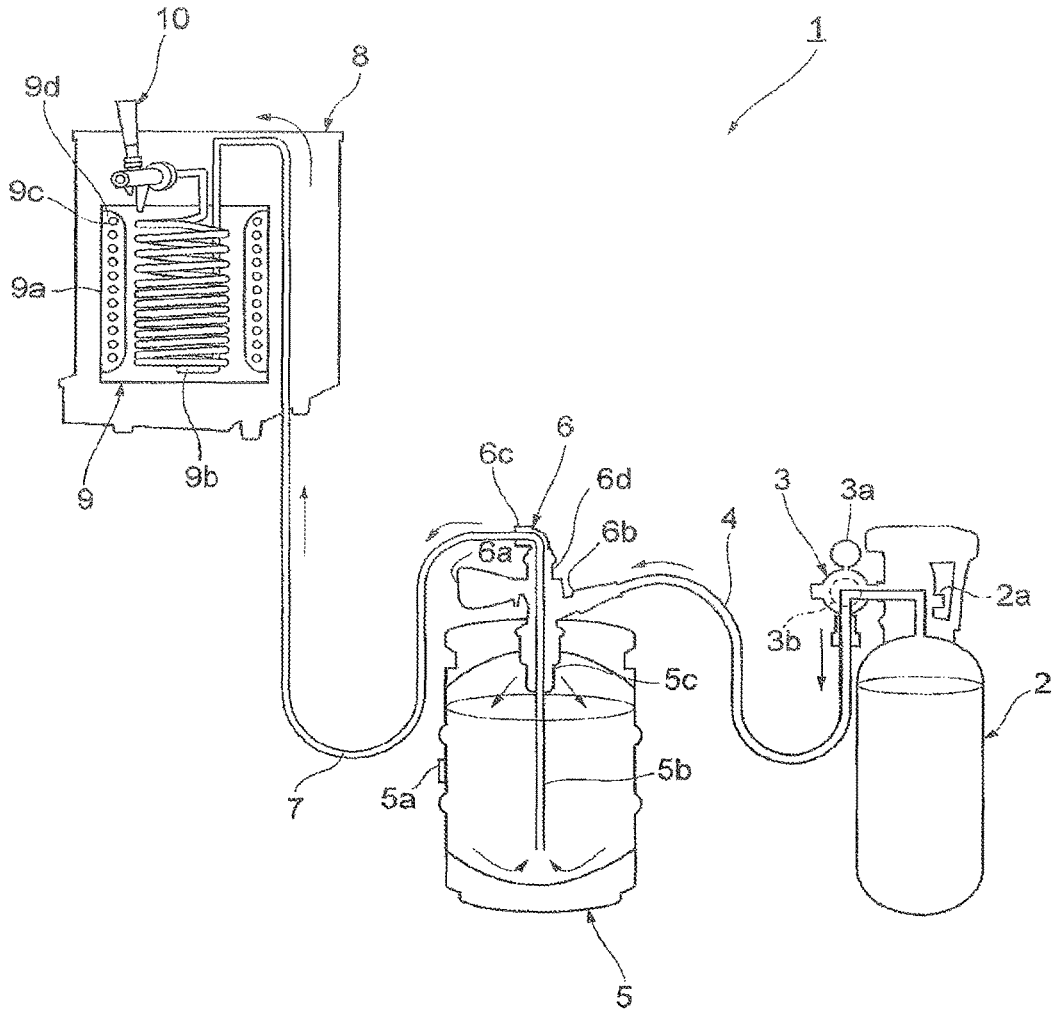
FIG. 1 is a view showing a configuration of a beverage vending apparatus including a tap of a first embodiment.

Hereinbelow, embodiments of a tap, a server, a pouring member, an attachment/detachment tool, a guide section and a beverage according to the present invention will be described in detail with reference to the accompanying drawings. Further, in all of the drawings, the same or corresponding components are designated by the same reference numerals.

(First Embodiment)

FIG. 1 shows the entire configuration of a beverage vending apparatus 1 configured to provide a cereal-based foaming beverage including a tap 10 of the embodiment. Here, the cereal-based foaming beverage is a foaming beverage formed of a cereal serving as a raw material, for example, beer, low-malt beer, or the like, and the cereal includes one or more selected from the group consisting of, for example, barley, wheat, rice, maize, beans, and root vegetables. Further, the cereal-based foaming beverage also includes a beverage that does not include alcohol, in addition to the alcoholic beverages. In the embodiment, a case in which beer is provided as the cereal-based foaming beverage will be described. The beverage vending apparatus 1 is an apparatus installed at, for example, a restaurant and configured to pour beer from the tap 10 according to an order or the like of a customer. First, the overall configuration of the beverage vending apparatus 1 will be described. The beverage vending apparatus 1 includes a carbon dioxide bottle 2, a decompression valve 3, a carbon dioxide hose 4, a beer barrel 5, a head 6, a beer hose 7, a server 8 and a cooling apparatus 9, in addition to the tap 10 of the embodiment.

The carbon dioxide bottle 2 is a substantially columnar container filled with carbon dioxide gas at a high pressure. The carbon dioxide bottle 2 has a function of pushing a beer liquid out of the beer barrel 5 into the server 8 and a function of maintaining an amount of the carbon dioxide gas contained in the beer liquid in the beer barrel 5 at an appropriate amount. In the carbon dioxide bottle 2, the carbon dioxide gas is filled in a liquid phase, for example, at a pressure of about 6 to 8 MPa. The carbon dioxide bottle 2 includes a residual quantity indication meter 2*a* configured to display an amount of the carbon dioxide gas in the carbon dioxide bottle 2. For example, a needle-shaped member may be used as the residual quantity indication meter 2*a*, and in this case, when the needle points to an upper side, it shows that an amount of the carbon dioxide gas in the carbon dioxide bottle 2 is relatively large, and when the needle points to a lower side, it shows that the amount of the carbon dioxide gas in the carbon dioxide bottle 2 is relatively small. In this way, the amount of the carbon dioxide gas in the carbon dioxide bottle 2 can be visually recognized by including the residual quantity indication meter 2*a*. In addition, the carbon dioxide bottle 2 includes an opening/closing handle (not shown) that is installed at an upper section of the carbon dioxide bottle 2 and rotatable by a user, and is able to open/close the flow path of the carbon dioxide gas from the carbon dioxide bottle 2 to the decompression valve 3 by rotation of the opening/closing handle.

The decompression valve 3 is an apparatus configured to adjust a pressure (hereinafter referred to as a gas pressure) by the carbon dioxide gas applied to the beer liquid in the beer barrel 5. The decompression valve 3 includes a residual pressure indication meter 3*a* configured to display a residual pressure of the carbon dioxide gas in the carbon dioxide bottle 2, and a rotary type manipulation unit 3*b* configured to adjust the gas pressure. For example, a user can increase the gas pressure by rotating the manipulation unit 3*b* clockwise, and decrease the gas pressure by rotating the manipulation unit 3*b* counterclockwise. Here, an amount of the carbon dioxide gas dissolved in the liquid decreases as a temperature of the liquid is increased, and increases as the temperature of the liquid is decreased. Accordingly, as the gas pressure is adjusted to an appropriate value by the decompression valve 3 according to the temperature of the beer liquid in the beer barrel 5, gas separation in which the carbon dioxide gas is extracted from the beer liquid at a high temperature and supersaturation in which the beer liquid excessively absorbs the carbon dioxide gas at a low temperature can be prevented.

The beer barrel 5 is a container in which the beer liquid is filled. The beer barrel 5 is configured to prevent intrusion of unwanted bacteria or the like into the beer barrel 5 because the inside thereof is sealed. In addition, for example, a card-shaped liquid temperature detection unit 5*a* can be adhered to a surface of the beer barrel 5, and a temperature of the beer in the beer barrel 5 can be detected by the liquid temperature detection unit 5*a*. An optimal value of the gas pressure corresponding to the detected temperature of the beer is displayed on the liquid temperature detection unit 5*a*, in addition to the temperature of the beer in the beer barrel 5. Accordingly, a user can adjust the gas pressure in the beer barrel 5 to an optimal value by adjusting the gas pressure to a value displayed on the liquid temperature detection unit 5*a* while manipulating the manipulation unit 3*b* of the decompression valve 3. In addition, the beer barrel 5 includes a tube 5*b* through which beer flows, and a mouthpiece (also referred to as a fitting valve) 5*c*. The tube 5*b* of the beer barrel 5 extends vertically in the beer barrel 5, and the mouthpiece 5*c* is installed at an upper end of the tube 5*b*.

The head 6 has a function of sending the carbon dioxide gas in the carbon dioxide bottle 2 into the beer barrel 5 via the decompression valve 3 and the carbon dioxide hose 4 and sending the beer liquid in the beer barrel 5 to the server 8. The head 6 includes a manipulation handle 6*a* configured to move vertically to open/close a flow path of a carbon dioxide gas and a beer liquid, a gas joint 6*b* connected to the carbon dioxide hose 4, and a beer joint 6*c* connected to the beer hose 7. A lower section of the head 6 is connected to the mouthpiece 5*c* of the beer barrel 5, the flow paths of the carbon dioxide hose 4 and the beer hose 7 are opened as the manipulation handle 6*a* of the head 6 is lowered in a state in which the lower section of the head 6 is connected to the mouthpiece 5*c*, and the flow paths of the carbon dioxide hose 4 and the beer hose 7 are closed as the manipulation handle 6*a* of the head 6 is raised. Further, the gas joint 6*b* and the beer joint 6*c* are detachably attached to a main body section 6*d* extending vertically from a central section of the head 6, and have a structure configured such that the head 6 as the gas joint 6*b*, the beer joint 6*c* and the main body section 6*d* can be easily disassembled and the head 6 can be easily cleaned.

The server 8 is connected to the head 6 via the beer hose 7, and has a function of cooling the beer liquid sent from the beer barrel 5 via the head 6 and the beer hose 7. The server 8 is a so-called electric cooling type and instant cooling type server, and the cooling apparatus 9 configured to cool the beer liquid from the beer hose 7 and serving as a supply device configured to supply a beverage into the tap 10 is installed in the server 8. The cooling apparatus 9 includes a cooling pool 9*a* configured to accommodate cooling water, and a beer pipe 9*b* connected to the beer hose 7 and spirally formed in the cooling pool 9*a*. A refrigerant pipe 9*c* connected to a freezing cycle apparatus (not shown) of the cooling apparatus 9 is continuously installed vertically at an inner side surface of the cooling pool 9*a*, water in the cooling pool 9*a* is cooled as ice 9*d* is formed in the refrigerant pipe 9*c* by a freezing cycle in the freezing cycle apparatus, and the beer in the beer pipe 9*b* is further cooled. In addition, since the beer pipe 9*b* is spirally formed and a flow path of the beer liquid in the cooling pool 9*a* is lengthily secured, the beer liquid in the beer pipe 9*b* is more appropriately instantly cooled in the cooling apparatus 9.

Further, in the embodiment, the example in which the beer barrel 5 is installed outside the server 8 and the server 8 is the electric cooling type and instant cooling type server including the cooling apparatus 9 has been described. However, instead of the electric cooling type and instant cooling type server, an ice cooling type and instant cooling type server or a barrel housing type server in which the beer barrel 5, the head 6 and the beer hose 7 are installed in a refrigerator may be used. Here, the ice cooling type and instant cooling type server is a server in which ice is formed in the cooling pool and the beer pipe is cooled by the ice via a cold plate type (not shown). In addition, the barrel housing type server is a server having a structure in which a beer barrel, a head and a beer hose are housed in a refrigerator, and the beer hose is cooled by the refrigerator.

Here, the tap 10 configured to pour the beer cooled by the cooling apparatus 9 will be described in more detail.

Figure 2:
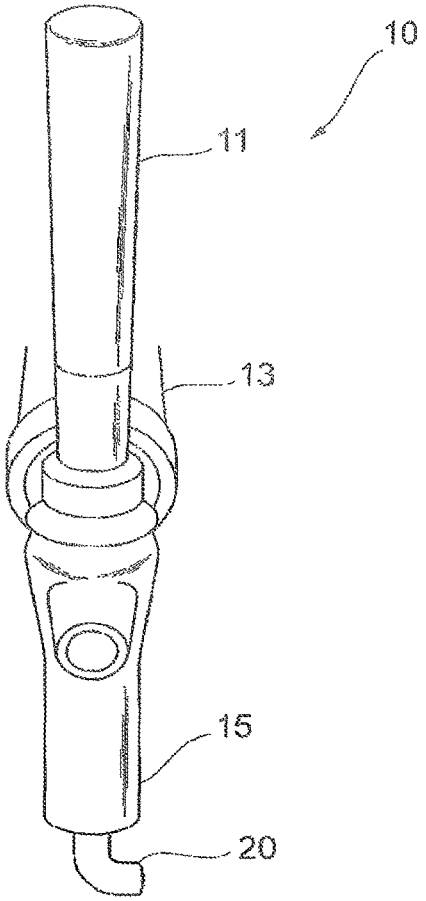
FIG. 2 shows a perspective view and a cross-sectional view of the tap of FIG. 1.
Figure 2:
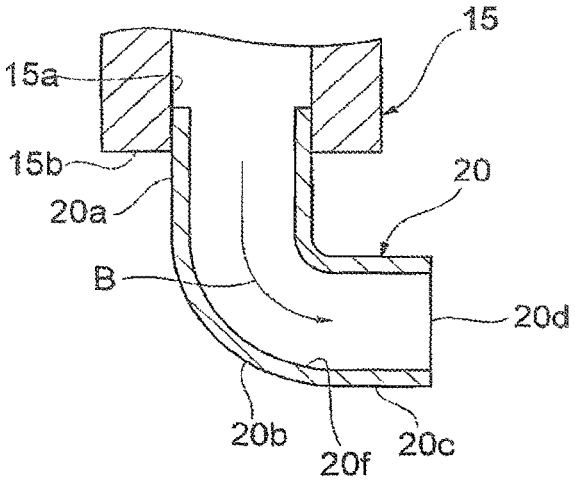
Figure 3:
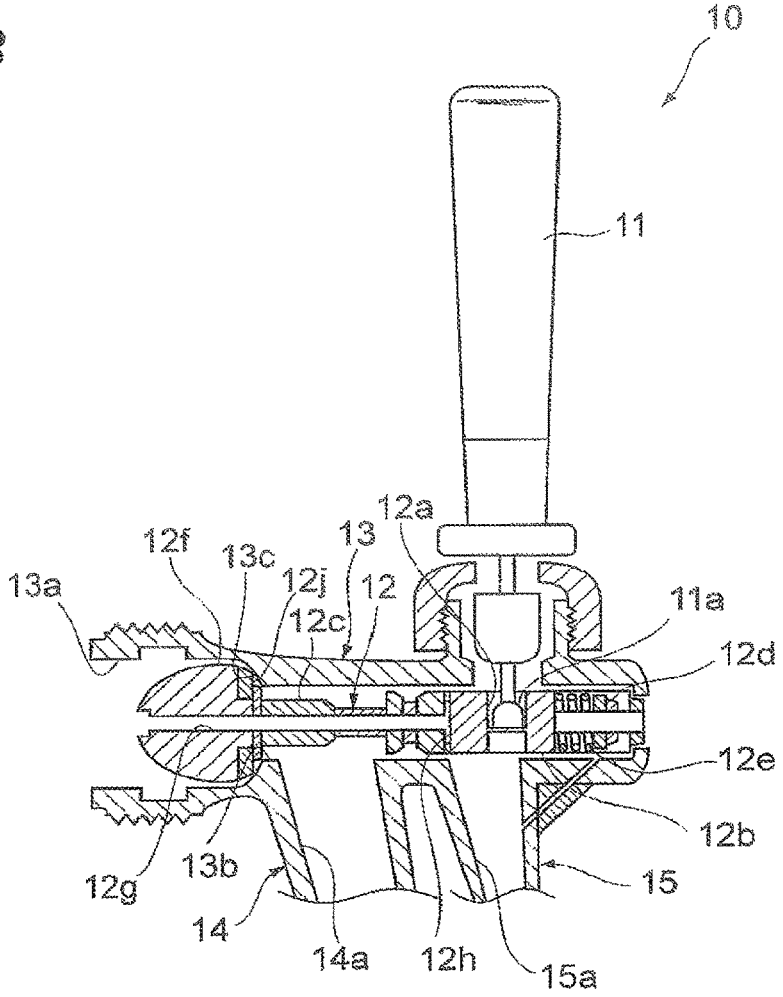
FIG. 3 is a cross-sectional view showing a flow path in the tap of FIG. 1.
Figure 4:
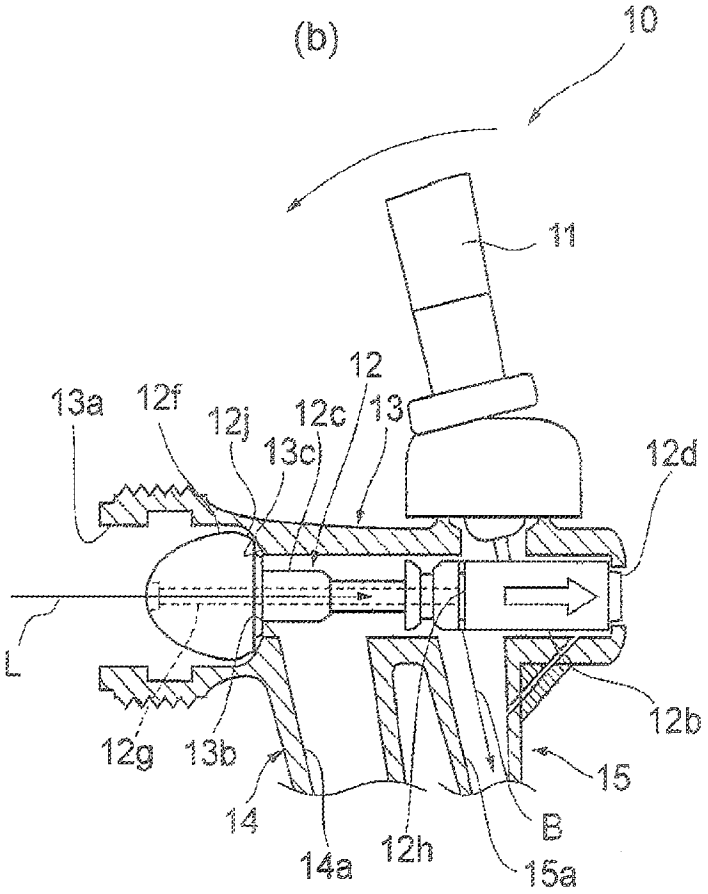
FIG. 4 is a cross-sectional view showing relations of a lever manipulation with flows of a beer liquid and a foam body.
Figure 4:
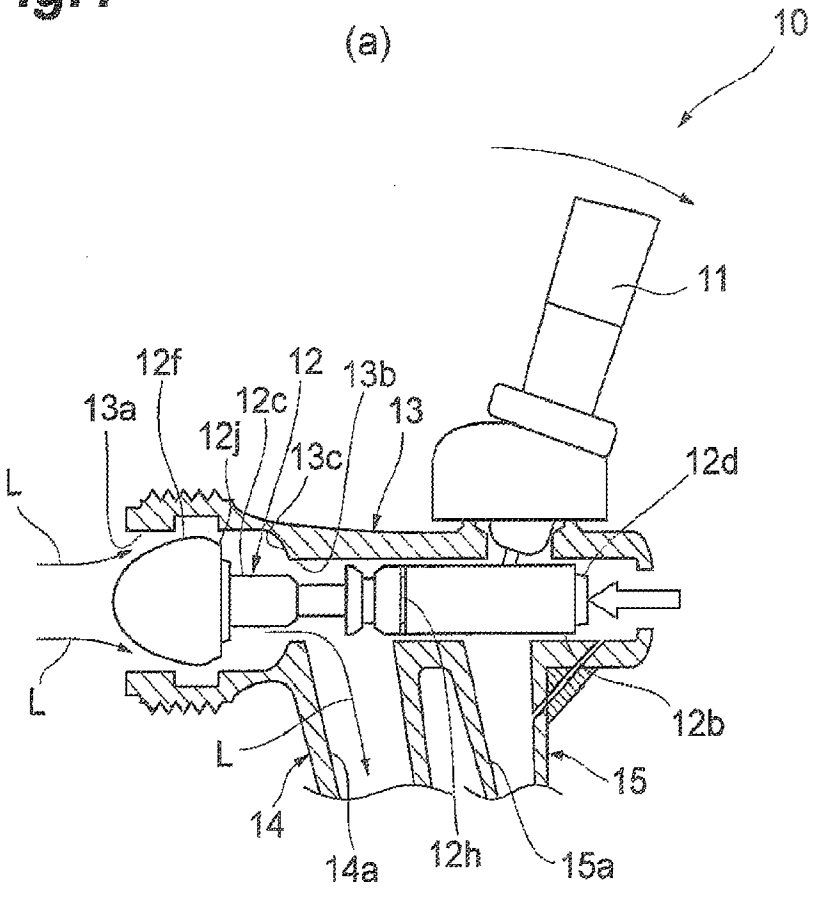

As shown in FIGS. 2 to 4, the tap 10 includes a lever 11 that can be moved and manipulated by a hand, a slide valve 12 configured to open/close the flow path of the beer in the tap 10 by manipulation of the lever 11, a tap main body 13 configured to movably hold the slide valve 12 therein, and a nozzle 14 for a liquid and a nozzle 15 for a foam body extending from the tap main body 13 in a downwardly inclined direction.

The lever 11 of the tap 10 is movable toward both of a back side and a front side of (a) in FIG. 2 in a state in which a user is located at the front side of (a) in FIG. 2. Hereinafter, the front side of FIG. 2 is simply referred to as a front side, and the back side of FIG. 2 is simply referred to as a back side. The lever 11 is formed in a substantially columnar shape extending upward from the tap main body 13. The lever 11 is formed in a shape having a diameter that gradually increases toward an upper side. A lower end 11*a* (see FIG. 3) of the lever 11 is engaged with an engaging concave section 12*a* formed at a surface of the slide valve 12.

The slide valve 12 includes a valve main body 12*b* having the engaging concave section 12*a* formed on a surface in a substantially columnar shape, a shaft section 12*c* configured to support the valve main body 12*b* to be movable toward the front side, a spring 12*e* installed between an end section 12*d* of the front side of the shaft section 12*c* and the valve main body 12*b* and configured to bias the valve main body 12*b* toward the front side and the back side, and a diameter expanding section 12*f* fixed to the back side of the shaft section 12*c* and having a diameter that increases toward the shaft section 12*c*.

As shown in FIG. 3 and (b) in FIG. 4, a flow path 12*g* through which a beer liquid (liquid) L and a beer foam (foam body) B flow is formed in the valve main body 12*b*, the shaft section 12*c* and the diameter expanding section 12*f* of the slide valve 12. In addition, a foam charge hole 12*h* configured to eject the beer foam B is formed at an end section of the front side of the flow path 12*g*. The foam charge hole 12*h* is configured to be opened only when the valve main body 12*b* is moved toward the front side from the shaft section 12*c*, and the beer foam B is ejected to the nozzle 15 for a foam body when the foam charge hole 12*h* is opened. The tap main body 13 includes a first beer liquid flow path 13*a* disposed at the end section of the back side of the tap main body 13 and in communication with the beer pipe 9*b* of the cooling apparatus 9, and a second beer liquid flow path 13*b* having a diameter increased at the front side of the beer liquid flow path 13*a*.

The nozzle 14 for a liquid extends from the tap main body 13 in a downwardly inclined direction, and a flow path 14*a* for a liquid in communication with the second beer liquid flow path 13*b* in the tap main body 13 and through which the beer liquid L flows is installed in the nozzle 14 for a liquid. The nozzle 15 for a foam body extends from the tap main body 13 at the front side of the nozzle 14 for a liquid in a downwardly inclined direction, and a flow path 15*a* for a foam body through which the beer foam B poured from the foam charge hole 12*h* flows is formed in the nozzle 15 for a foam body. Further, the beer foam B is a liquid foam body including air bubbles formed from a film of the liquid.

As shown in FIG. 2, a tubular pouring member 20 configured to pour the beer foam B in the flow path 15*a* for a foam body into a beverage container A is installed at a front end section 15*b* of the flow path 15*a* for a foam body of the nozzle 15 for a foam body. The pouring member 20 includes a first extension section 20*a* extending downward from the front end section 15*b* of the nozzle 15 for a foam body attached to the inner side surface of the flow path 15*a* for a foam body of the nozzle 15 for a foam body, a folded section 20*b* folded at the lower end of the first extension section 20*a*, and a second extension section 20*c* extending from the folded section 20*b* in a substantially horizontal direction. In addition, a flow path 20*f* in communication with the flow path 15*a* for a foam body of the nozzle 15 for a foam body and through which the beer foam B flows is formed inside the pouring member 20. An outlet port 20*d* through which the beer foam B is discharged to the outside is formed at a front end section of the second extension section 20*c*.

In addition, the pouring member 20 has the folded section 20*b* formed at the lower end of the first extension section 20*a*, and thus the front end section of the flow path 20*f* through which the beer foam B flows is curved along a liquid surface S (see FIG. 6) of the beer liquid L in the beverage container A. That is, the front end section of the flow path 20*f* is curved to form an angle of 0° or more and 45° or less upward and downward with respect to the liquid surface S of the beer liquid L, and the flow path 20*f* is formed such that a pouring angle of the beer foam B is an angle of 0° or more and 45° or less upward and downward with respect to the liquid surface S. In addition, the front end section configured to pour the beer foam B in the flow path 20*f* through which the beer foam B flows is oriented in a direction of 0° or more and 45° or less upward and downward with respect to the liquid surface S of the beer liquid L. Here, the angle is preferably 0° or more and 30° or less upward with respect to the liquid surface S or may be 0° or more and 30° or less downward with respect to the liquid surface S, and more preferably 0° or more and 15° or less upward with respect to the liquid surface S or 0° or more and 15° or less downward with respect to the liquid surface S. Further, the direction along the liquid surface S and the direction in the horizontal direction are shown as the same direction.

Here, the front end section of the flow path 20*f* and the front end section configured to pour the beer foam B are the folded section 20*b* and the second extension section 20*c*, respectively. In addition, the case in which the flow path 20*f* is curved along the liquid surface S also includes, in addition to the case in which the second extension section 20*c* is curved in the horizontal direction, the case in which the second extension section 20*c* is curved upward or downward with respect to a horizontal plane, for example, the case in which the folded section 20*b* and the second extension section 20*c* serving as the front end section of the flow path 20*f* are curved to form an angle of 0° or more and 45° or less upward and downward with respect to the liquid surface S of the beer liquid L. Here, the angle is preferably 0° or more and 30° or less upward with respect to the liquid surface S or 0° or more and 30° or less downward with respect to the liquid surface S, and more preferably 0° or more and 15° or less upward with respect to the liquid surface S or 0° or more and 15° or less downward with respect to the liquid surface S. Further, in FIG. 2, an example in which the second extension section 20*c* is curved in the horizontal direction is shown.

Next, operations of the components when the beer serving as the cereal-based foaming beverage is poured into the beverage container A using the tap 10 will be described with reference to FIGS. 3 to 5. First, in a state in which a user of the beverage vending apparatus 1 does not manipulate the lever 11, an end surface 12*j* of the front side of the diameter expanding section 12*f* in the slide valve 12 abuts a wall surface 13*c* in the tap main body 13, and the first beer liquid flow path 13*a* and the second beer liquid flow path 13*b* in the tap main body 13 are blocked.

Figure 5:
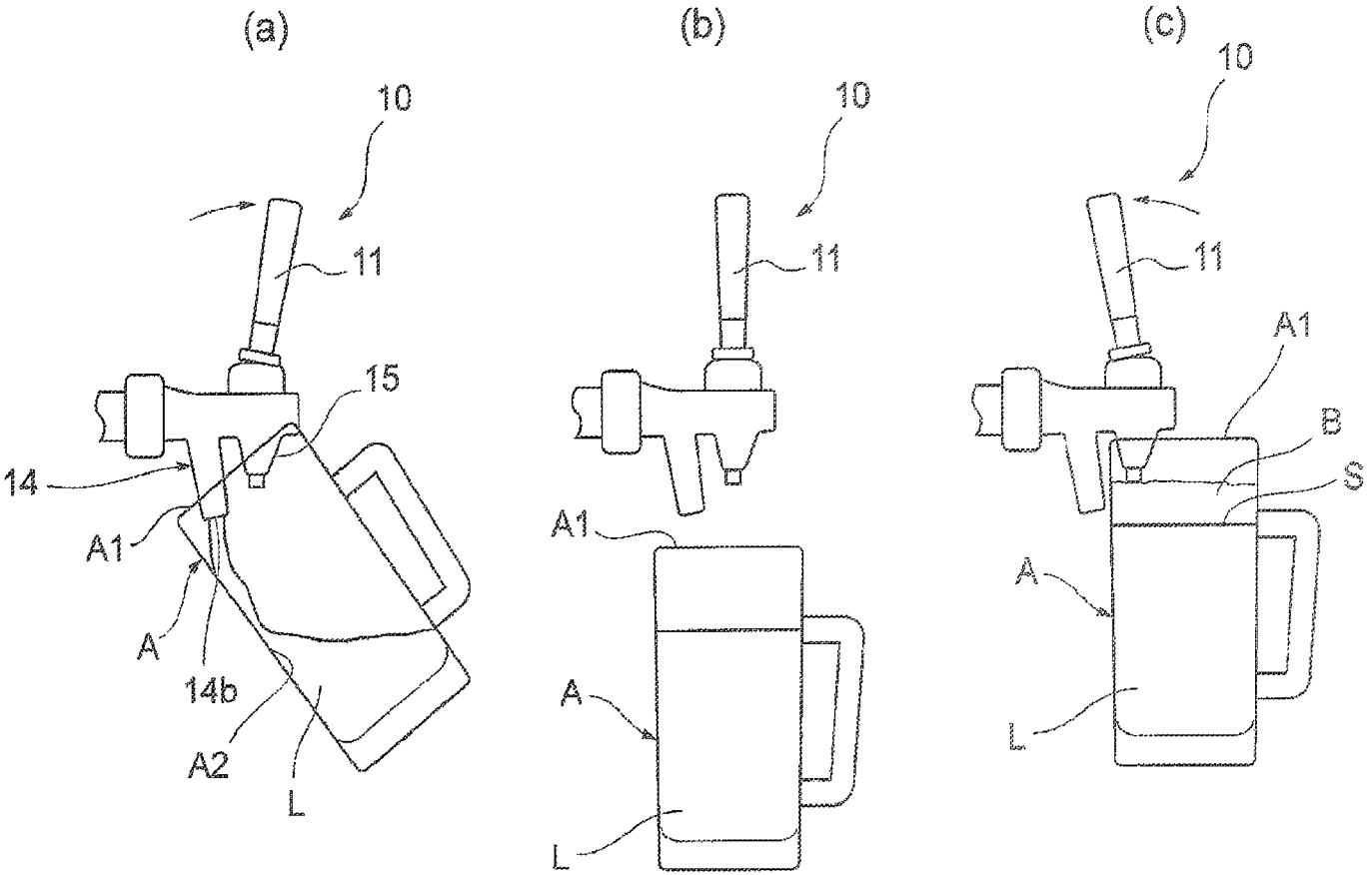
FIG. 5 is a view showing a flow of pouring of beer using the tap of FIG. 1.

In this state, as shown in (a) in FIG. 5, a user of the beverage vending apparatus 1 positions the beverage container A at the lower section of the tap 10 such that an opening A1 of the upper end of the beverage container A is inclined at about 45 degrees at a back side. Then, when the user moves the lever 11 toward the front side in this state, as shown in (a) in FIG. 4, the slide valve 12 moves toward the back side. When the slide valve 12 moves toward the back side, the end surface 12*j* of the diameter expanding section 12*f* is separated from the wall surface 13*c* in the tap main body 13, and the first beer liquid flow path 13*a* and the second beer liquid flow path 13*b* come in communication with each other. When the first beer liquid flow path 13*a* and the second beer liquid flow path 13*b* come in communication with each other, the beer liquid L is guided to the flow path 14*a* for a liquid of the nozzle 14 for a liquid through the first beer liquid flow path 13*a* and the second beer liquid flow path 13*b*. Then, the beer liquid L guided to the flow path 14*a* for a liquid of the nozzle 14 for a liquid is poured from a lower end 14*b* (see (a) in FIG. 5) of the nozzle 14 for a liquid toward an inner side surface A2 of the beverage container A that is inclined by 45 degrees toward the back side. In this way, as the beer liquid L is poured in a state in which the beverage container A is inclined, an impulsive force of the beer liquid L on the beverage container A to the inner side surface A2 can be reduced, and generation of initial foam upon pouring of the beer liquid L can be suppressed.

As shown in FIG. 3 and (b) in FIG. 5, when pouring of the beer liquid L into the beverage container A is terminated, the user vertically erects the beverage container A such that the opening A1 is directed upward, and returns the lever 11 to its original position. Here, since the end surface 12*j* of the diameter expanding section 12*f* in the slide valve 12 abuts the wall surface 13*c* in the tap main body 13, the first beer liquid flow path 13*a* and the second beer liquid flow path 13*b* are blocked, and pouring of the beer liquid L into the beverage container A is stopped.

Then, as shown in (b) in FIG. 4 and (c) in FIG. 5, the user of the beverage vending apparatus 1 pushes the lever 11 of the tap 10 toward the back side to generate the beer foam B on the liquid surface S of the beer liquid L in the beverage container A in a state in which the beverage container A is vertically erected. When the user pushes the lever 11 toward the back side, the valve main body 12*b* of the slide valve 12 is moved toward the front side with respect to the shaft section 12*c*, and the foam charge hole 12*h* is opened. When the foam charge hole 12*h* is opened, the beer liquid L enters the flow path 12*g* of the slide valve 12 from the first beer liquid flow path 13*a* of the tap main body 13. The beer liquid L entering the flow path 12*g* arrives at the foam charge hole 12*h*, and the beer liquid L that has arrived at the foam charge hole 12*h* is ejected downward toward the flow path 15*a* for a foam body of the nozzle 15 for a foam body from the foam charge hole 12*h* in a state in which the beer liquid L is converted into the beer foam B.

Figure 6:
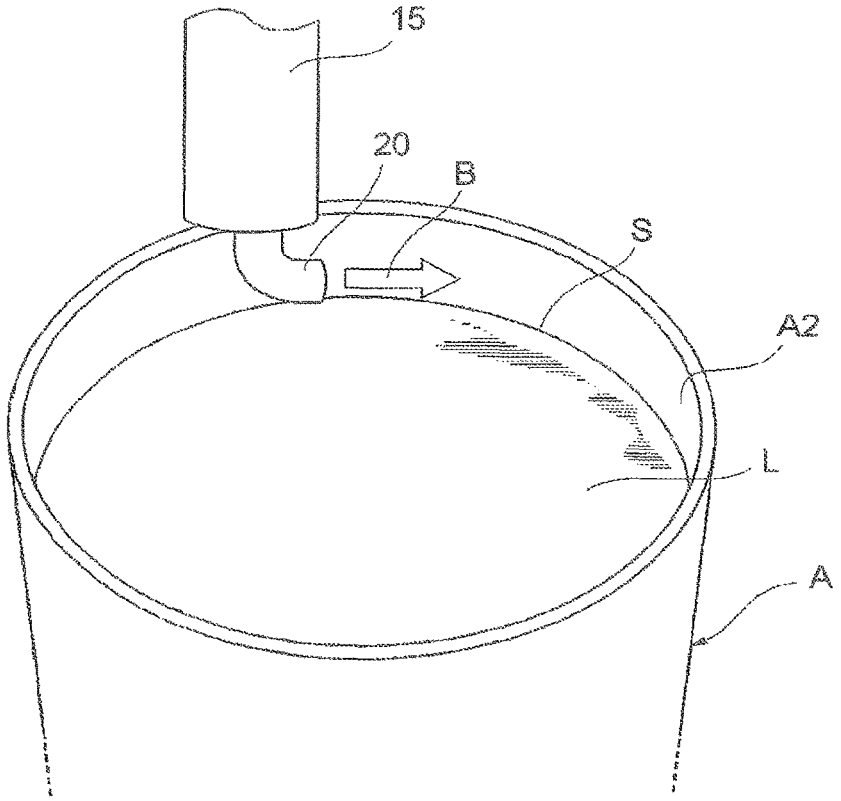
FIG. 6 is a view showing generation of the foam body using the tap of FIG. 1.
Figure 6:
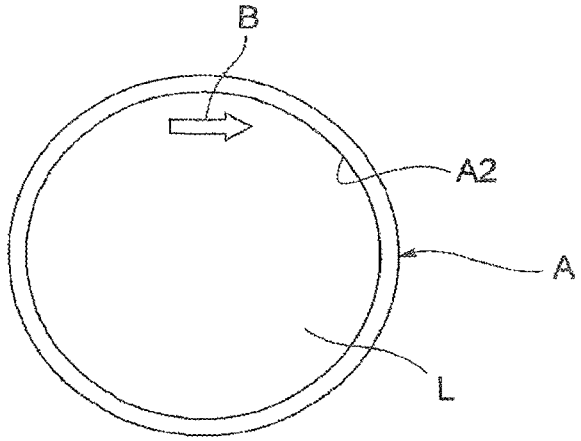

Here, as shown in FIGS. 2 and 6, when the beer foam B is generated on the liquid surface S of the beer liquid L in the beverage container A, the second extension section 20*c* is folded to extend in a substantially horizontal direction by the folded section 20*b* of the pouring member 20. That is, since the second extension section 20*c* of the pouring member 20 is bent along the liquid surface S of the beer liquid L in the beverage container A, the beer foam B in the nozzle 15 for a foam body is poured from the outlet port 20*d* of the pouring member 20 along the liquid surface S of the beer liquid L. In addition, as shown in (b) in FIG. 6, since the beer foam B is poured along the inner side surface A2 of the beverage container A, the beer foam B is able to move in the beverage container A in a spiral shape.

In this way, according to the tap 10 and the server 8 of the embodiment, since the flow path 20*f* through which the beer foam B flows is curved along the liquid surface S of the beverage, when the beer foam B is poured onto the beer liquid L to generate the beer foam B on the upper section of the beer liquid L, the beer foam B is poured along the liquid surface S. Accordingly, since the beer foam B is poured along the liquid surface S of the beer liquid L and is not easily mixed into the beer liquid L, the beer foam B can be prevented from being mixed into the beer liquid L.

In addition, according to the pouring member 20 configured to pour the beer foam B of the embodiment, the second extension section 20*c* of the flow path 20*f* of the beer foam B in the pouring member 20 is curved along the liquid surface S of the beer liquid L. That is, since the flow path 20*f* in the pouring member 20 is curved along the liquid surface S, the beer foam B is poured along the liquid surface S, and the beer foam B can be prevented from being mixed with the beer liquid L.

In addition, the flow path 20*f* through which the beer foam B flows is formed such that a pouring angle of the beer foam B is an angle of 0° or more and 45° or less upward and downward with respect to the horizontal direction. Accordingly, since the beer foam B can be poured along the liquid surface S, the beer foam B is not easily mixed with the beer liquid L.

In addition, the tap 10 pours the beer foam B onto the beer liquid L, and the front end section configured to pour the beer foam B in the flow path 20*f* through which the beer foam B flows is oriented in a direction of an angle of 0° or more and 45° or less upward and downward with respect to the liquid surface S of the beer liquid L. Since the front end section of the flow path 20*f* configured to pour the beer foam B in this way is oriented in a direction of an angle of 0° or more and 45° or less with respect to the liquid surface S, the beer foam B is poured along the liquid surface S, and the beer foam B can be suppressed from being mixed with the beer liquid L.

In addition, since an impulsive force on the beer liquid L generated when the beer foam B is poured from the nozzle 15 for a foam body can be reduced as the beer foam B is poured along the liquid surface S, generation of rough foam when the beer foam B is poured can be suppressed. In addition, since the pouring member 20 is formed in a tubular shape folded along the beer liquid L in the beverage container A, as the pouring member 20 is folded along the liquid surface S of the beer liquid L in the beverage container A, a configuration configured to suppress generation of rough foam can be easily realized. Further, when the beer foam B is poured along an inner wall of the beverage container A while hitting an inner wall of the beverage container A, a force moving the beer foam B in the beverage container A in a circular direction is increased. Accordingly, since a force of the beer foam B applied to the beer liquid L is relatively reduced, the beer foam B is suppressed from being further mixed with the beer liquid L.

(Second Embodiment)

Next, a tap, a server and a pouring member of a second embodiment will be described with reference to FIGS. 7 to 9. Like the tap 10 of the first embodiment, a tap 30 of the second embodiment is installed at the beverage vending apparatus 1, and the flow path of the carbon dioxide gas and the beer liquid L is similar to the first embodiment. The tap 30 of the second embodiment is distinguished from the tap 10 of the first embodiment in that a pouring member 40 extends downward in a linear shape instead of the tubular pouring member 20 being folded by the folded section 20*b*, and other details are the same as the first embodiment. Accordingly, in the second embodiment, only the pouring member 40 extending downward in the linear shape will be described, and description of other configurations will be omitted.

Figure 7:
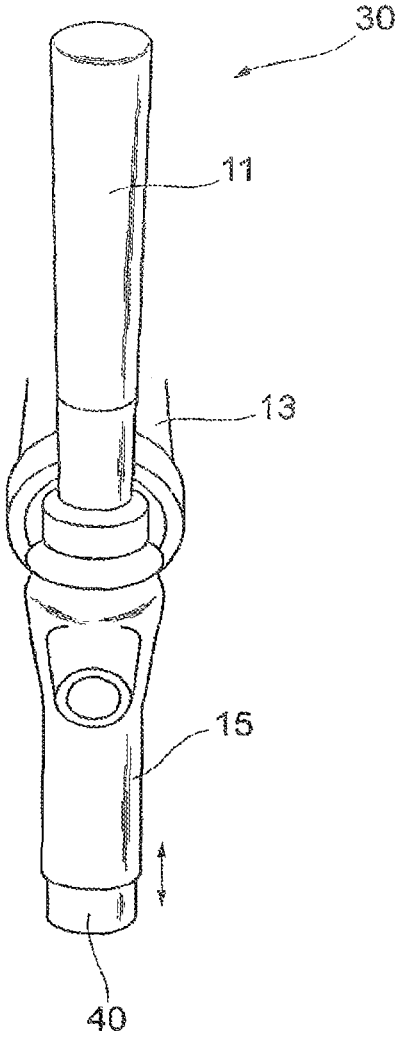
FIG. 7 is a perspective view showing a tap of a second embodiment.
Figure 8:
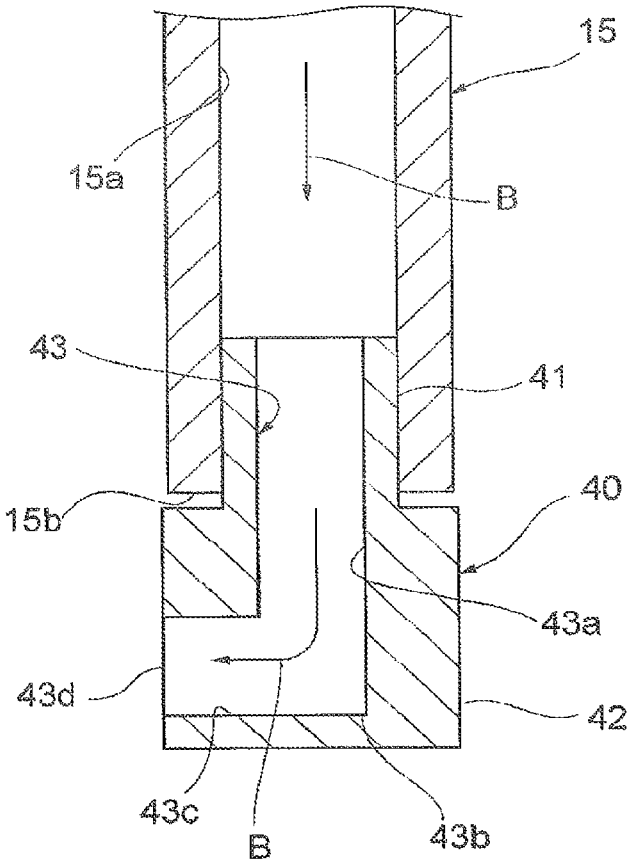
FIG. 8 is a cross-sectional view showing a flow path of a foam body in a pouring member of the tap of FIG. 7.

As shown in FIGS. 7 and 8, the pouring member 40 of the second embodiment includes a columnar fitting protrusion 41 fitted into the front end section 15*b* of the nozzle 15 for a foam body, and a columnar flow path conversion section 42 having a diameter that expands at a lower section of the fitting protrusion 41. The pouring member 40 of the second embodiment is attached to the nozzle 15 for a foam body by fitting the fitting protrusion 41 into the front end section 15*b* of the nozzle 15 for a foam body. In addition, the pouring member 40 can be removed from the nozzle 15 for a foam body by pulling the flow path conversion section 42 from below, and is detachably attached to the nozzle 15 for a foam body. A flow path 43 through which the beer foam B flows is formed in the fitting protrusion 41 and the flow path conversion section 42*b*, and the flow path 43 of the pouring member 40 includes a first extension section 43*a* extending downward from the upper end of the fitting protrusion 41, a folded section 43*b* folded at a lower end of the first extension section 43*a*, and a second extension section 43*c* extending from the folded section 43*b* in a substantially horizontal direction. An outlet port 43*d* through which the beer foam B is discharged to the outside is formed at a front end section of the second extension section 43*c*.

In addition, the pouring member 40 of the second embodiment has the folded section 43*b* at the lower end of the first extension section 43*a*, and thus the flow path 43 through which the beer foam B passes is curved along the liquid surface S of the beer liquid L in the beverage container A. That is, the front end section of the flow path 43 is curved to form an angle of 0° or more and 45° or less upward and downward with respect to the liquid surface S of the beer liquid L, and the flow path 43 is formed such that a pouring angle of the beer foam B is an angle of 0° or more and 45° or less upward and downward with respect to the horizontal direction. In addition, the front end section configured to pour the beer foam B in the flow path 43 through which the beer foam B flows is oriented in a direction of an angle of 0° or more and 45° or less upward and downward with respect to the liquid surface S of the beer liquid L. Here, the angle is preferably 0° or more and 30° or less upward with respect to the liquid surface S or 0° or more and 30° or less downward with respect to the liquid surface S, and more preferably 0° or more and 15° or less upward with respect to the liquid surface S or 0° or more and 15° or less downward with respect to the liquid surface S.

Here, the front end section of the flow path 43 and the front end section configured to pour the beer foam B are the folded section 43*b* and the second extension section 43*c*, respectively. In addition, the case in which the flow path 43 is curved along the liquid surface S also includes, like the first embodiment, the case in which the second extension section 43*c* is curved upward or downward with respect to the horizontal plane, for example, referred to as the case in which the folded section 43*b* and the second extension section 43*c* serving as the front end section of the flow path 43 are curved to form an angle of 0° or more and 45° or less upward and downward with respect to the liquid surface S of the beer liquid L. Here, the angle is preferably 0° or more and 30° or less upward with respect to the liquid surface S or 0° or more and 30° or less downward with respect to the liquid surface S, and more preferably 0° or more and 15° or less upward with respect to the liquid surface S or 0° or more and 15° or less downward with respect to the liquid surface S. Further, in FIG. 8, an example in which the second extension section 43*c* is curved in the horizontal direction is shown.

Figure 9:
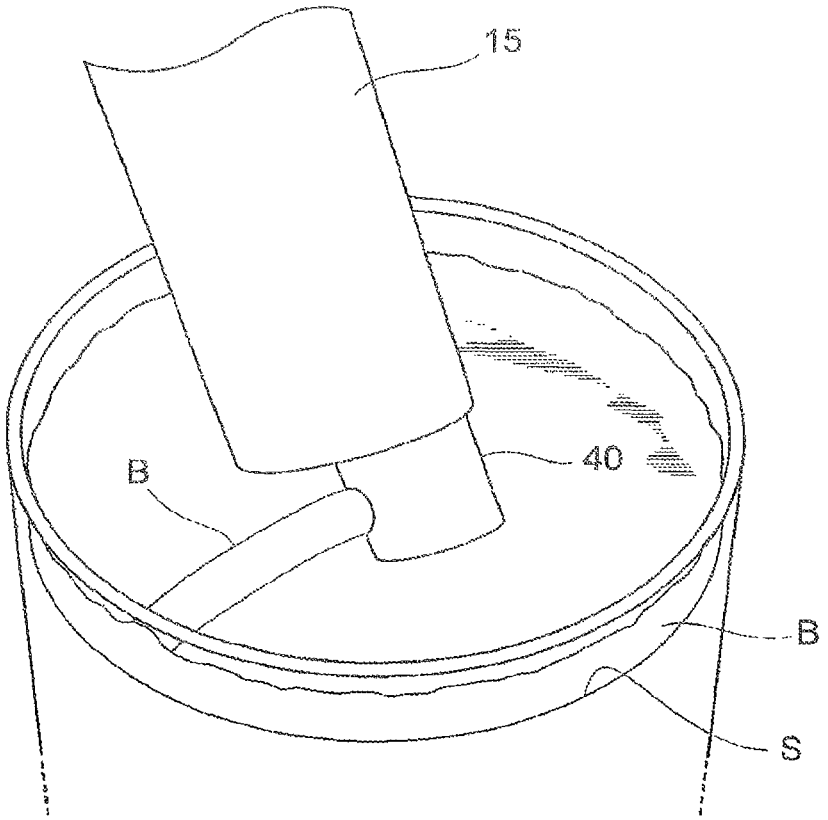
FIG. 9 is a view showing generation of the foam body using the tap of FIG. 7.

Here, as shown in FIGS. 8 and 9, since the second extension section 43*c* of the flow path 43 is folded by the folded section 43*b* in the pouring member 40, the beer foam B in the nozzle 15 for a foam body is poured from the outlet port 43*d* along the liquid surface S of the beer liquid L. Accordingly, according to the tap 30 of the second embodiment, since the beer foam B is poured along the beer liquid L and not easily mixed with the beer liquid L, the same effect as in the first embodiment is obtained.

In addition, since the pouring member 40 of the second embodiment is detachable, the pouring member 40 is attached to the nozzle for a foam body of the related art, and the beer foam B can be poured along the liquid surface S of the beer liquid L. Then, since the pouring member 40 can be removed from the nozzle 15 for a foam body and cleaned, the pouring member 40 can be handled more sanitarily.

Further, in the second embodiment, since the pouring member 40 is formed in a linear shape extending downward, the shape of the pouring member 40 can be simplified to simplify manufacture of the pouring member 40. In addition, since the pouring member 40 does not have a folded shape, the entire appearance of the nozzle 15 for a foam body can remain relatively unchanged from the related art.

(Third Embodiment)

Hereinafter, a tap, a server and a pouring member of a third embodiment will be described. The tap of the third embodiment uses a nozzle for a foam body and a pouring member that are configured to pour a frozen foam body (a frozen foam), instead of the nozzle 15 for a foam body and the pouring member 20 of the first embodiment that are configured to pour the liquid foam body. The tap of the third embodiment is distinguished from the tap 10 of the first embodiment in that the foam body is the frozen foam body as described above, and other details are the same as the first embodiment.

In the third embodiment, the frozen foam body is generated in a main body of the beverage vending apparatus, and the generated frozen foam body is poured into the beverage container A through the nozzle for a foam body. The tubular pouring member of the first embodiment or the linear pouring member of the second embodiment is installed at the front end section of the nozzle for a foam body, and the flow path in the pouring member is curved along the horizontal plane. Accordingly, when the frozen foam body is poured from the nozzle for a foam body onto the beer liquid L poured into the beverage container A to generate the frozen foam body on the upper section of the beer liquid L, the frozen foam body is poured from the pouring member of the nozzle for a foam body along the liquid surface S. Accordingly, even in the third embodiment, the same effect as in the first and second embodiments is obtained, and the frozen foam body is not easily mixed with the beer liquid L.

(Fourth Embodiment)

In the fourth embodiment, the beverage poured from the tap will be described. The beverage of the fourth embodiment is, for example, beer as shown in (c) in FIG. 5, and the beer liquid L is poured into the beverage container A and the beer foam B is poured onto the beer liquid L. Here, the fourth embodiment is distinguished from the first to third embodiments in that liquid types of the beer liquid L and the beer foam B are different, and for example, as shown in (d) in FIG. 19, a second layer R2 in which the beer foam B becomes a liquid is formed between a first layer R1 serving as a layer of the beer liquid L and a third layer R3 serving as a layer of the beer foam B.

The second layer R2 in which the beer foam B becomes the liquid is formed as the poured beer foam B gradually changes into the liquid on the beer liquid L. Here, when a specific gravity of the liquid type of the beer liquid L is lower than a specific gravity of the liquid type of the liquid that forms the beer foam B, since the beer foam B that becomes the liquid is likely to be diffused, while the second layer R2 is formed immediately after the pouring of the beer foam B, the second layer R2 thins with the lapse of the time thereafter. Meanwhile, when the specific gravity of the liquid type of the beer liquid L is higher than the specific gravity of the liquid type that forms the beer foam B, since the beer foam B is not easily diffused in the beer liquid L even when the beer foam B becomes the liquid, the second layer R2 is more noticeably formed with the lapse of time. In addition, while the liquid of the liquefied beer foam B sinks to a lower side of the beer foam B, a liquefaction rate of the beer foam B is reduced and a lowering speed of the beer foam B is also extremely reduced. For this reason, when the specific gravity of the beer liquid L is higher than the specific gravity of the beer foam B, the second layer R2 can be formed even when a difference between the specific gravity of the beer liquid L and the specific gravity of the beer foam B is extremely small. Meanwhile, when the specific gravity of the beer liquid L is lower than the specific gravity of the beer foam B, while the second layer R2 cannot be held for a long time, the second layer R2 can be formed immediately after pouring the beer foam B.

In this way, the beverage of the fourth embodiment has the first layer R1 formed of the beer liquid L, the second layer R2 formed of the liquefied beer foam B, and the third layer R3 formed of the beer foam B. Accordingly, since the first layer R1 of the beer liquid L, the second layer R2 of the liquefied beer foam B and the third layer R3 of the beer foam B can form a beautiful stripe pattern, the beverage having clear contrast is provided to improve appearance and enhance design characteristics.

In addition, the beverage of the fourth embodiment can be manufactured as will be described below. Initially, the beer foam B is poured onto the beer liquid L. Next, the beverage is left for a predetermined time. Then, the beer foam B can be liquefied to form a layer corresponding to the above-mentioned second layer R2. Here, the standing time is preferably 20 seconds or more, more preferably 30 seconds or more, more preferably 1 minute or more, and most preferably 2 minutes or more. In this way, the beer foam B is liquefied as the standing time is increased, and the second layer R2 can be securely formed. In addition, the standing time is preferably 5 minutes or less. As the standing time is set as described above, the second layer R2 can be formed while the third layer R3 serving as the layer of the beer foam B remains.

Here, as the beverage container A, the beverage container A having a small diameter at the height position of the second layer R2 may be used. As the above-mentioned beverage container is used, the second layer R2 can be thickened even when a liquefaction amount of the beer foam B is small, and the second layer R2 can also be formed in a short time.

In addition, in the fourth embodiment, when the beer foam B is poured using the tap, the server and the pouring member of any one of the first to third embodiments, since the beer foam B is poured along the liquid surface S of the beer liquid L and the beer foam B is not easily mixed with the beer liquid L, the contrasts of the first layer R1, the second layer R2 and the third layer R3 can become clearer. Further, while the beverage of the fourth embodiment can be realized even when a nozzle configured to pour the beer foam B in a downward direction is used, for the above-mentioned reason, the beverage is more preferably manufactured using the tap, the server and the pouring member of the first to third embodiments.

In addition, in the fourth embodiment, as the liquid that constitutes the first layer R1, in addition to the beer liquid L, various liquids such as water, liqueurs, or the like, may be used, one kind of liquid may be used, or a plurality of kinds of liquids may be mixed and used. Further, as the foam body that constitutes the third layer R3, various foam bodies in addition to the beer foam B can be used.

(Fifth Embodiment)

In a fifth embodiment, for example, a guide section installed at the server 8 shown in FIG. 1 and configured to position the beverage container A at a predetermined position when the foam body is poured into the beverage container A will be described with reference to FIGS. 15 and 16.

Figure 15:
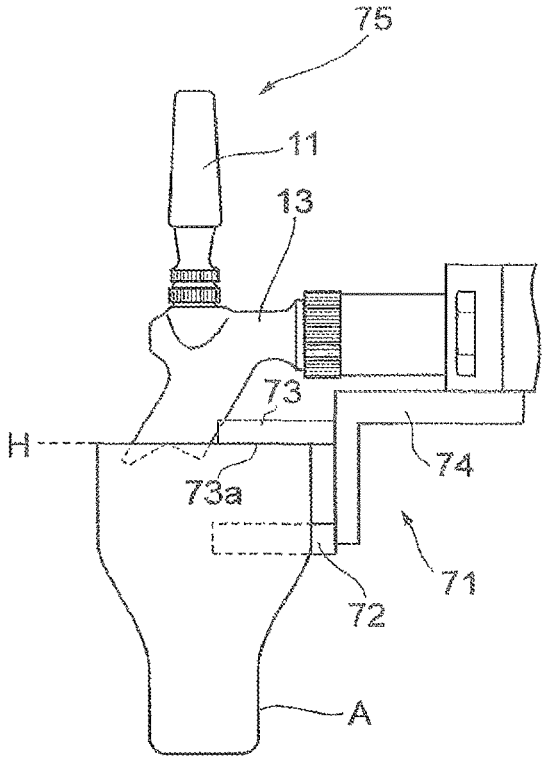
FIG. 15 is a side view and plan views showing a guide section.
Figure 15:
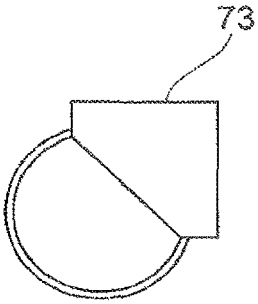
Figure 15:
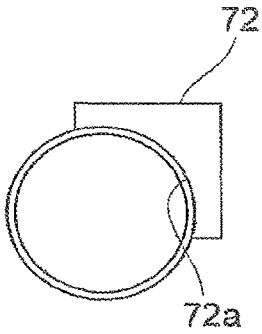

As shown in (a) in FIG. 15, like the first embodiment, a tap 75 including a guide section 71 includes a lever 11 and a tap main body 13. The guide section 71 includes a support member 74 supported by a lower section of the tap main body 13, extending toward the front side and folded downward at an end section of the front side, a height position adjustment member 73 extending from the support member 74 toward the front side and configured to adjust the height of the beverage container A to a predetermined height H or less, and a horizontal position adjustment member 72 extending from the lower end of the support member 74 toward the front side and configured to adjust a position in the horizontal direction of the beverage container A.

As shown in (b) and (c) in FIG. 15, the horizontal position adjustment member 72 has a curved section 72*a* formed along an outer circumference of the beverage container A when seen in a plan view, and as the outer circumference of the beverage container A is pressed against the curved section 72*a*, the position in the horizontal direction of the beverage container A is fixed. The height position adjustment member 73 has an abutting section 73*a* formed at a lower surface thereof and abutting the beverage container A when the beverage container A is moved upward in a state in which the outer circumference of the beverage container A is pressed against the curved section 72*a* of the horizontal position adjustment member 72 as described above. As the beverage container A abuts the abutting section 73*a* of the height position adjustment member 73, the height position of the beverage container A is fixed.

Figure 16:
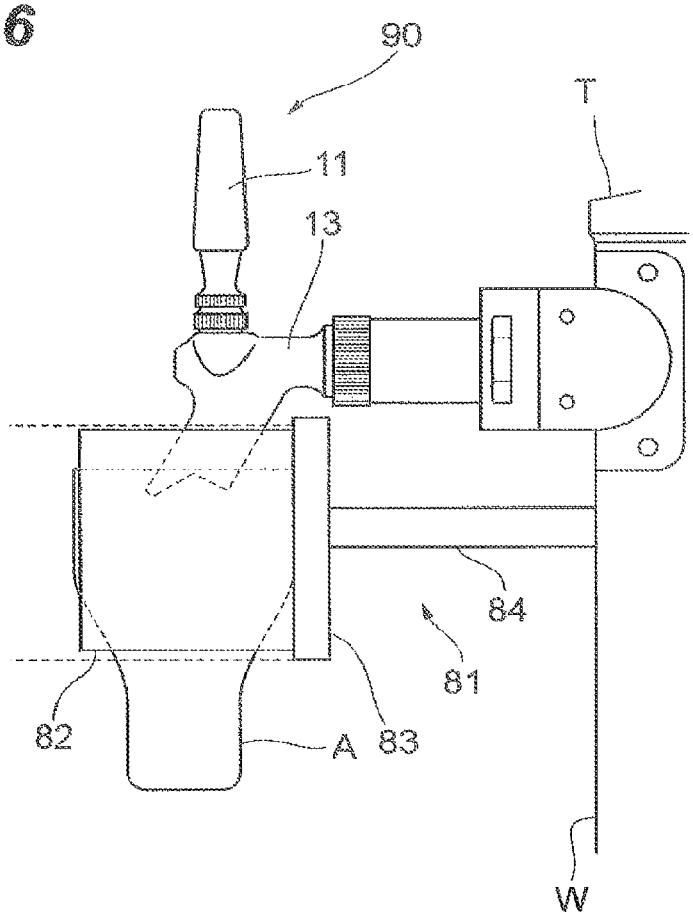
FIG. 16 is a side view and a plan view showing a guide section.
Figure 16:
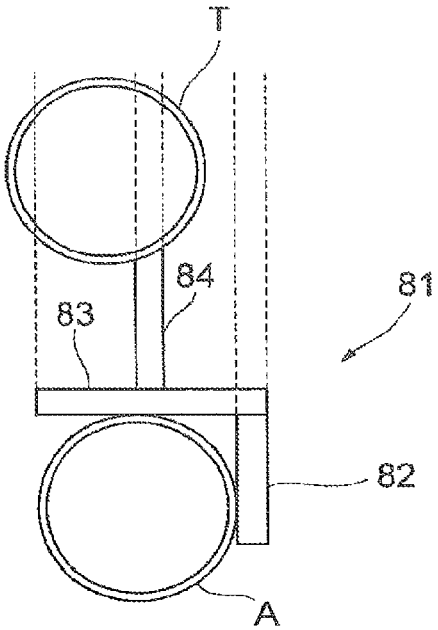

In addition, as shown in FIG. 16, in a tap 90 including a guide section 81 in a tower type server having a tower T, the guide section 81 includes an extension section 84 extending from a front sidewall section W of the tower T toward the front side, a flat plate-shaped first position adjustment member (a horizontal position adjustment member) 83 attached to a front side end section of the extension section 84, and a flat plate-shaped second position adjustment member (a horizontal position adjustment member) 82 extending from one end of the first position adjustment member 83 toward the front side. As shown in (b) in FIG. 16, a position in forward and rearward directions of the beverage container A is fixed by pressing the beverage container A against the first position adjustment member 83, and a position in leftward and rightward directions of the beverage container A is fixed by pressing the beverage container A against the second position adjustment member 82. Further, the tap 90 shown in FIG. 16 can be used with servers other than the tower type.

The above-mentioned guide section 81 includes the position adjustment members 82 and 83 configured to position the beverage container A at a predetermined position with respect to the tap 90 configured to pour the beer foam B onto the beer liquid L and adjust the horizontal position of the beverage container A with respect to the tap 90. Accordingly, the horizontal position of the beverage container A when the beer foam B is poured can be an optimal position. Accordingly, the pouring of the beer foam B can be smoothly performed, and the flow of the beer foam B with respect to the beverage container A can always be constant.

In addition, the above-mentioned guide section 71 shown in FIG. 15 includes the height position adjustment member 73 configured to adjust the height position of the beverage container A with respect to the tap 75, in addition to the horizontal position adjustment member 72. Accordingly, since the height position of the beverage container A upon pouring of the beer foam B can be an optimal position, the pouring of the beer foam B can be more smoothly performed, and a difference in elevation between the tap 75 and the beverage container A can always be constant.

In addition, as the guide sections 71 and 81 come in contact with at least a portion of an end of the beverage container A using the guide section 71 or the guide section 81, a position of the beverage container A with respect to at least one of the nozzle for a foam body and the pouring member can be fixed. The position of the beverage container A fixed as described above is preferably a position at which the beer foam B can be prevented from being scattered to the outside of the beverage container A when the beer foam B is poured into the beverage container A. When the guide section is provided as described above, since the beverage container A can be disposed at an optimal position for the pouring of the beer foam B, the beer foam B can be poured along the liquid surface S with a simple manipulation.

(Sixth Embodiment)

Next, a tap and a pouring member of a sixth embodiment will be described with reference to FIGS. 21 to 29. A tap 100 of the sixth embodiment includes a pouring member 110 corresponding to the pouring member 40 of the second embodiment. The tap 100 of the sixth embodiment is distinguished from the tap 30 of the second embodiment in that a shape of the tap 100 is different from that of the tap 30 and a liquid guide section 111 configured to guide an adhesion liquid C attached to the tap 100 away from an outlet port 112 is formed, and other details are the same as the second embodiment. Accordingly, hereinafter, only different points from the second embodiment will be described, and overlapping description will be omitted.

Figure 21:
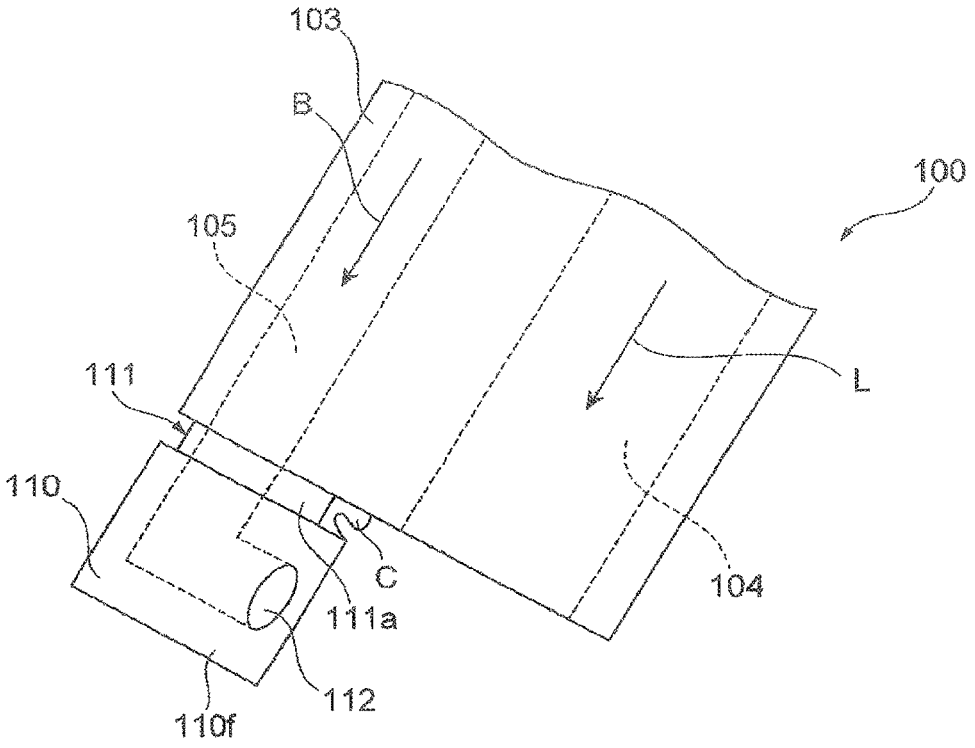
FIG. 21 is a side view showing a tap and a pouring member.
Figure 22:
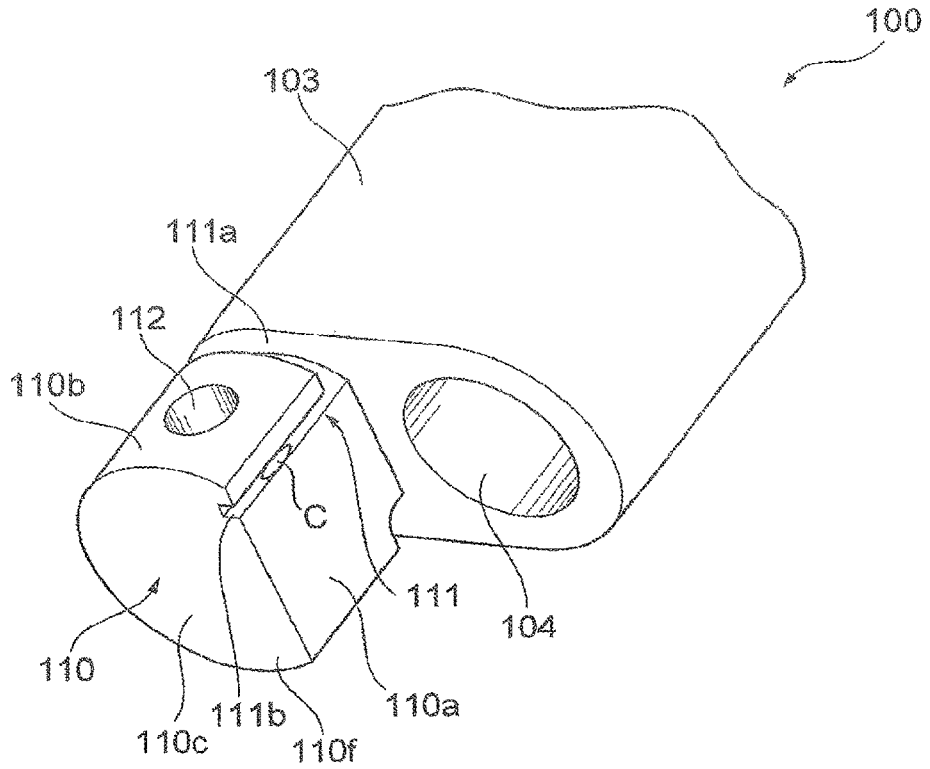
FIG. 22 is a perspective view showing the tap and the pouring member.
Figure 23:
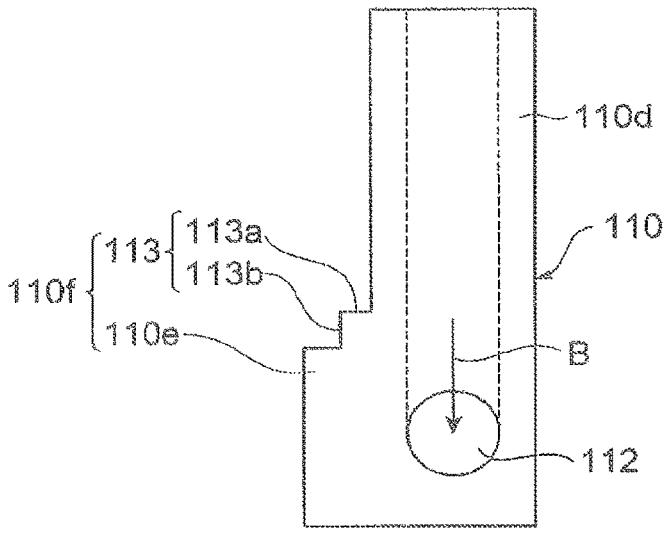
FIG. 23 is a side view showing a pouring member and a front end of the tap to which the pouring member is attached.
Figure 23:
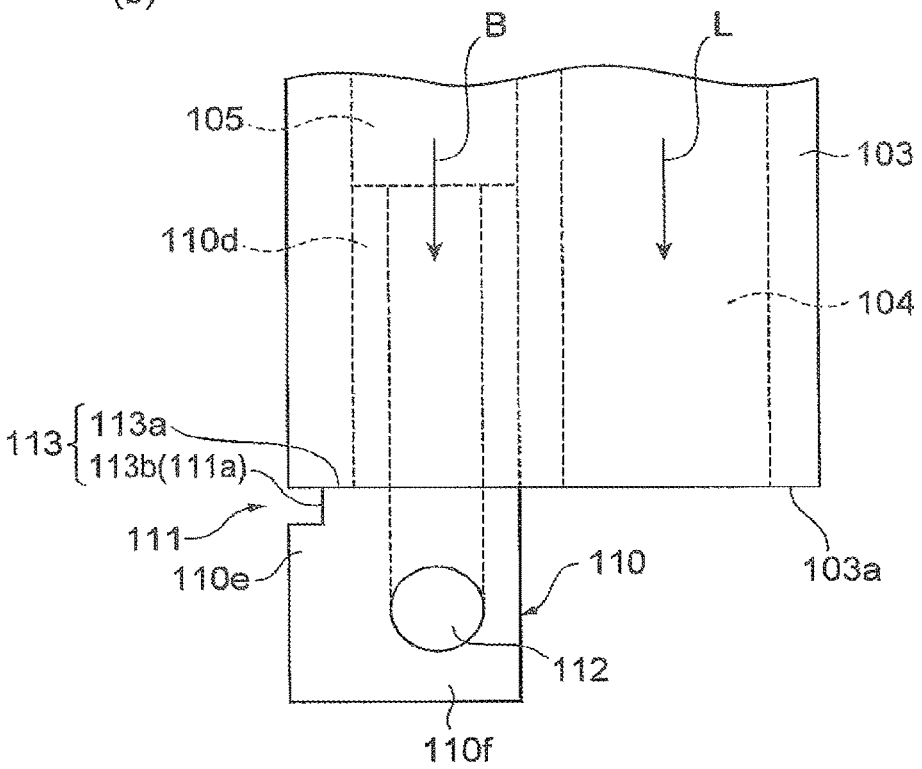

As shown in FIGS. 21 to 23, the tap 100 of the sixth embodiment has a flow path 104 for a liquid through which the beer liquid L passes and a flow path 105 for a foam body through which the beer foam B passes, which are installed at a nozzle 103. The flow path 104 for a liquid and the flow path 105 for a foam body are adjacent to each other and extend substantially in parallel. In addition, the pouring member 110 is fitted into the flow path 105 for a foam body, and has the outlet port 112 configured to discharge the beer foam B passing through the flow path 105 for a foam body to the outside.

The pouring member 110 has a fitting section 110*d* (see FIG. 23) formed in a substantially columnar shape, and an exposure section 110*f* exposed to the outside when the pouring member 110 is mounted on the nozzle 103 having a diameter that increases with respect to the fitting section 110*d*. The pouring member 110 is attached to the nozzle 103 as the fitting section 110*d* is fitted into the flow path 105 for a foam body. Accordingly, like the pouring member 40 of the second embodiment, the pouring member 110 is detachably attached to the nozzle 103. Then, the above-mentioned liquid guide section 111 is formed between the nozzle 103 and the pouring member 110 attached to the nozzle 103.

In the pouring member 110 attached to the nozzle 103, the exposure section 110*f* extends from the nozzle 103 along the flow path 105 for a foam body in a columnar shape. In addition, as shown in FIG. 22, the pouring member 110 has a first side surface 110*a* disposed at the side of the flow path 104 for a liquid, a second side surface 110*b* at which the outlet port 112 is formed, and a bottom surface 110*c* having a flat shape. The first side surface 110*a* disposed at the side of the flow path 104 for a liquid is formed in a flat shape in which a portion overhanging toward the flow path 104 for a liquid in the columnar exposure section 110*f* is cut out. Since the first side surface 110*a* is formed in a flat shape in which a portion overhanging toward the flow path 104 for a liquid is cut out as described above, in comparison with the case in which the exposure section 110*f* is formed in a columnar shape, the beer liquid L poured from the flow path 104 for a liquid does not easily abut the pouring member 110.

The liquid guide section 111 has a first groove section 111*a* extending in a direction substantially perpendicular to the flow path 105 for a foam body at an upper side of the outlet port 112, and a second groove section 111*b* extending substantially parallel to the flow path 105 for a foam body at an end section of the side of the flow path 104 for a liquid in the first groove section 111*a*. That is, the first groove section 111*a* is formed at the nozzle 103 side of the outlet port 112, and the second groove section 111*b* extends in a direction along the flow path 105 for a foam body at a position spaced apart from the outlet port 112.

As shown in (a) and (b) in FIG. 23, the pouring member 110 has the above-mentioned fitting section 110*d*, a diameter expanding section 110*e* having a diameter that expands toward the fitting section 110*d*, and a stepped section 113 having a stair shape and formed between the fitting section 110*d* and the diameter expanding section 110*e*. The above-mentioned exposure section 110*f* is constituted by the stepped section 113 and the diameter expanding section 110*e*. The stepped section 113 has a first surface 113*a* extending perpendicularly from a surface of the fitting section 110*d*, and a second surface 113*b* extending perpendicular to the first surface 113*a* from a front edge of the first surface 113*a*. For this reason, the fitting section 110*d* of the pouring member 110 is fitted into the flow path 105 for a foam body, and the first groove section 111*a* is formed using the second surface 113*b* as a bottom surface as the first surface 113*a* comes in contact with an end surface 103*a* of the nozzle 103.

As shown in FIG. 21, the first groove section 111*a* of the liquid guide section 111 is a groove that condensation generated on the surface of the nozzle 103 or the adhesion liquid C such as the beer liquid L or the like enters. That is, the adhesion liquid C that moves downward along the surface of the nozzle 103 enters the first groove section 111*a*. In addition, as shown in FIG. 22, the second groove section 111*b* is a groove configured to guide the adhesion liquid C not to arrive at the outlet port 112 and discharge the adhesion liquid C to a lower side of the pouring member 110. That is, the adhesion liquid C that enters the first groove section 111*a* flows along the first groove section 111*a* and arrives at the second groove section 111*b*, and is discharged to the lower side of the pouring member 110 after flowing along the second groove section 111*b*.

In this way, the liquid guide section 111 configured to guide the adhesion liquid C away from the outlet port 112 of the beer foam B is formed at the pouring member 110 that constitutes the front end section of the flow path of the beer foam B. Accordingly, since the adhesion liquid C can be guided not to be directed toward the outlet port 112 as the adhesion liquid C enters the groove sections 111*a* and 111*b*, a situation in which pouring of the beer foam B from the outlet port 112 is disturbed by the adhesion liquid C can be avoided.

Here, when there is no liquid guide section 111, the adhesion liquid C remains in the vicinity of the outlet port 112, the adhesion liquid C and the beer foam B come in contact with the outlet port 112 due to surface tension of the adhesion liquid C, and thus the beer foam B may be scattered and flow out. However, in the sixth embodiment, since a configuration configured to prevent arrival of the adhesion liquid C at the outlet port 112 is provided by including the liquid guide section 111, a situation in which pouring of the beer foam B from the outlet port 112 is disturbed by the adhesion liquid C can be avoided, and the beer foam B can be securely poured in a desired direction.

In addition, in the sixth embodiment, since the liquid guide section 111 is formed at the pouring member 110, a configuration configured to guide the adhesion liquid C away from the outlet port 112 can be easily realized by merely attaching the pouring member 110 to the tap of the related art.

Further, while the direction in which the first and second groove sections 111*a* and 111*b* extend is not limited thereto, the second groove section 111*b* preferably extends in a vertical direction when the pouring member 110 is attached to the nozzle 103 to pour the beer foam B. When the second groove section 111*b* extends in the vertical direction in this way, since the adhesion liquid C that enters the second groove section 111*b* is likely to drop, the adhesion liquid C can be more efficiently discharged. Further, as shown in FIG. 23, the first surface 113*a* of the stepped section 113 extends perpendicular to the fitting section 110*d*, and the second surface 113*b* extends perpendicular to the first surface 113*a*. However, according to a shape in which the first groove section 111*a* of the liquid guide section 111 is formed when the pouring member 110 is attached to the nozzle 103, the shape of the stepped section 113 can be appropriately varied.

Figure 27:
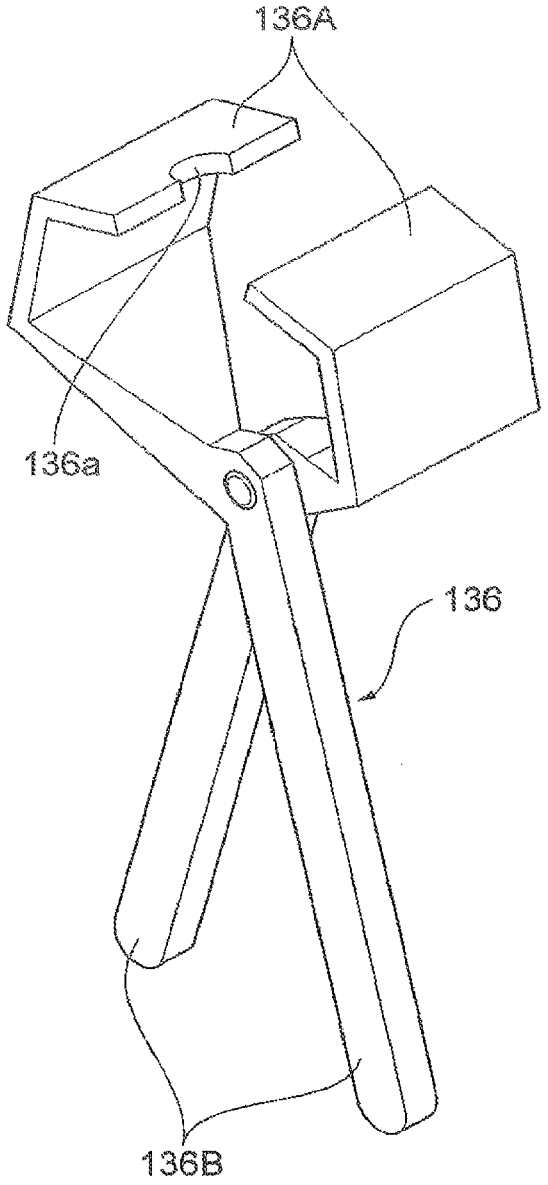
FIG. 27 is a view for describing a means configured to remove a pouring member from a tap.
Figure 28:
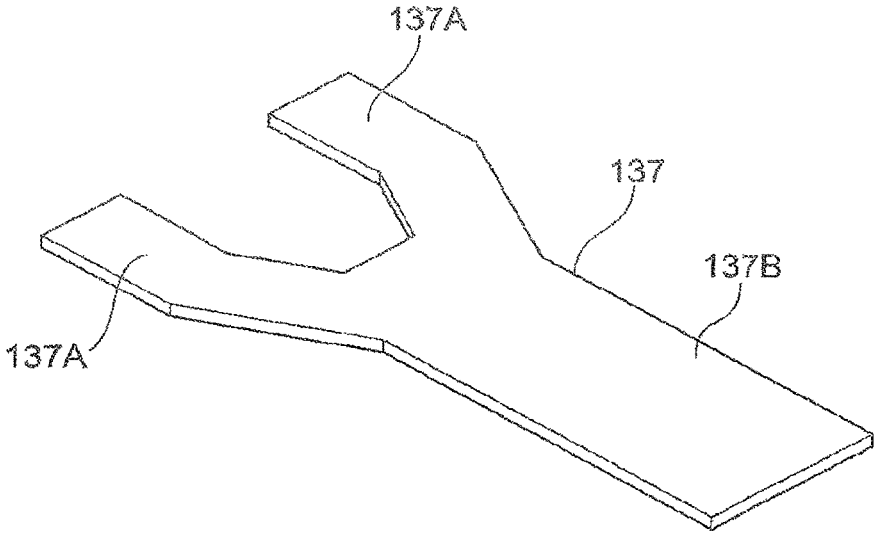
FIG. 28 is a view for describing the means configured to remove the pouring member from the tap.

As shown in FIGS. 27 and 28, the pouring member 110 can be removed from the nozzle 103 using a pliers type attachment/detachment tool 136 or a spanner type attachment/detachment tool 137. In addition, as shown in FIG. 30, the pouring member 110 may be removed from the nozzle 103 using an attachment/detachment tool that is referred to as a pouring member attachment/detachment jig 130 in the embodiment.

Figure 29:
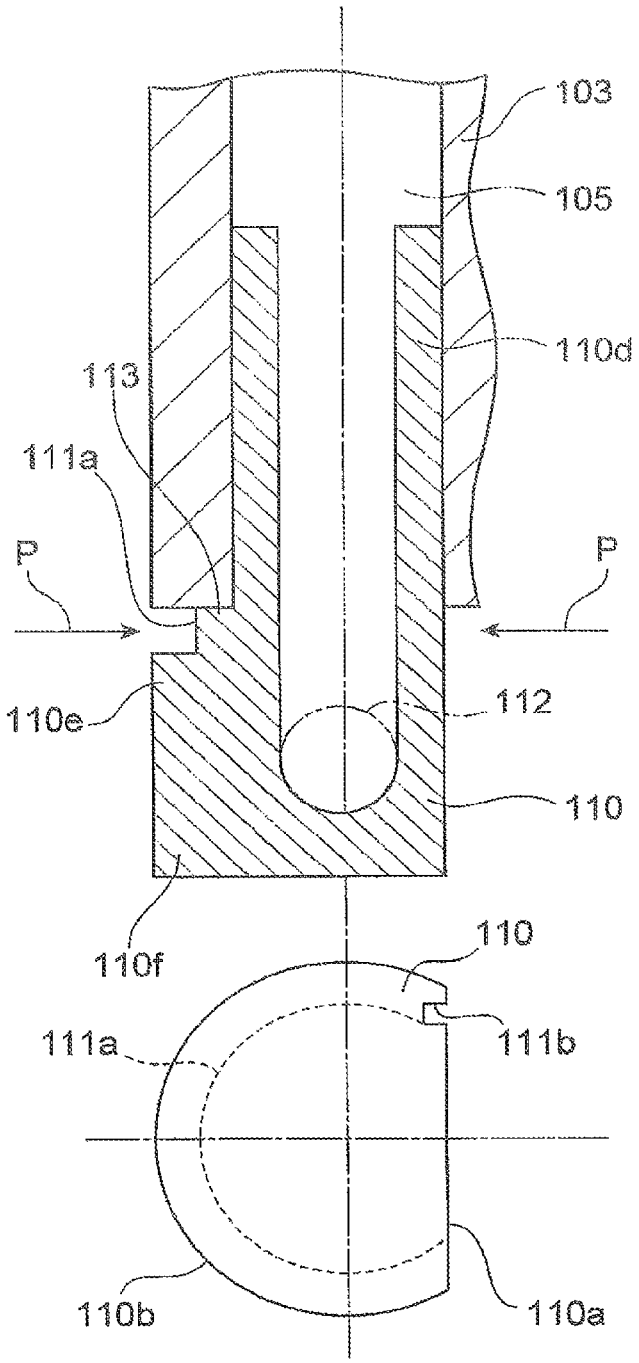
FIG. 29 shows a cross-sectional view and a bottom view of a nozzle and a pouring member.

The pliers type attachment/detachment tool 136 has a pair of flat plate-shaped clipping sections 136A having a cutout section 136*a* formed at one of the clipping sections 136A, and gripping sections 136B configured to grip and adjust an interval between the clipping sections 136A. As shown in FIGS. 27 and 29, the cutout section 136*a* of the clipping section 136A is inserted into a groove section 111*a* of the pouring member 110, and as shown by an arrow P, the gripping section 136B is gripped to sandwich the pouring member 110 with the pair of clipping sections 136A, the attachment/detachment tool 136 is moved downward in this state, and thus the pouring member 110 can be removed from the nozzle 103. In addition, similarly, as the attachment/detachment tool 136 is moved upward in a state in which the pouring member 110 is sandwiched between the pair of clipping sections 136A, the pouring member 110 can also be mounted on the nozzle 103. In this way, the pouring member 110 can be detachably attached to the nozzle 103 by sandwiching the pouring member 110 between the clipping sections 136A, the groove section 111*a* configured to collect and guide the adhesion liquid C can also function as a groove configured to detachably attach the pouring member 110.

Figure 30:
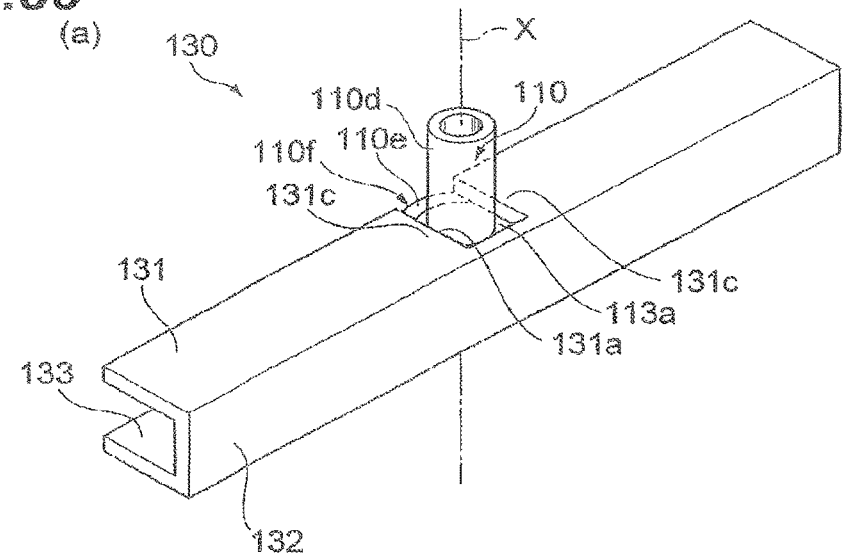
FIG. 30 shows a perspective view, a plan view and a bottom view of a pouring member attachment/detachment jig.
Figure 30:
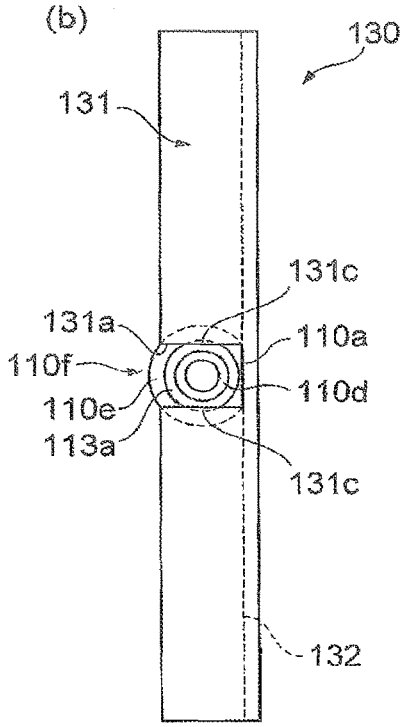
Figure 30:
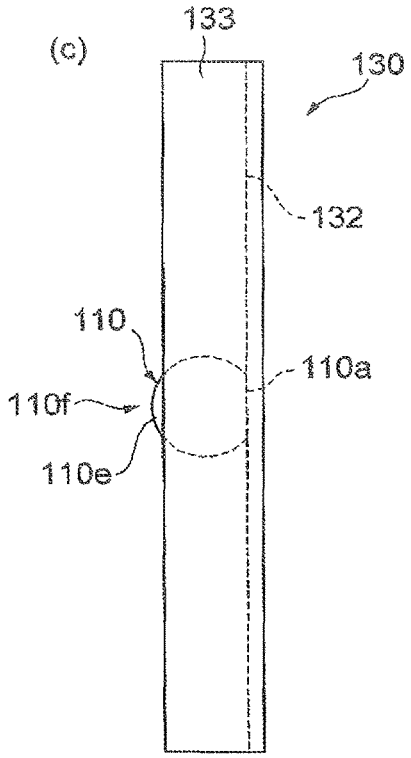

In addition, as shown in FIGS. 28 and 30, the spanner type attachment/detachment tool 137 has a pair of clipping sections 137A and a gripping section 137B. The clipping section 137A is inserted into the groove section 111*a* of the pouring member 110, the gripping section 137B is gripped to move the attachment/detachment tool 137 downward in a state in which the pouring member 110 is sandwiched between the pair of clipping sections 137A as shown by the arrow P, and thus the pouring member 110 can be removed from the nozzle 103. In this way, the pouring member 110 can be removed from the nozzle 103 by sandwiching the pouring member 110 between the clipping sections 137A, and even in this case, the groove section 111*a* configured to collect and guide the adhesion liquid C can also function as a groove configured to detachably attach the pouring member 110.

Further, the pouring member 110 can be detachably attached to the nozzle 103 using the pouring member attachment/detachment jig 130 shown in FIG. 30. The pouring member attachment/detachment jig 130 extends in a linear shape, and a cross-section of the pouring member attachment/detachment jig 130 has substantially a Ɔ shape formed of an upper plate section 131, a side plate section 132 and a lower plate section 133. A cutout section 131*a* into which the fitting section 110*d* is inserted to hook the exposure section 110*f* to the pouring member attachment/detachment jig 130 is formed at the upper plate section 131. A material of the pouring member attachment/detachment jig 130 may be a metal or the like that cannot be easily bent, for example, stainless steel. In addition, the pouring member attachment/detachment jig 130 can be manufactured through sheet metal working using, for example, stainless steel or the like.

When the pouring member 110 is mounted on the nozzle 103 using the pouring member attachment/detachment jig 130, first, the fitting section 110*d* is inserted into the cutout section 131*a* to fit the exposure section 110*f* of the pouring member 110 between the upper plate section 131 and the lower plate section 133, a flat-shaped side surface 110*a* comes in contact with the inside of the side plate section 132, and thus the fitting section 110*d* protrudes upward from the cutout section 131*a*. Then, the pouring member attachment/detachment jig 130 is gripped in this state, the fitting section 110*d* is inserted into the flow path 105 for a foam body, the fitting section 110*d* is not easily fitted into the flow path 105 for a foam body while the pouring member attachment/detachment jig 130 is swung about an axis X passing through a center of the fitting section 110*d*, and thus the fitting section 110*d* can be fitted into the flow path 105 for a foam body to mount the pouring member 110 on the nozzle 103.

In addition, when the pouring member 110 is removed from the nozzle 103 using the pouring member attachment/detachment jig 130, first, clipping sections 131*c* disposed at both sides of the cutout section 131*a* are inserted into the groove section 111*a* (see FIG. 29) of the pouring member 110 to sandwich the pouring member 110 between the pair of clipping sections 131*c*. Then, the flat-shaped side surface 110*a* comes in contact with the inside of the side plate section 132, and the exposure section 110*f* is fitted between the upper plate section 131 and the lower plate section 133. The pouring member attachment/detachment jig 130 is gripped in this state, the pouring member attachment/detachment jig 130 is lowered while swinging about the axis X, and thus the fitting section 110*d* can be removed from the flow path 105 for a foam body to detach the pouring member 110 from the nozzle 103.

In this way, the pouring member 110 can be detachably attached to the nozzle 103 using the pouring member attachment/detachment jig 130. Here, as described above, since the pouring member attachment/detachment jig 130 extends in a linear shape, the pouring member attachment/detachment jig 130 can be easily swung by gripping the pouring member attachment/detachment jig 130. In addition, when the pouring member 110 is held by the pouring member attachment/detachment jig 130, since the flat-shaped side surface 110*a* comes in contact with the inner side surface of the side plate section 132, the pouring member 110 can be easily fitted into the pouring member attachment/detachment jig 130, and a force can be securely transmitted to the pouring member 110 from the pouring member attachment/detachment jig 130. Accordingly, the pouring member 110 can be simply detachably attached to the nozzle 103 using the pouring member attachment/detachment jig 130. Further, in FIG. 30, while a jig having the upper plate section 131, the side plate section 132 and the lower plate section 133 is exemplified as the pouring member attachment/detachment jig, the pouring member 110 can be removed from the nozzle 103 using a jig having the upper plate section 131 and the side plate section 132 without the lower plate section 133, and a shape of the pouring member attachment/detachment jig may be appropriately varied.

As described above, the attachment/detachment tools 136 and 137 and the pouring member attachment/detachment jig 130 include the pairs of clipping sections 136A, 137A and 131*c* that sandwich the pouring member 110 therebetween, respectively, and detachably attach the pouring member 110 to the tap 100 by sandwiching the pouring member 110 between the pairs of clipping sections 136A, 137A and 131*c*. Accordingly, since the pouring member 110 can be pushed into the flow path 105 for a foam body of the tap 100 or extracted from the tap 100 while the pouring member 110 is sandwiched, attachment/detachment of the pouring member 110 with respect to the tap 100 can be easily performed.

(Seventh Embodiment)

Next, a tap of a seventh embodiment will be described with reference to FIGS. 31 to 41. The seventh embodiment is distinguished from the first embodiment in that the tap of the seventh embodiment includes a pouring member configured to control a shape of the poured beer foam B. In the seventh embodiment, various aspects of the pouring member will be described. The pouring member as will be described below is detachably attached to the front end of the nozzle 15 for a foam body, and can control the shape of the beer foam B poured from the nozzle 15 for a foam body. Further, the pouring member is not limited to being detachably attached to the nozzle 15 for a foam body but may be integrally formed with the nozzle 15 for a foam body.

Figure 31:
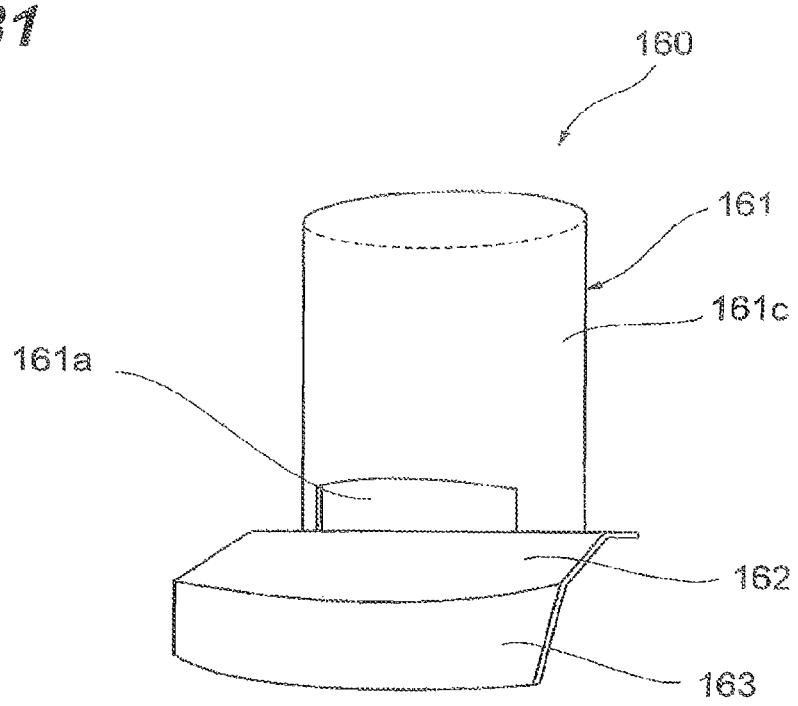
FIG. 31 is a perspective view showing a pouring member of another embodiment.
Figure 31:
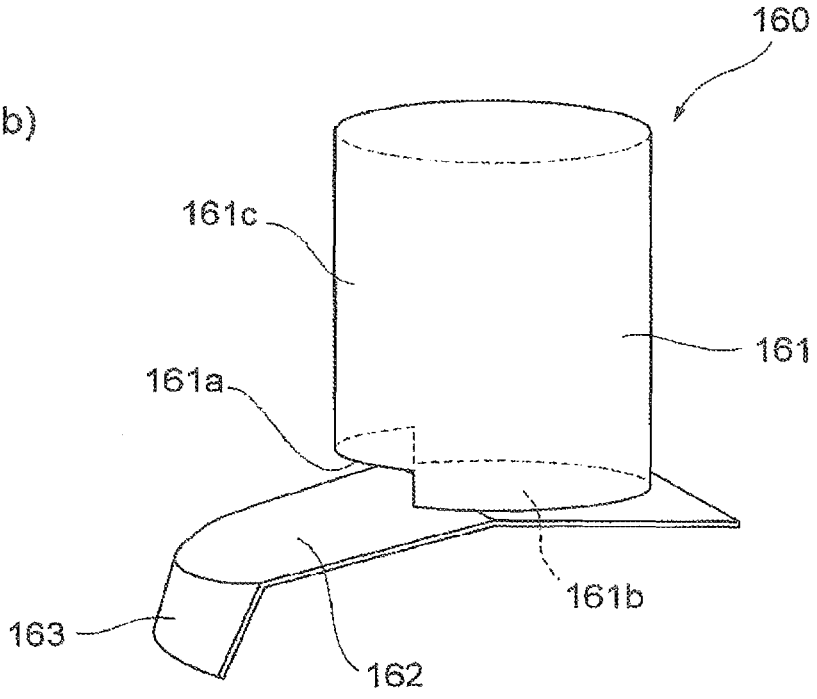

As shown in FIG. 31, a pouring member 160 is fitted onto the front end of the nozzle 15 for a foam body. In addition, the pouring member 160 includes a foam reception section 161 having a bottomed cylindrical shape and configured to receive the beer foam B dropped from the nozzle 15 for a foam body, and a first foam guide section 162 and a second foam guide section 163 that are configured to guide the beer foam B received by the foam reception section 161 in an inclined downward direction.

An inner diameter of the foam reception section 161 is substantially the same as an outer diameter of the nozzle 15 for a foam body, and can fit the foam reception section 161 into the front end of the nozzle 15 for a foam body. The foam reception section 161 has an outlet port 161*a* configured to discharge the beer foam B received from the nozzle 15 for a foam body to the outside of the foam reception section 161. The outlet port 161*a* is disposed at a lower end of a side surface 161*c* of the foam reception section 161 in a state in which the foam reception section 161 is fitted onto the nozzle 15 for a foam body. Since the outlet port 161*a* extends in a lateral direction along a bottom surface 161*b* of the foam reception section 161, the beer foam B received by the foam reception section 161 is discharged from the outlet port 161*a* after expanding in the lateral direction.

The first foam guide section 162 is a plate-shaped portion extending from the outlet port 161*a* of the foam reception section 161 in an inclined downward direction, and the second foam guide section 163 is a plate-shaped portion extending from the front end of the first foam guide section 162 in a further inclined downward direction. An inclination angle of the second foam guide section 163 with respect to the bottom surface 161*b* of the foam reception section 161 is larger than an inclination angle of the first foam guide section 162 with respect to the bottom surface 161*b* of the foam reception section 161. The first foam guide section 162 guides the beer foam B such that the beer foam B discharged from the outlet port 161*a* flows downward along an upper surface of the first foam guide section 162. The second foam guide section 163 guides the beer foam B such that the beer foam B flowing downward along the upper surface of the first foam guide section 162 flows downward in the further inclined downward direction.

Figure 32:
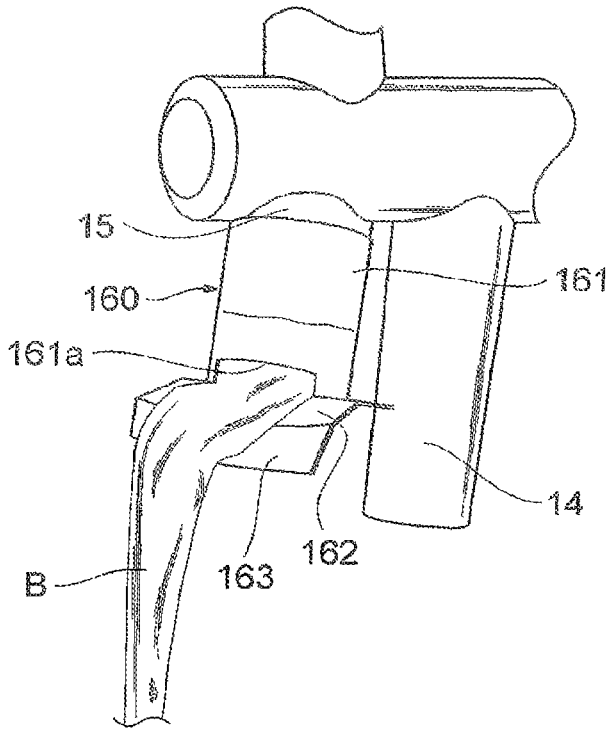
FIG. 32 is a perspective view showing a state in which the pouring member of FIG. 31 is attached to a nozzle for a foam body and a situation in which a beer foam flows out.

As shown in FIG. 32, the beer foam B entering the foam reception section 161 having a cylindrical shape from above comes in contact with the bottom surface 161*b* of the foam reception section 161, arrives at the outlet port 161*a* of the foam reception section 161 while expanding along the bottom surface 161*b*, and flows along the first and second foam guide sections 162 and 163 in an inclined downward direction. Accordingly, as the pouring member 160 is attached to the front end of the nozzle 15 for a foam body, since the beer foam B flows along the first and second foam guide sections 162 and 163, the beer foam B can beautifully flow in the shape of a waterfall. Accordingly, a design characteristic of the poured beer foam B is improved.

In addition, in comparison with the case in which there is no pouring member 160, since a foam-attaching direction of the beer foam B is approximately a horizontal direction, the beer foam B can flow along the liquid surface of the beer liquid L, and the beer foam B is not easily incorporated into the beer liquid L. Accordingly, foam durability of the beer foam B on the liquid surface of the beer liquid L is improved.

Here, provisionally, when the first foam guide section 162 extends in the horizontal direction without the second foam guide section 163, the beer foam B goes around the bottom of the first foam guide section 162 from the front end of the first foam guide section 162 due to the surface tension. However, in the embodiment, since the first and second foam guide sections 162 and 163 are folded in an inclined downward direction, the beer foam B does not easily go around the bottom of the foam guide section 162 as described above. In addition, since the pouring member 160 has a two-stepped inclined surface including the first foam guide section 162 and the second foam guide section 163, the beer foam B flows downward along the first and second foam guide sections 162 and 163 more smoothly. Accordingly, the beer foam B does not easily go around the bottom of the foam guide sections 162 and 163.

Further, instead of folding the first and second foam guide sections 162 and 163 in the inclined downward direction, the beer foam B does not easily go around the bottom of the foam guide sections 162 and 163 even when a flow velocity of the beer foam B is increased. In addition, in the pouring member 160, instead of the first and second foam guide sections 162 and 163 folded in the inclined downward direction, the pouring member 160 may be inclined as a whole. Further, the second foam guide section 163 may be omitted.

Figure 33:
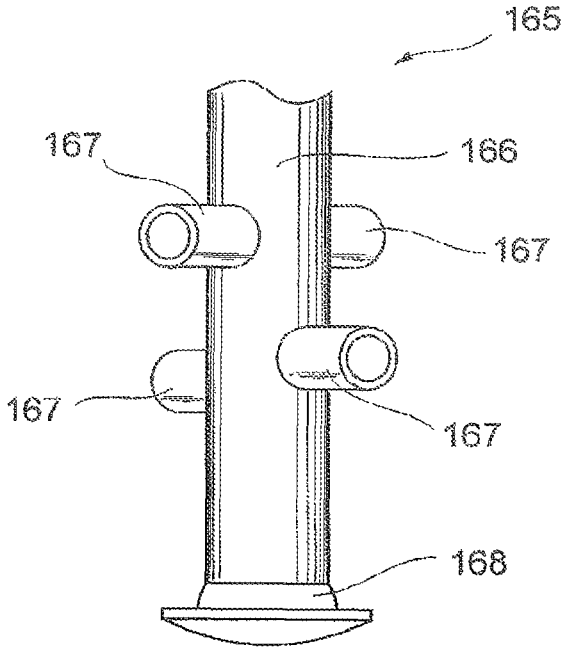
FIG. 33 is a perspective view showing the pouring member.

As shown in FIG. 33, a pouring member 165 includes a foam reception section 166 having a cylindrical shape and configured to receive the beer foam B poured from the nozzle 15 for a foam body, four branch sections 167 branched off from the foam reception section 166 and including a flow path of the beer foam B, and a bottom section 168 configured to seal a lower end of the foam reception section 166. Further, instead of the foam reception section 166 having the cylindrical shape, the bottom section 168 may be omitted using the foam reception section having a bottomed cylindrical shape.

Each of the branch sections 167 protrudes substantially perpendicularly from the surface of the foam reception section 166, and a front end of each of the branch sections 167 is opened in a substantially horizontal direction when the pouring member 160 is attached to the nozzle 15 for a foam body. In addition, the branch sections 167 are disposed at equal intervals with a phase angle of for example, 90 degrees.

Figure 34:
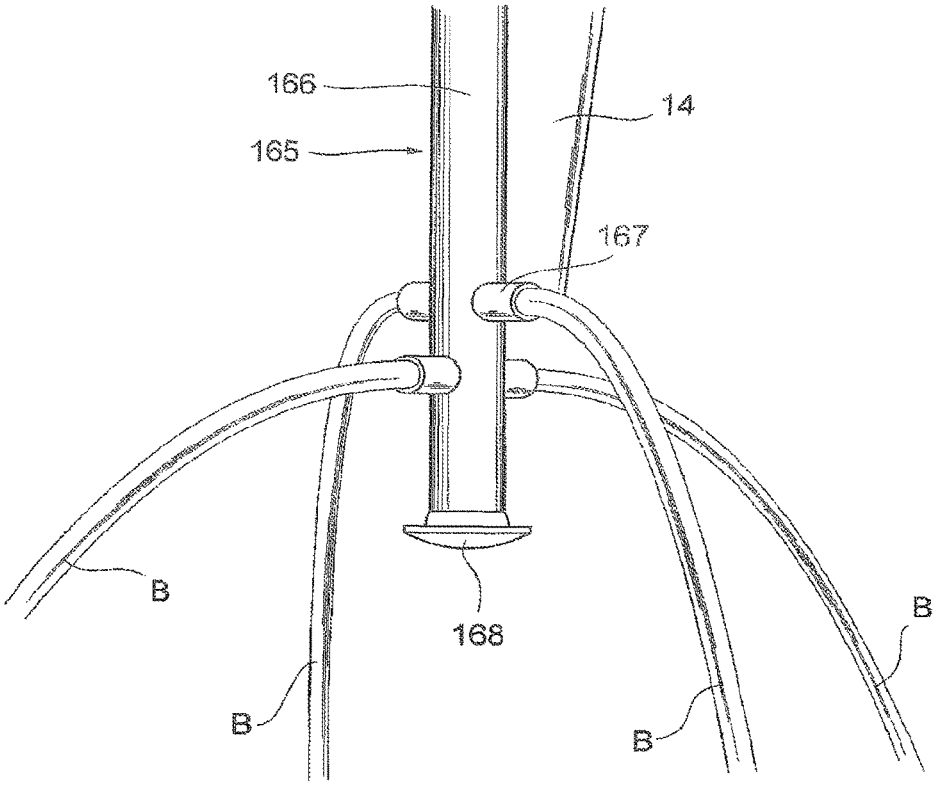
FIG. 34 is a perspective view showing a state in which the pouring member of FIG. 33 is attached to the nozzle for the foam body and a situation in which the beer foam flows out.

As shown in FIG. 34, the beer foam B received from the nozzle 15 for a foam body by the foam reception section 166 remains in the foam reception section 166. Then, the beer foam B is radially poured from the branch sections 167. In this way, since the beer foam B is poured from the branch sections 167 to radially expand, a design characteristic of the poured beer foam B is improved. In addition, since the beer foam B is poured along the liquid surface of the beer liquid L in comparison with the case in which there is no pouring member 165, like the above-mentioned pouring member 160, the beer foam B does not easily dissolve in the beer liquid L. Accordingly, since the poured beer foam B is not easily incorporated into the beer liquid L, foam durability of the beer foam B on the liquid surface of the beer liquid L is improved. Further, the shapes of the foam reception section 166 and the branch sections 167, a disposition interval of the branch sections 167 and the number of the branch sections 167 can be appropriately varied.

Figure 35:
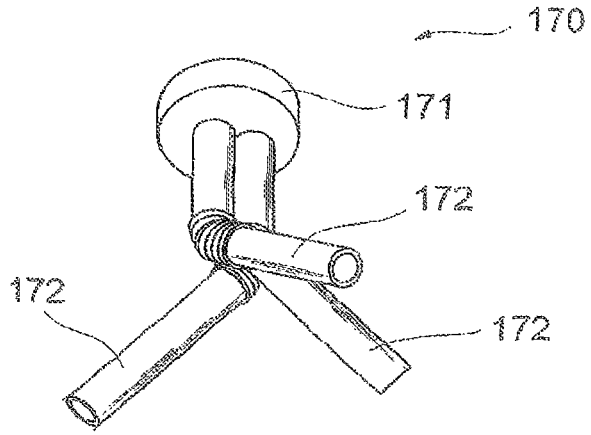
FIG. 35 is a perspective view showing the pouring member.
Figure 35:
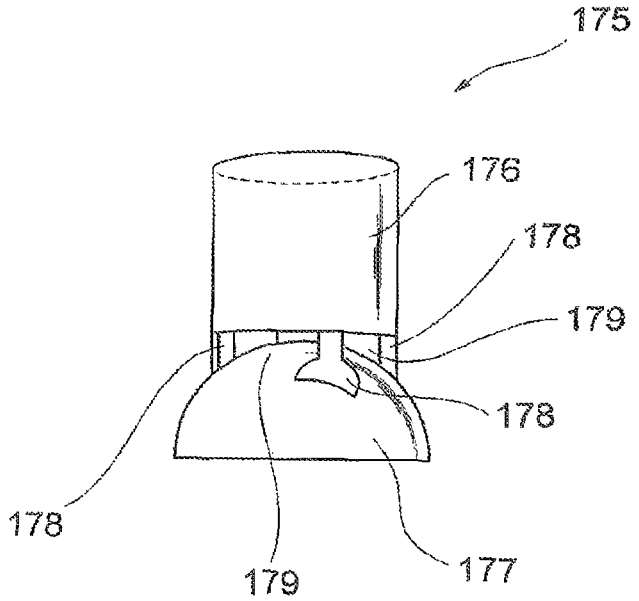

As shown in (a) in FIG. 35, a pouring member 170 includes a foam reception section 171 having a bottomed cylindrical shape, and three tube members 172 having a flow path in communication with a bottom surface of the foam reception section 171. Each of the tube members 172 can be folded such that a front end side is oriented in various directions with respect to a proximal end section of the tube member 172 extending downward from the foam reception section 171.

In the pouring member 170, since the beer foam B received by the foam reception section 171 is poured through the tube members 172, like the above-mentioned pouring member 165, the beer foam B can be poured to radially expand. In addition, in the pouring member 170, a pouring angle of the poured beer foam B with respect to the liquid surface can be adjusted by adjusting a folding angle of each of the tube members 172, and foam durability of the beer foam B can be improved. Further, the number of tube members 172 is not limited to 3 but may be 2 or 4 or more.

As shown in (b) in FIG. 35, a pouring member 175 includes a foam reception section 176 having a cylindrical shape, and a foam guide section 177 having a hemispherical shape and connected to a lower section of the foam reception section 176 via three leg sections 178 extending downward from the foam reception section 176. In the pouring member 175, the leg sections 178 are disposed at equal intervals in a circumferential direction of the foam reception section 176. Then, the beer foam B received from the nozzle 15 for a foam body by the foam reception section 176 is poured along the spherical surface of the foam guide section 177 through a space 179 formed between the leg sections 178. Even in the pouring member 175, since the beer foam B can be poured along the liquid surface of the beer liquid L in comparison with the case in which there is no pouring member 175, foam durability of the beer foam B on the liquid surface can be improved.

Further, while the number of leg sections 178 is 3 in the above-mentioned pouring member 175, the number of leg sections 178 may be 1, 2 or 4 or more. In addition, while the foam guide section 177 has a hemispherical shape, the shape of the foam guide section 177 may be, for example, a conical or triangular pyramidal shape or may be appropriately varied.

Figure 36:
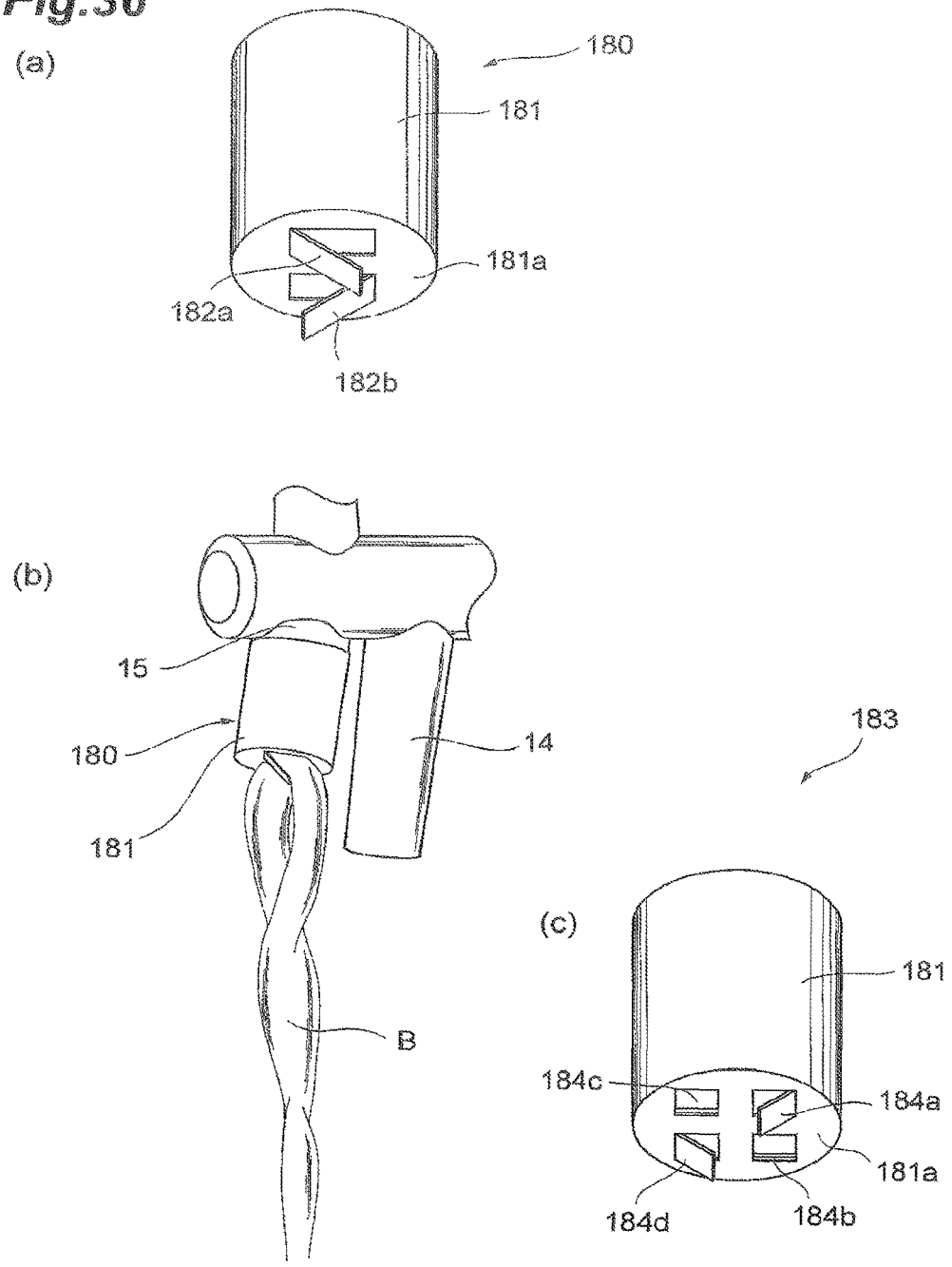
FIG. 36 is a perspective view showing the pouring member, a state in which the pouring member is attached to the nozzle for the foam body, and a situation in which the beer foam flows out.

As shown in (a) in FIG. 36, a pouring member 180 includes a foam reception section 181 having a bottomed cylindrical shape and configured to receive the beer foam B poured from the nozzle 15 for a foam body. A first cutout section 182*a* cut out and folded downward in substantially a Ɔ shape and a second cutout section 182*b* cut out and folded downward in substantially a C shape are formed at a bottom surface 181*a* of the foam reception section 181.

As shown in (b) in FIG. 36, when the beer foam B is received from the nozzle 15 for a foam body by the foam reception section 181, the beer foam B is formed in a twisted shape and poured onto the liquid surface of the beer liquid L due to the surface tension of the beer foam B. As a result, the shape of the beer foam B can be controlled, and a design characteristic of the beer foam B is improved. In addition, the beer foam B can be poured along the liquid surface of the beer liquid L in comparison with the case in which there is no pouring member 180, and foam durability of the beer foam B on the liquid surface can be improved. Further, in the pouring member 180, the number of cutout sections and disposition aspects can be appropriately varied.

For example, as shown in (c) in FIG. 36, a pouring member 183 having four cutout sections 184*a*, 184*b*, 184*c* and 184*d* cut out and folded in different directions can be used. When the pouring member 183 is used, the beer foam B poured from the cutout sections 184*a*, 184*b*, 184*c* and 184*d* joins therebelow, and the beer foam B is formed in a twisted shape to be poured onto the liquid surface of the beer liquid L. Accordingly, the same effect as when the pouring member 180 is used can be obtained.

Figure 37:
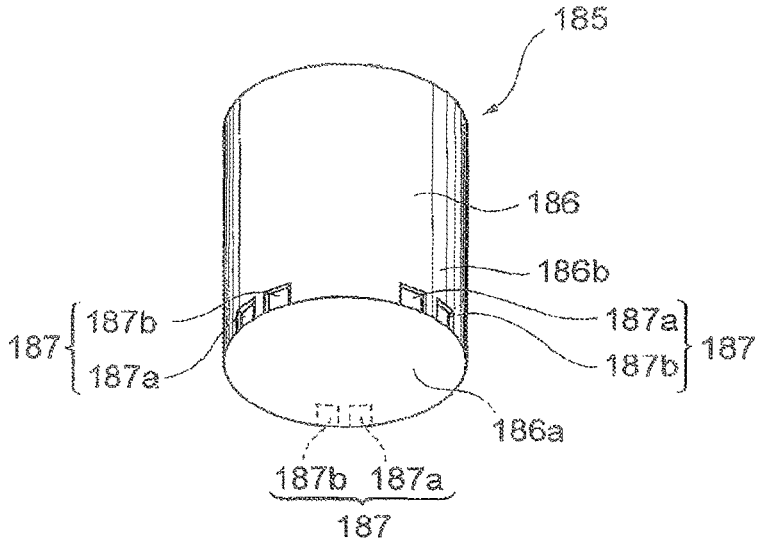
FIG. 37 is a perspective view showing the pouring member, a state in which the pouring member is attached to the nozzle for the foam body, and a situation in which the beer foam flows out.
Figure 37:
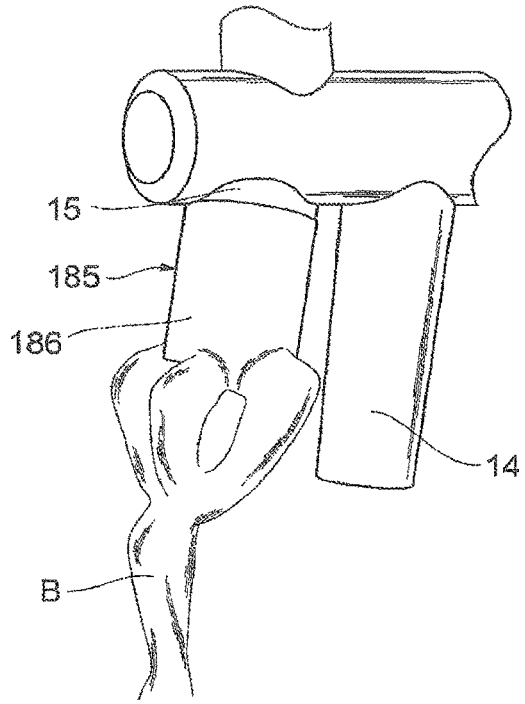

As shown in (a) in FIG. 37, a pouring member 185 includes a foam reception section 186 having a bottomed cylindrical shape and configured to receive the beer foam B poured from the nozzle 15 for a foam body. A foam pouring section 187 is formed at an end section of a bottom surface 186*a* side in a side surface 186*b* of the foam reception section 186. Three foam pouring sections 187 are formed at equal intervals in the circumferential direction of the foam reception section 186. Each of the foam pouring sections 187 has rectangular cutout sections 187*a* and 187*b* formed in parallel in the circumferential direction of the foam reception section 186.

As shown in (b) in FIG. 37, in the pouring member 185, the beer foam B received from the nozzle 15 for a foam body by the foam reception section 186 is expanded on the bottom surface 186*a* of the foam reception section 186 to be poured from the cutout sections 187*a* and 187*b* of the foam pouring sections 187. The beer foam B poured from the cutout sections 187*a* and 187*b* forms a flow such that the beer foam B joins therebelow again. In this way, the shape of the beer foam B can be controlled using the pouring member 185, and a design characteristic of the beer foam B is improved. Further, in the pouring member 185, the number and disposition aspects of the foam pouring sections 187, and the number and disposition aspects of the cutout sections 187*a* and 187*b* are not limited but may be appropriately varied.

In addition, in the pouring member 180 shown in FIG. 36 and the pouring member 185 shown in FIG. 37, the shape, the number and disposition aspects of the cutout sections serving as holes through which the beer foam B is poured, and a distance between the cutout section and another cutout section are adjusted, the shape of the beer foam B poured from the pouring member can be varied. In addition, the pouring shape of the beer foam B can also be varied by varying a flow velocity of the beer foam B upon pouring, and for example, when the flow velocity of the beer foam B is low, the beer foam B as shown in (b) in FIG. 37 is likely to join at a lower part. A diameter of the hole through which the beer foam B is poured may be, for example, 0.6 mm, 0.8 mm or 1.0 mm. As the diameter of the hole through which the beer foam B is poured is reduced, since the pouring of the beer foam B can be finely performed, the diameter of the hole is preferably small.

Figure 38:
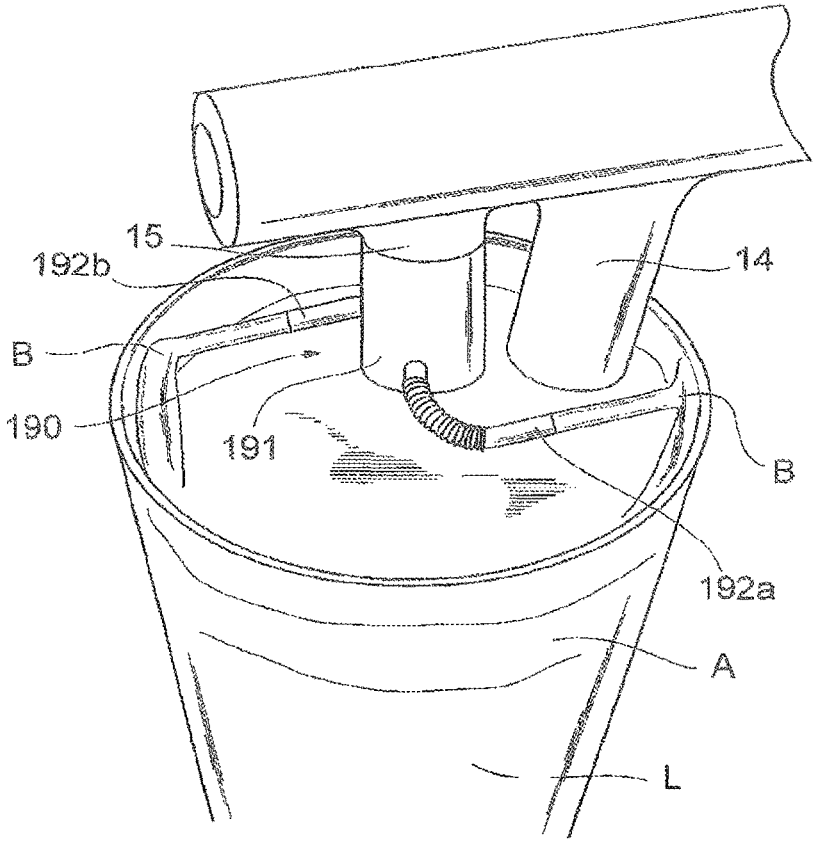
FIG. 38 is a view showing a pouring member of another embodiment, a state in which the pouring member is attached to a nozzle for a foam body, a situation in which a beer foam flows out, and a flow of the beer foam.
Figure 38:
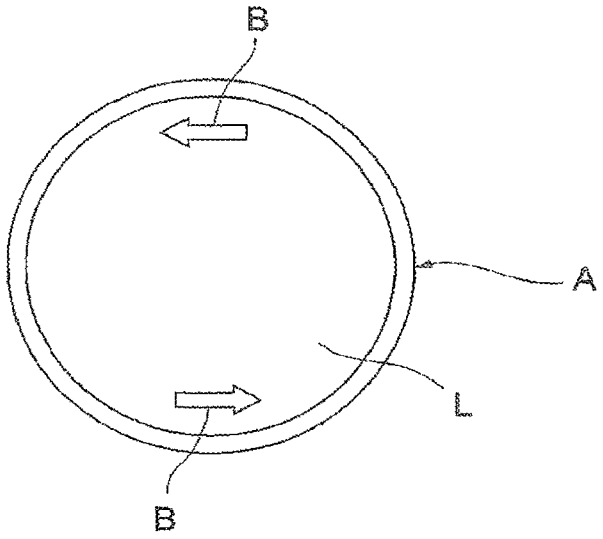

As shown in (a) in FIG. 38, a pouring member 190 includes a foam reception section 191 having a bottomed cylindrical shape, fitted into the front end of the nozzle 15 for a foam body and configured to receive the beer foam B poured from the nozzle 15 for a foam body, a first tubular flow path 192*a* configured to form a first flow path of the beer foam B, and a second tubular flow path 192*b* configured to form a second flow path of the beer foam B. On the horizontal plane, the first tubular flow path 192*a* and the second tubular flow path 192*b* are oriented in reverse directions. Further, both of the first and second tubular flow paths 192*a* and 192*b* may be formed of a foldable material. In addition, as the folding angles of the tubular flow paths 192*a* and 192*b* are adjusted, a pouring angle of the beer foam B with respect to the liquid surface of the beer liquid L may also be varied.

As shown in (b) in FIG. 38, a pouring direction of the beer foam B from the first tubular flow path 192*a* and a pouring direction of the beer foam B from the second tubular flow path 192*b* are opposite to each other. In addition, the beer foam B from the first tubular flow path 192*a* and the beer foam B from the second tubular flow path 192*b* are poured along an inner wall of the beverage container A. Here, the phrase "the beer foam B is poured along the inner wall of the beverage container A" may also refer to a case in which the beer foam B is poured in a tangential direction of the opening when the opening of the upper end of the beverage container A has a circular shape.

In this way, when the pouring direction of the beer foam B from the first tubular flow path 192*a* and the pouring direction of the beer foam B from the second tubular flow path 192*b* are opposite to each other and the beer foam B from the first tubular flow path 192*a* and the beer foam B from the second tubular flow path 192*b* are poured along the inner wall of the beverage container A, the beer foam B can be rotated on the liquid surface of the beer liquid L. In addition, since the beer foam B from the first tubular flow path 192*a* and the beer foam B from the second tubular flow path 192*b* push each other while rotating, rotation of the beer foam B can be accelerated. When the rotation of the beer foam B is accelerated in this way, since a downward velocity of the beer foam B is relatively low, the beer foam B is not easily further incorporated into the beer liquid L, and foam durability of the beer foam B can be improved.

Figure 39:
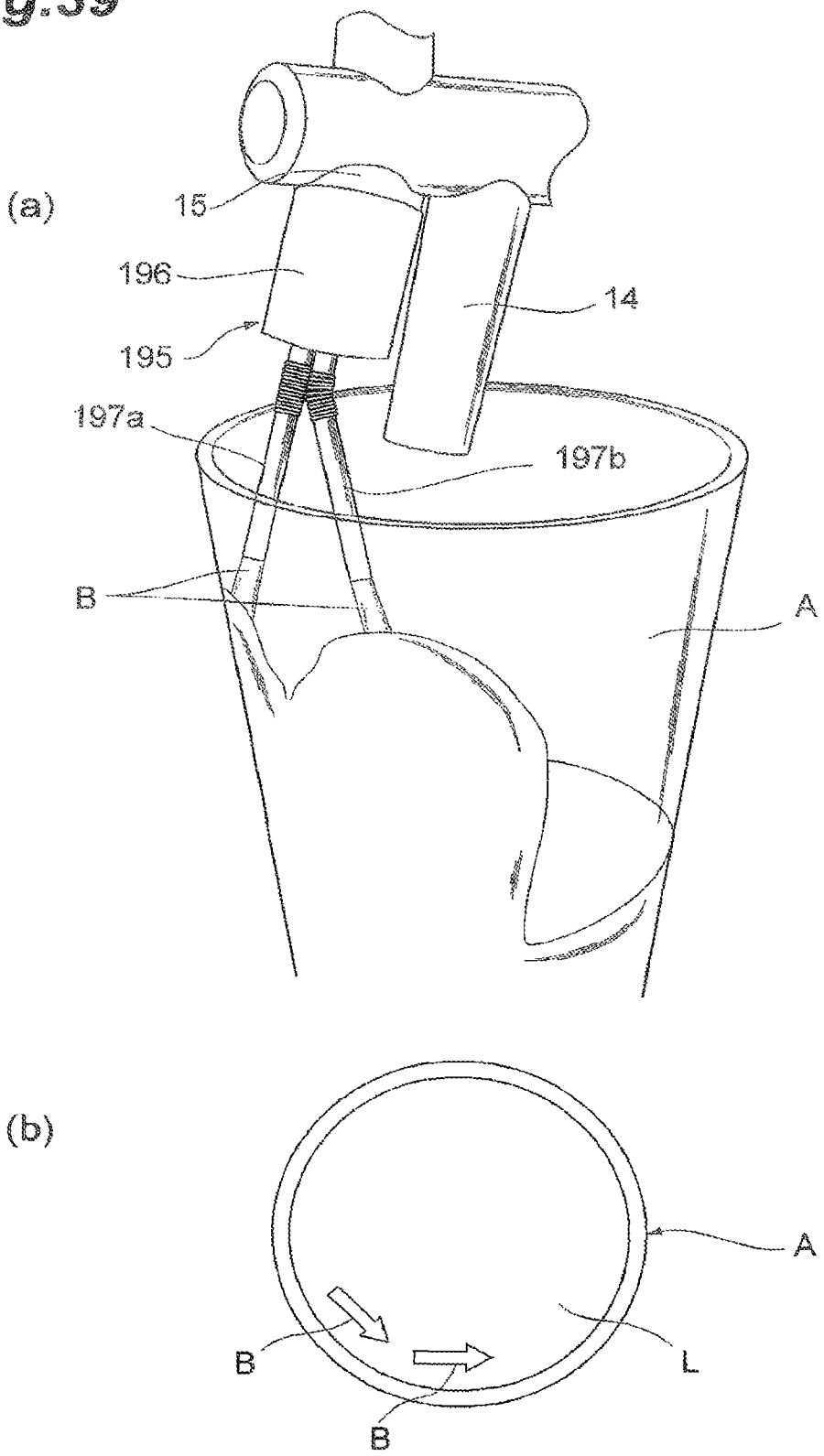
FIG. 39 is a view showing the pouring member of the other embodiment, the state in which the pouring member is attached to the nozzle for the foam body, the situation in which the beer foam flows out, and the flow of the beer foam.

As shown in (a) in FIG. 39, a pouring member 195 includes a foam receiving section 196 similar to the foam reception section 191, a third tubular flow path 197*a* configured to form a first flow path of the beer foam B, and a fourth tubular flow path 197*b* configured to form a second flow path of the beer foam B. In the pouring member 195, as shown in (b) in FIG. 39, the pouring direction of the beer foam B from the third tubular flow path 197*a* on the horizontal plane and the pouring direction of the beer foam B from the fourth tubular flow path 197*b* on the horizontal plane are different from each other. Then, the beer foam B from the third tubular flow path 197*a* and the beer foam B from the fourth tubular flow path 197*b* are poured along the inner wall of the beverage container A.

In this way, since the pouring direction of the beer foam B from the third tubular flow path 197*a* and the pouring direction of the beer foam B from the fourth tubular flow path 197*b* on the horizontal plane are different and the beer foam B from the third tubular flow path 197*a* and the beer foam B from the fourth tubular flow path 197*b* are poured along the inner wall of the beverage container A, like the above-mentioned pouring member 190, the beer foam B can be rotated on the liquid surface of the beer liquid L. In addition, since the beer foam B from the third tubular flow path 197*a* pushes the beer foam B from the fourth tubular flow path 197*b*, a rotating flow of the beer foam B can be further accelerated. Accordingly, since a downward velocity of the beer foam B is relatively reduced as the flow of the beer foam B in the rotation direction is accelerated, the beer foam B is not easily further incorporated into the beer liquid L, and foam durability of the beer foam B can be further improved.

In the pouring member of the seventh embodiment, the beer foam B can be poured in various shapes, and since the beer foam B can be poured along the liquid surface of the beer liquid L, the beer foam B is not easily incorporated into the beer liquid L, and foam durability of the beer foam B can be improved. In addition, since the shape of the beer foam B can be controlled by the pouring member, it is possible to give the beer foam B an interesting appearance, and since a design characteristic of the beer foam B upon pouring can be improved, it can be fun for a person pouring the beer foam B.

Figure 40:
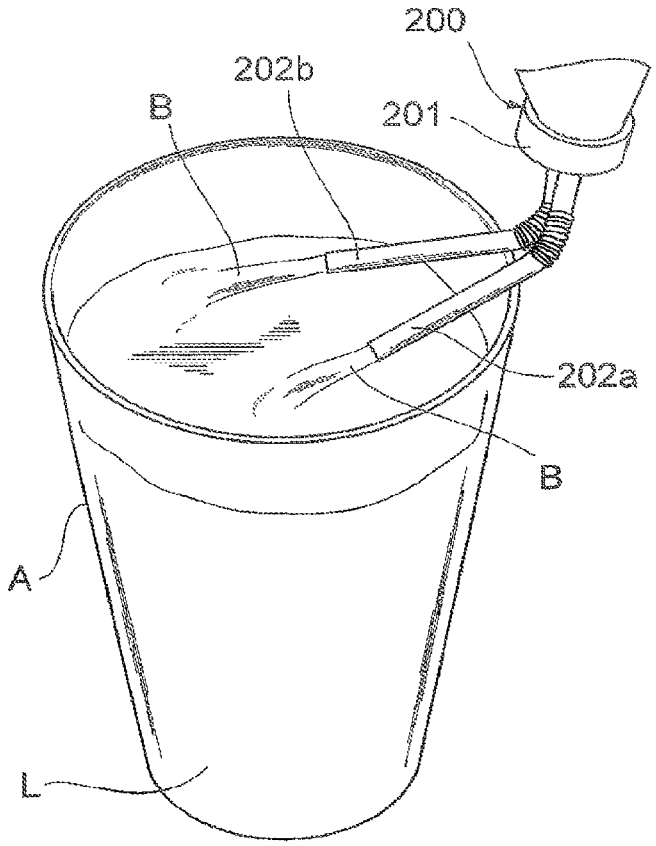
FIG. 40 is a perspective view showing the pouring member of the other embodiment, the state in which the pouring member is attached to the nozzle for the foam body, and the situation in which the beer foam flows out.

In the seventh embodiment, while the tap including the pouring member configured to control the pouring shape of the beer foam B has been described, the pouring member can be varied in aspects other than the pouring member described in the seventh embodiment. For example, as shown in FIG. 40, a pouring member 200 including a foam reception section 201 having a cylindrical shape and fitted into the front end of the nozzle 15 for a foam body, and first and second tubular flow paths 202*a* and 202*b* divided from the foam reception section 201 into two parts. Further, in the seventh embodiment, while the tubular flow paths are used as the first flow path and the second flow path, instead of the tubular flow paths, for example, the flow path having high stiffness that cannot be easily deformed may also be used, and the material of the flow path is not particularly limited.

In addition, in the seventh embodiment, as the directions of the beer foam B poured from the tubular flow paths 192*a* and 192*b* shown in FIG. 38, the tubular flow paths 197*a* and 197*b* shown in FIG. 39 and the tubular flow paths 202*a* and 202*b* shown in FIG. 40 are designed, and thus the beer foam B can be poured in a spiral shape. That is, in the seventh embodiment, the flow path through which the beer foam B flows includes a first flow path (for example, the tubular flow path 197*a* shown in FIG. 39) and a second flow path (for example, the tubular flow path 197*b* shown in FIG. 39).

Then, the direction of pouring the beer foam B when the beer foam B is poured into the beverage container A from the first flow path and the direction of pouring the beer foam B when the beer foam B is poured into the beverage container A from the second flow path can become a direction in which the beer foam B poured from the first flow path and the beer foam B poured from the second flow path are formed in a spiral shape in the beverage container A. Hereinafter, for example, a condition in which the beer foam B is poured to form a beautiful spiral shape using the pouring member 195 shown in FIG. 39 will be described. Further, hereinafter, the beer foam B poured from the tubular flow path 197*a* will be described as a beer foam B1 and the beer foam B poured from the tubular flow path 197*b* will be described as a beer foam B2.

Figure 41:
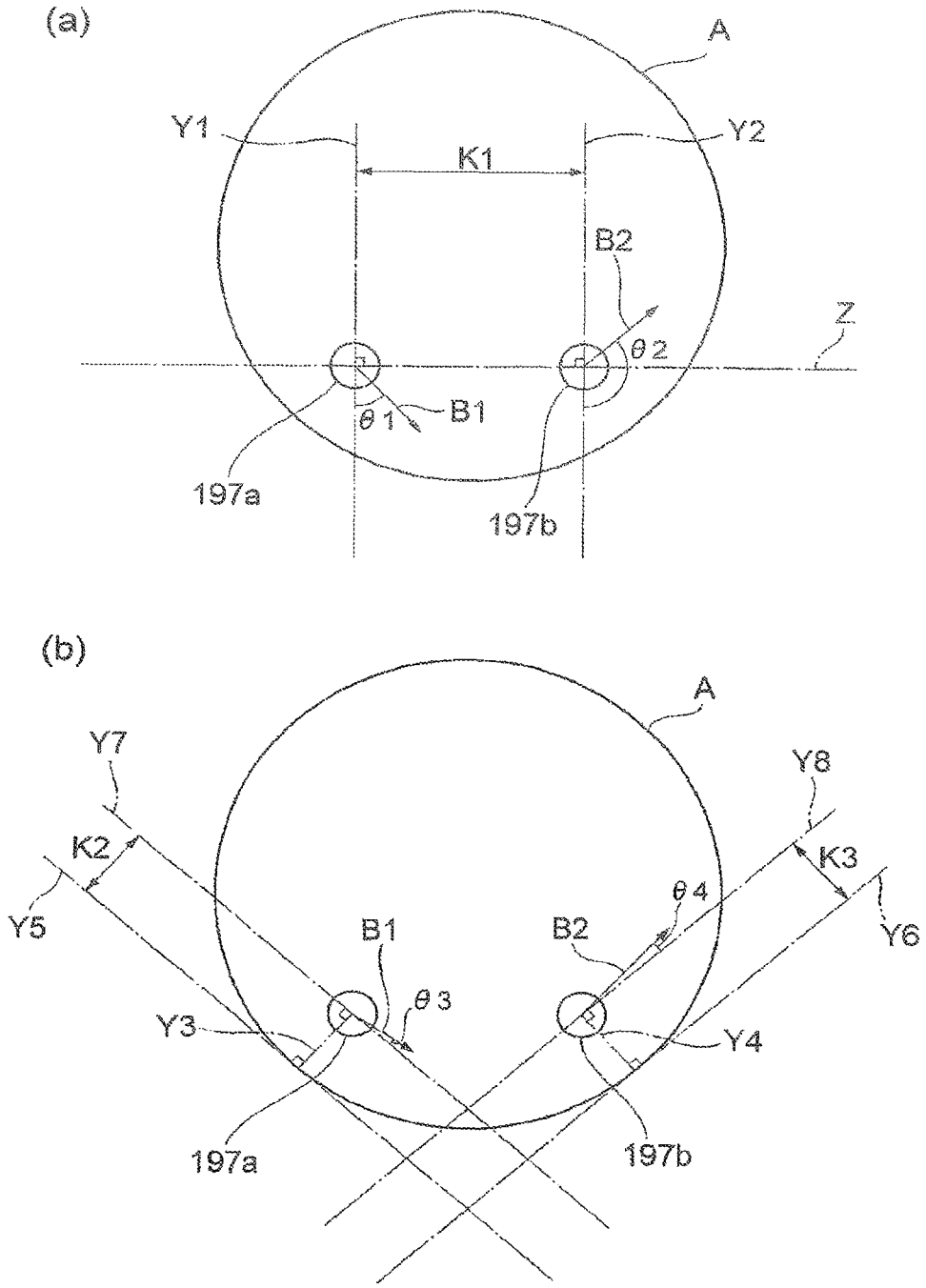
FIG. 41 is a plan view showing a flow of beer foam in a beverage container.

(a) and (b) in FIG. 41 are plan views showing position relations at front ends of the tubular flow paths 197*a* and 197*b* in the beverage container A. Here, the outlet port through which the beer foam B1 is discharged is disposed at the front end of the tubular flow path 197*a*. In addition, the outlet port through which the beer foam B2 is discharged is disposed at the front end of the tubular flow path 197*b*.

As shown in (a) in FIG. 41, when seen in a plan view, a straight line Z that connects the outlet port of the beer foam B1 and the outlet port of the beer foam B2, a straight line Y1 perpendicular to the straight line Z and passing through the outlet port of the beer foam B1 and a straight line Y2 perpendicular to the straight line Z and passing through the outlet port of the beer foam B2 are fixed, an angle between the pouring direction of the beer foam B1 and the straight line Y1 when seen in a plan view is referred to as θ1, and an angle between the pouring direction of the beer foam B2 and the straight line Y2 when seen in a plan view is referred to as θ2. Here, the pouring direction of the beer foam B1 and the pouring direction of the beer foam B2 are directions shown by arrows in the drawings. In addition, θ1 is an angle of the outlet port side of the beer foam B2 with respect to the straight line Y1. Here, the straight line Y1 extends from the outlet port of the beer foam B1 toward the beverage container A adjacent to the outlet port of the beer foam B1. θ2 is an angle of an opposite side of the outlet port of the beer foam B1 with respect to the straight line Y2. Here, the straight line Y2 extends from the outlet port of the beer foam B2 toward the beverage container A side adjacent to the outlet port of the beer foam B2.

Here, θ1 is preferably within a range of 45±20(°), and in order to pour the beer foams B1 and B2 to become a more beautiful vortex, θ1 is preferably within a range of 45±10(°). Further, in order to pour the beer foams B1 and B2 to become an even more beautiful vortex, θ1 is preferably within a range of 45±5(°). In addition, θ2 is preferably within a range of 130±20(°), and in order to pour the beer foams B1 and B2 to become a more beautiful vortex, θ2 is preferably within a range of 130±10(°). Further, in order to pour the beer foams B1 and B2 to become an even more beautiful vortex, θ2 is preferably within a range of 130±5(°).

In addition, as shown in (b) in FIG. 41, when seen in a plan view, a line segment Y3 that connects the outlet port of the beer foam B1 and the wall section of the beverage container A closest to the outlet port of the beer foam B1, a line segment Y4 that connects the outlet port of the beer foam B2 and the wall section of the beverage container A closest to the outlet port of the beer foam B2, a straight line Y5 serving as a tangential line of the beverage container A in the wall section of the beverage container A closest to the outlet port of the beer foam B1, a straight line Y6 serving as a tangential line of the beverage container A in the wall section of the beverage container A closest to the outlet port of the beer foam B2, a straight line Y7 parallel to the straight line Y5 and passing through the outlet port of the beer foam B1, and a straight line Y8 parallel to the straight line Y6 and passing through the outlet port of the beer foam B2 are fixed. Here, the pouring direction of the beer foam B1 and the pouring direction of the beer foam B2 are directions shown by arrows in (b) in FIG. 41. In addition, an angle of the pouring direction of the beer foam B1 with respect to the straight line Y7 is referred to as θ3, and an angle of the pouring direction of the beer foam B2 with respect to the straight line Y8 is referred to as θ4.

Here, θ3 is preferably within a range of 0±20(°), and in order to pour the beer foam B to become a more beautiful vortex, θ3 is preferably within a range of 0±10(°). Further, in order to pour the beer foams B1 and B2 to become an even more beautiful vortex, θ3 is preferably within a range of 0±5(°). In addition, θ4 is preferably within a range of 0±20(°), and in order to the beer foams B1 and B2 to become a more beautiful vortex, θ4 is preferably within a range of 0±10(°). Further, in order to pour the beer foams B1 and B2 to become an even more beautiful vortex, θ4 is preferably within a range of 0±5(°).

Further, a state in which θ3 is 0(°) is a state in which the pouring direction of the beer foam B1 is parallel to the straight line Y5. In addition, a state in which θ4 is 0(°) is a state in which the pouring direction of the beer foam B2 is parallel to the straight line Y6. In addition, a state in which θ3 is 0+y(°) is a state in which the pouring direction of the beer foam B1 is deviated from the straight lines Y7 and Y8 toward an opposite side of the straight lines Y5 and Y6 by y(°). In addition, a state in which θ4 is 0−y(°) is a state in which the pouring direction of the beer foam B2 is deviated from the straight lines Y7 and Y8 toward the straight lines Y5 and Y6 by y(°). In (b) in FIG. 41, a state in which θ3 and θ4 are deviated from 0(°) by a slightly+side is shown.

In addition, a distance K2 between the outlet port of the beer foam B1 and the wall section of the beverage container A closest to the outlet port of the beer foam B1 (a length of the line segment Y3/a distance between the straight line Y5 and the straight line Y7) and a distance K3 between the outlet port of the beer foam B2 and the wall section of the beverage container A closest to the outlet port of the beer foam B2 (a length of the line segment Y4/a distance between the straight line Y6 and the straight line Y8) are preferably about 2 mm. Further, the beverage container A preferably has a circular shape when seen in a plan view, and a hole diameter of the beverage container A is preferably 60 mm or more and 100 mm or less. Then, in this case, a distance K1 between the straight line Y1 and the straight line Y2 (a distance between the nozzles) is preferably 30 mm or more and 50 mm or less.

While preferable embodiments of the present invention have been described above, the present invention is not limited to these embodiments. That is, the tap, the server, the pouring member, the guide section and the beverage according to the present invention may be modified from the taps, the servers, the pouring members, the guide sections and the beverages according to the embodiments without departing from the spirit disclosed in the accompanying claims or may be applied to other matters.

Figure 10:
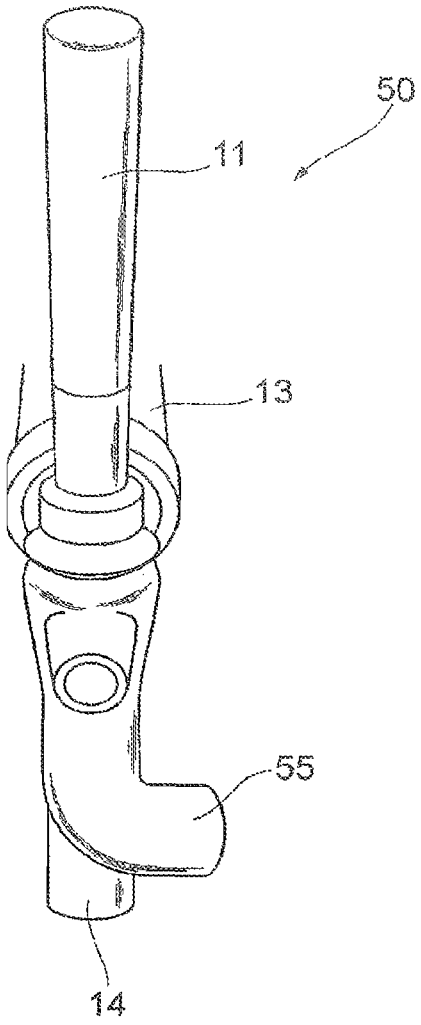
FIG. 10 is a perspective view showing a tap according to a variant.

For example, as shown in FIG. 10, instead of the tap including the above-mentioned nozzle for a foam body and pouring member, a tap 50 including a nozzle 55 for a foam body formed by curving a front end section of a flow path through which a foam body flows can be used without installing the pouring member. In the tap 50 according to the variant, the front end section of the nozzle 55 for a foam body of the tap 50 is curved along the liquid surface, i.e., to form an angle of 0° or more and 45° or less upward and downward with respect to the horizontal direction. Accordingly, the same effect as with the tap of the embodiment is obtained.

Figure 11:
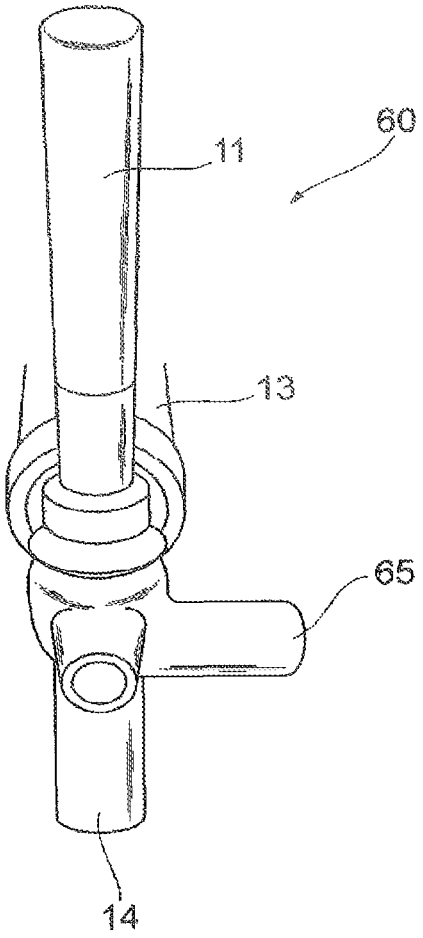
FIG. 11 is a perspective view showing the tap according to the variant.

In addition, as shown in FIG. 11, instead of the tap including the above-mentioned nozzle for a foam body and pouring member, a tap 60 including a nozzle 65 for a foam body extending such that a flow path is formed along the liquid surface can be used without installing the pouring member. In the tap 60 according to the variant, the nozzle 65 for a foam body is formed along the liquid surface. That is, since the flow path of the nozzle 65 for a foam body is oriented in a direction having an angle of 0° or more and 45° or less upward and downward with respect to the horizontal direction, the same effect as in the embodiment is obtained.

Further, a foam splash prevention section configured to prevent the beer foam B from scattering may be provided. The foam splash prevention section will be described below with reference to FIGS. 17 and 18.

Figure 17:
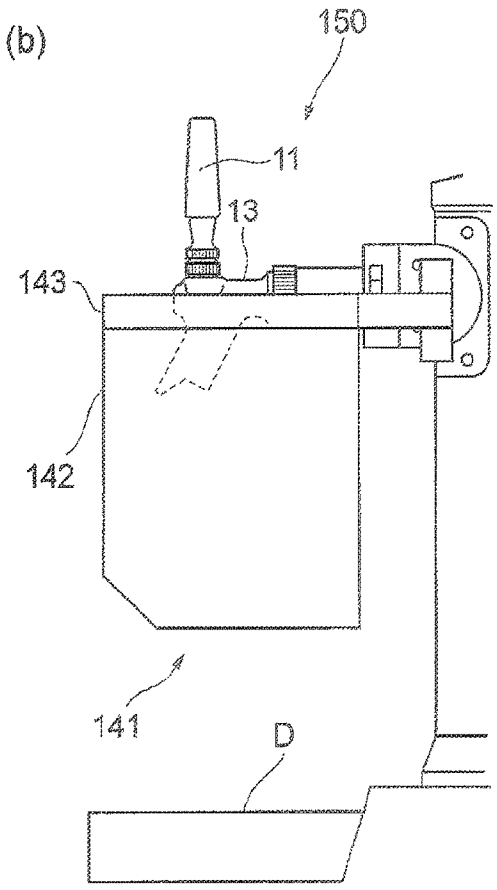
FIG. 17 is a side view showing a foam splash prevention guide.
Figure 17:
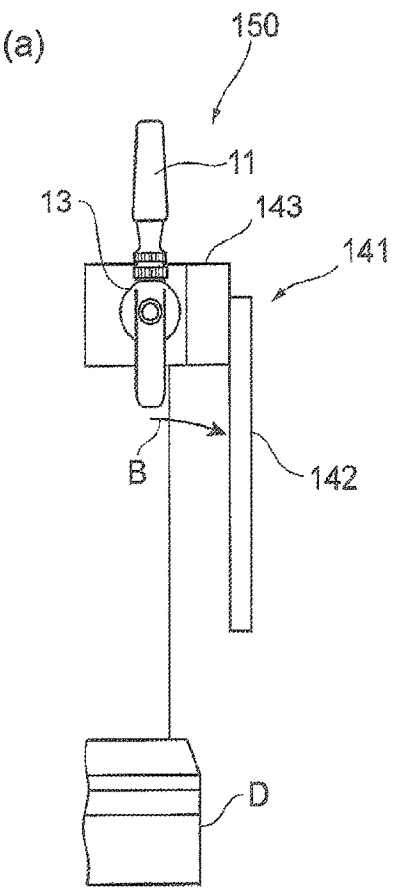

As shown in FIG. 17, in a tap 150 including a foam splash prevention section 141, the foam splash prevention section 141 includes a support member 143 attached to a position adjacent to the tap main body 13, and a flat plate-shaped foam receiving section 142 fixed to the support member 143 and extending downward from the support member 143 toward the front side. As shown in (a) in FIG. 17, the beer foam B scattered upon pouring is scattered toward the inner side surface of the foam receiving section 142, and the beer foam B scattered to the inner side surface of the foam receiving section 142 falls onto a receptacle D.

Figure 18:
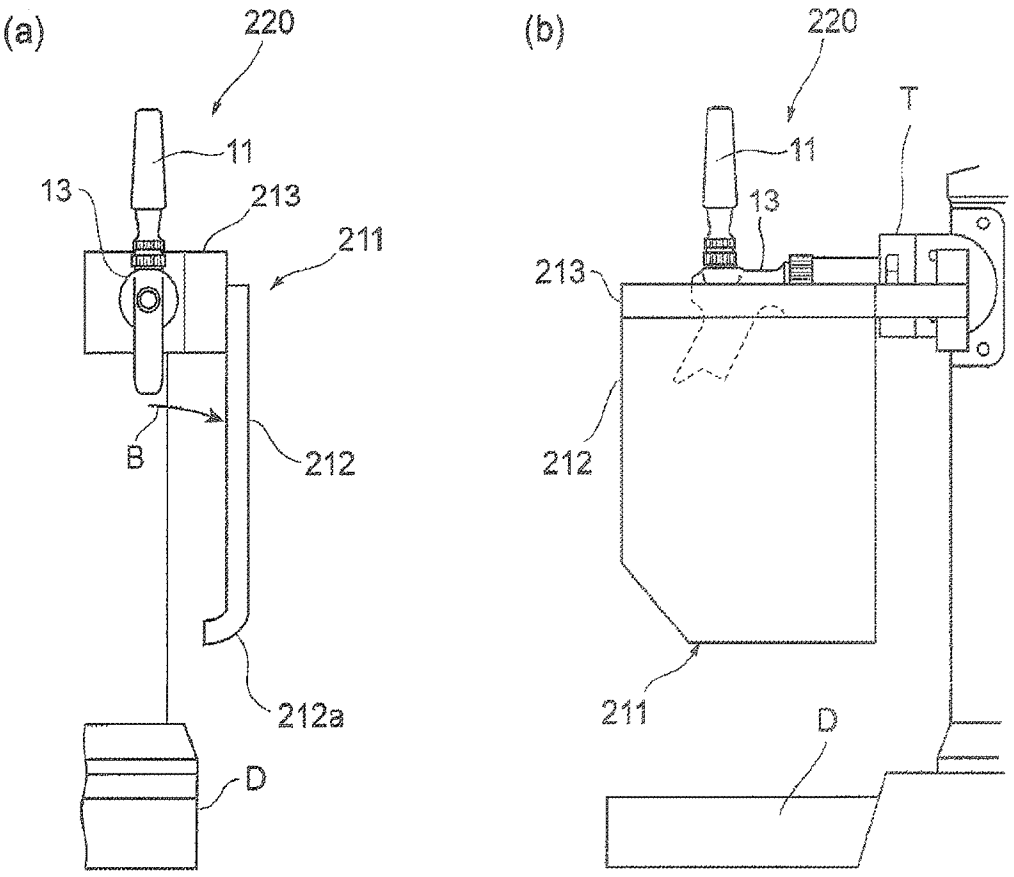
FIG. 18 is a side view showing the foam splash prevention guide.

In addition, in a tap 220 including a foam splash prevention section 211 shown in FIG. 18, the foam splash prevention section 211 includes a support member 213 and a foam receiving section 212, similar to the above-mentioned foam splash prevention section 141, and a curved section 212*a* curved inward is formed at a lower end of the foam receiving section 212. As the above-mentioned curved section 212*a* is provided at the lower end of the foam receiving section 212, the beer foam scattered on the inner side surface of the foam receiving section 212 can be more easily guided to the receptacle D.

As the above-mentioned foam splash prevention section 141 or the foam splash prevention section 211 is provided, the beer foam B can be prevented from being scattered to the outside of the apparatus upon pouring. Further, in the foam splash prevention section 141 shown in FIG. 17, while the flat plate-shaped foam receiving section 142 extends downward from the support member 143 adjacent to the tap main body 13, instead of the foam receiving section 142, the foam receiving section fixed to the receptacle D and extending upward from the receptacle D may be used. As the foam receiving section extending upward from the receptacle D is provided, the beer foam B can be securely guided to the receptacle D even when the beer foam B drops further downward.

In addition, as shown in FIGS. 7 and 8, the pouring member 40 detachably attached to the nozzle 15 for a foam body may have a positioning means configured to direct the outlet port 43*d* of the pouring member 40 toward a desired position when attached to the front end section 15*b* of the nozzle 15 for a foam body. The positioning means has, for example, a non-circular fitting structure of the pouring member 40 and the nozzle 15 for a foam body, and may consequently determine the direction of the outlet port 43*d* when the pouring member 40 is fitted into the nozzle 15 for a foam body. In addition, the positioning means may be marks attached to the pouring member 40 and the nozzle 15 for a foam body, and in this case, the direction of the outlet port 43*d* is automatically determined by coupling the mark of the pouring member 40 and the mark of the nozzle 15 for a foam body. As the above-mentioned positioning means is provided, since the pouring direction of the beer foam B is consequently determined by merely attaching the pouring member 40 to the tap 10, a configuration formed such that the beer foam B is not easily mixed with the beer liquid L can be easily realized.

In addition, in the embodiment, while the example in which the tap 10 includes both of the nozzle 14 for a liquid and the nozzle 15 for a foam body has been described, the nozzle 14 for a liquid may not be provided.

In addition, in the embodiment, while the example in which the pouring member 40 having a linear shape and extending downward is detachably attached to the nozzle 15 for a foam body has been described, the tubular pouring member 20 may be detachably attached to the nozzle 15 for a foam body. In addition, the pouring member 40 of the second embodiment may not be detachably attached thereto.

In addition, in the embodiment, while the example in which the tap is installed at the beverage vending apparatus 1 has been described, the apparatus configuration of the beverage vending apparatus 1 is not limited to the embodiment but may be appropriately varied.

In addition, in the embodiment, while the example in which the tap is installed at the beverage vending apparatus 1 for providing beer has been described, the tap of the present invention may also be applied to a beverage vending apparatus for providing a beverage other than beer.

In addition, in the sixth embodiment, the liquid guide section configured to guide the adhesion liquid C away from the outlet port 112 is not limited to the aspect having the first and second groove sections 111*a* and 111*b* but, for example, may have any one of the first and second groove sections 111*a* and 111*b*. Further, the shape of the groove section can be appropriately varied.

Figure 24:
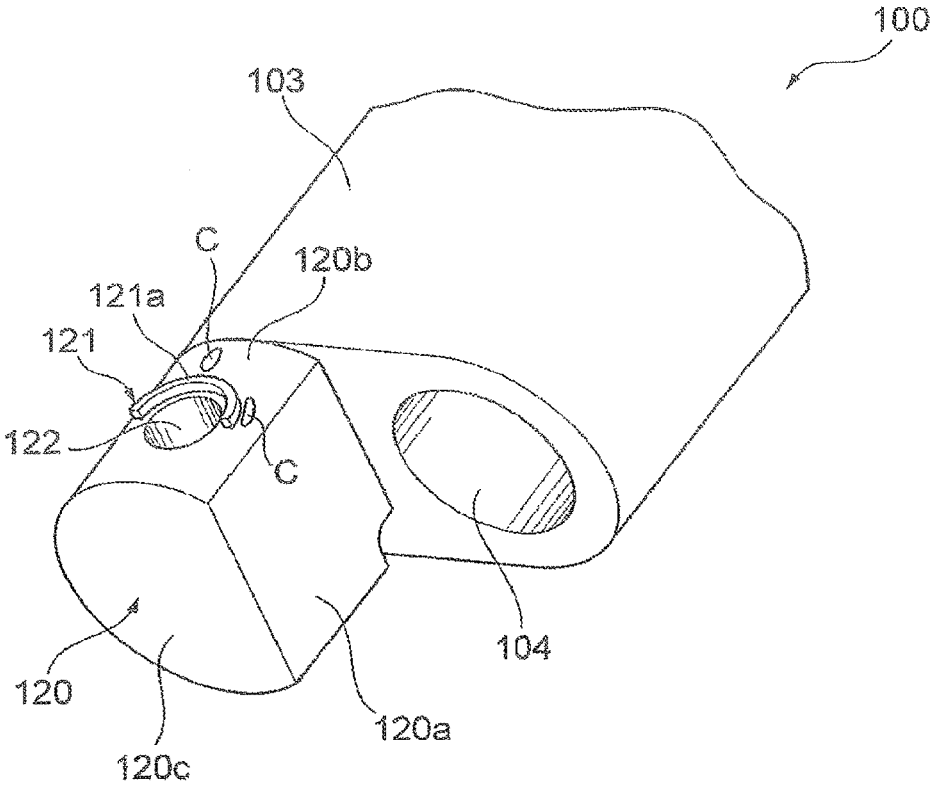
FIG. 24 is a perspective view showing a tap and a pouring member according to a variant.

In addition, as a variant of the liquid guide section, a liquid guide section 121 including an umbrella-shaped protrusion section 121*a* shown in FIG. 24 is exemplified. The liquid guide section 121 is installed at a pouring member 120 having a first side surface 120*a*, a second side surface 120*b*, a bottom surface 120*c* and an outlet port 122, like the pouring member 110. That is, the liquid guide section 121 is formed at the pouring member 120 detachably attached to the nozzle 103. The protrusion section 121*a* protruding from the second side surface 120*b* of the pouring member 120 is curved along the outer circumference of the outlet port 122 at an upper side of the outlet port 122. Accordingly, since the adhesion liquid C directed toward the outlet port 122 from above flows along the curved protrusion section 121*a* while abutting the protrusion section 121*a*, the adhesion liquid C does not easily arrive at the outlet port 122. In this way, since the adhesion liquid C can be guided not to arrive at the outlet port 122 of the beer foam B, like the case in which the liquid guide section 111 having a groove is formed, a situation in which the pouring of the beer foam B is disturbed due to the adhesion liquid C can be avoided, and the beer foam B can be securely guided in the desired direction.

Figure 25:
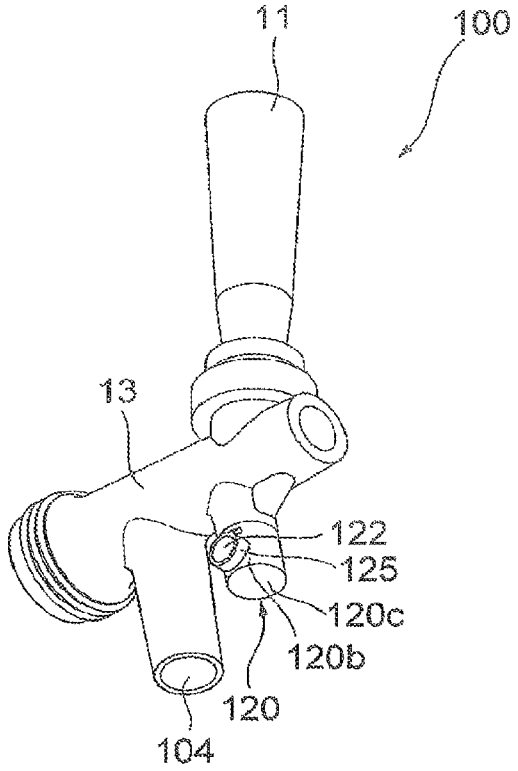
FIG. 25 is a perspective view showing a pouring member and a tap according to another variant.

In addition, as a separate variant, as shown in FIG. 25, an annular liquid guide section 125 protruding outward is exemplified. The liquid guide section 125 is installed at the pouring member 120, like the above-mentioned liquid guide section 121. In the pouring member 120, the inside of the liquid guide section 125 becomes the outlet port 122, and the outlet port 122 extends to the outside of the pouring member 120 as the liquid guide section 125 is installed. As the above-mentioned liquid guide section 125 is provided, the beer foam B does not easily drop on the second side surface 120*b*. In addition, since the beer foam B can be attached to the pouring member 120 to be suppressed from falling, the beer foam B can be more securely poured in a lateral direction. Further, because the beer foam B does not easily drop on the second side surface 120*b*, the shape of the liquid guide section 125 is not limited to the annular shape but may be a shape in which only the lower side of the outlet port 122 extends to the outside of the pouring member 120 along the outer circumference of the outlet port 122. That is, at least the lower side of the outlet port 122 may protrude to the outside.

Figure 26:
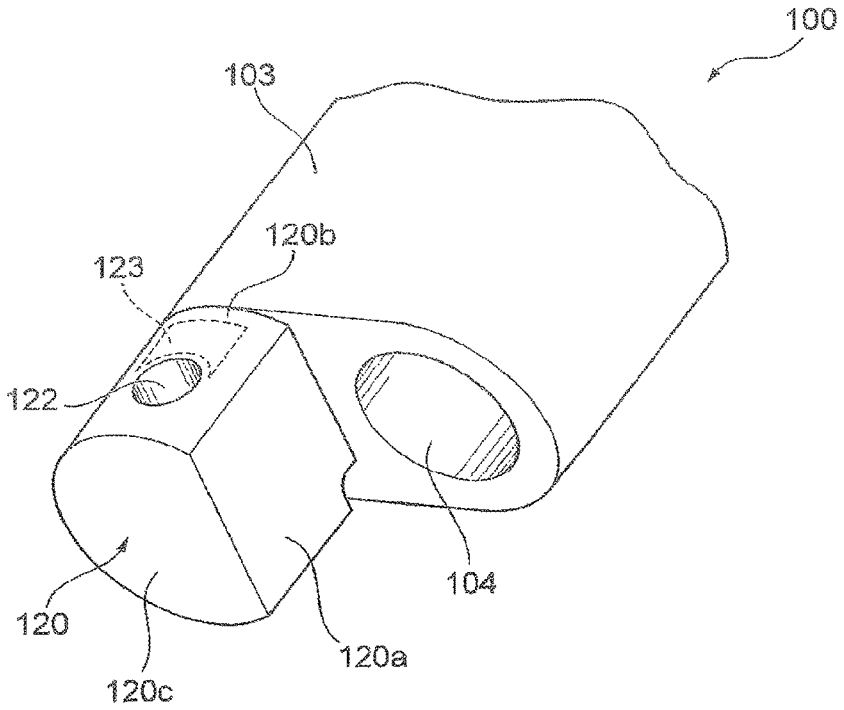
FIG. 26 is a perspective view showing a pouring member and a tap according to still another variant.

In addition, as another separate variant, a coating layer 123 formed of a water-repellent material as shown in FIG. 26 may be used as the liquid guide section. The coating layer 123 is formed along the outer circumference of the outlet port 122 at the upper side of the outlet port 122. As the above-mentioned coating layer 123 is formed, since the adhesion liquid C directed toward the outlet port 122 from above is repelled upon arrival at the coating layer 123, the adhesion liquid C does not easily arrive at the outlet port 122. Accordingly, like when the liquid guide section 121 having the protrusion section 121*a* is formed, a situation in which the pouring of the beer foam B is disturbed due to the adhesion liquid C can be avoided. Further, not only is the upper side of the outlet port 122 formed of the water-repellent material like the coating layer 123 but, for example, the entire pouring member 120 may also be formed of a material having high water repellency. In addition, at least a part of the liquid guide section may be formed at an upper side in the vertical direction of the outlet port 122 when the pouring member is attached to the nozzle to pour the beer foam B.

Further, in the sixth embodiment, while the pouring member 110 at which the liquid guide section 111 is formed has been described, the shape or the material of the pouring member 110 can be appropriately varied. For example, as shown in FIG. 23, in the pouring member 110 of the sixth embodiment, while the outlet port 112 is opened at the front side of FIG. 23, the opening direction of the outlet port 112 may be appropriately deviated. In addition, in the sixth embodiment, the pouring member may not be provided, and for example, the nozzle 103 may have a pouring port of the beer foam B. Even in this case, the same effect as with the liquid guide section 111 of the sixth embodiment is obtained by forming the liquid guide section at the front end section of the flow path of the beer foam B.

(First Example)

Next, a first example of the tap 30 including the pouring member 40 of the second embodiment will be described with reference to FIGS. 12 to 14. Further, the present invention is not limited to the first example to be described below. In an experiment of the first example, a white beer foam B was poured for five seconds by pushing the lever 11 down in a state in which the beverage container A in which water M was contained to a level of 25 mm was disposed at a predetermined position, and a relation between a pouring angle of the beer foam B with respect to the liquid surface S of the water M in the beverage container A and a state of the beer foam B was tested. In addition, as the beverage container A, a half pint glass having a hole diameter of about 77 mm was used. Then, a diameter of the outlet port 43*d* (see FIG. 8) of the pouring member 40 was 5 mm, a distance between the outlet port 43*d* and the liquid surface S of the water M was 15 mm, a temperature of the beer barrel 5 was 20° C., and a gas pressure was 0.25 MPa.

Figure 12:
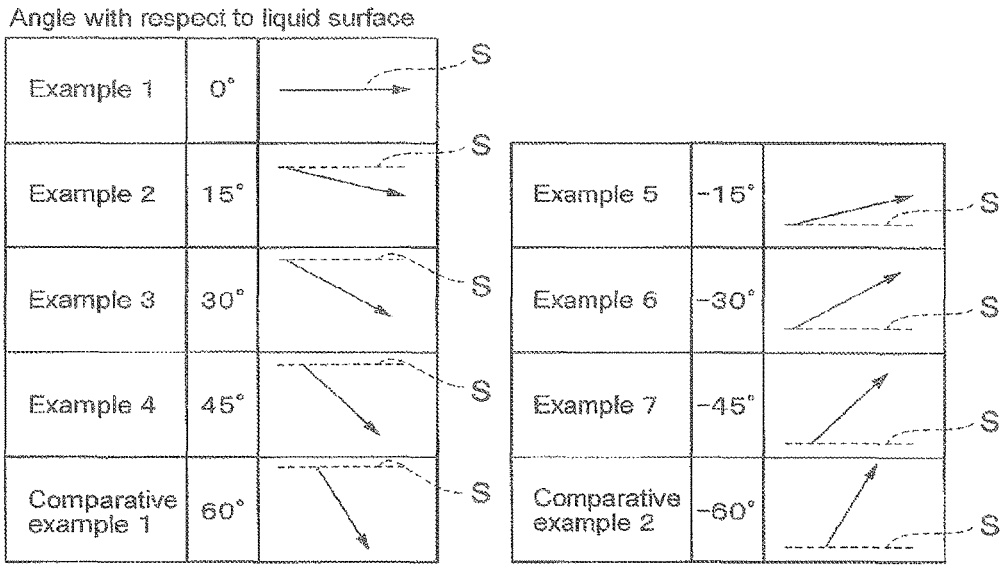
FIG. 12 is a view showing a condition of an experiment performed using the tap of FIG. 7.
Figure 12:
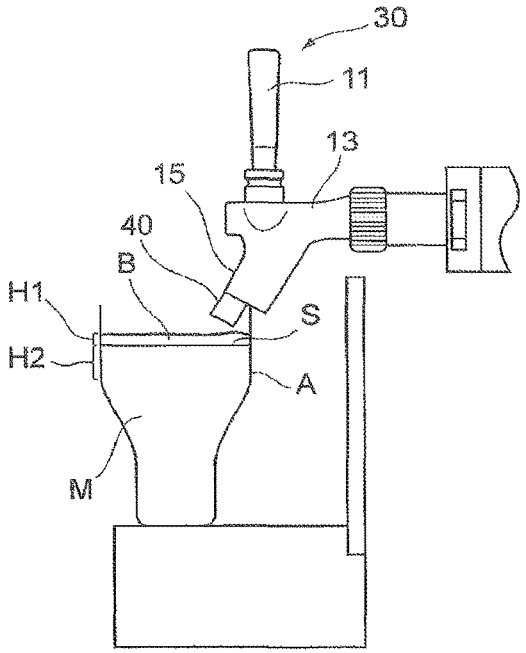

In the experiment, as shown in (a) in FIG. 12, the case in which the beer foam B was poured with respect to the liquid surface S in a downward direction of X° was referred to as X°, and the case in which the beer foam B was poured with respect to the liquid surface S in an upward direction of X° was referred to as −X°. Then, the case in which a pouring angle of the beer foam B with respect to the liquid surface S was 0° was represented as example 1, the case of 15° was represented as example 2, the case of 30° was represented as example 3, the case of 45° was represented as example 4, the case of −15° was represented as example 5, the case of −30° was represented as example 6, the case of −45° was represented as example 7, the case of 60° was represented as comparative example 1, and the case of −60° was represented as comparative example 2. Further, in examples 6 and 7 and comparative example 2 of −30°, −45° and −60°, in order to prevent scattering of the beer foam B to the outside, the experiment was performed in a state in which the pouring member 40 was extracted to the outside of the beverage container A, the outlet port 43*d* was deviated to the outside of the beverage container A by about 10 mm, and a distance between the liquid surface S and the outlet port 43*d* was 35 mm.

In the experiment, as shown in (b) in FIG. 12, a foam height H1 after 5 seconds from the beginning of the pouring of the beer foam B onto the liquid surface S when the beer foam B was poured onto the liquid surface S and a foam depth H2 immediately after the beginning of the pouring in a lower section of the liquid surface S were measured. In general, when an impulsive force of the beer liquid L to the liquid surface S by the beer foam B is small, the foam height H1 is larger than the foam depth H2, and when the impulsive force is large, the foam depth H2 is larger than the foam height H1.

Figure 13:
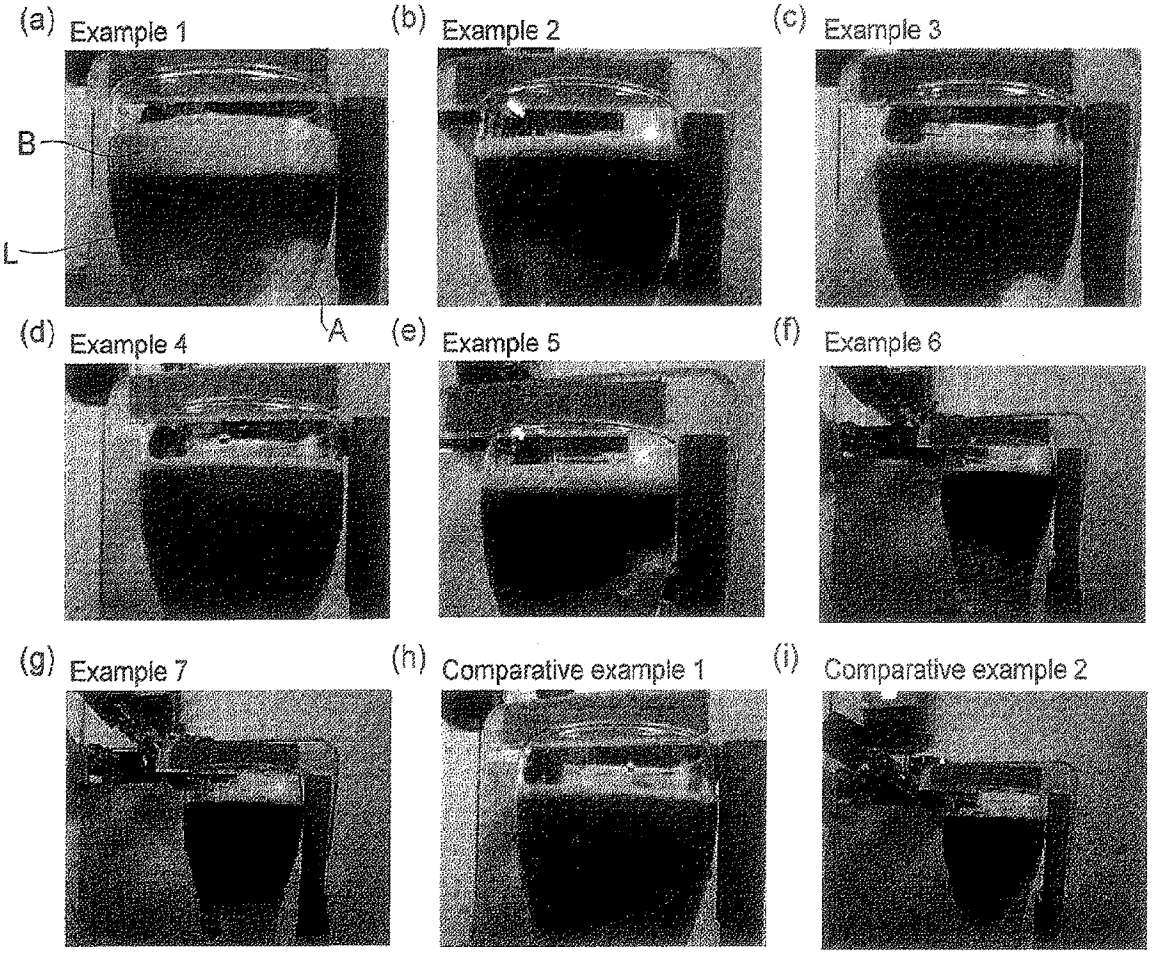
FIG. 13 is a view showing a beer liquid and a foam body in the experiment of FIG. 12.

(a) in FIG. 13 is a photograph of example 1, (b) in FIG. 13 is a photograph of example 2, (c) in FIG. 13 is a photograph of example 3, (d) in FIG. 13 is a photograph of example 4, (e) in FIG. 13 is a photograph of example 5, (f) in FIG. 13 is a photograph of example 6, (g) in FIG. 13 is a photograph of example 7, (h) in FIG. 13 is a photograph of comparative example 1, and (i) in FIG. 13 is a photograph of comparative example 2, after pouring of the beer foam B. As shown in (a) to (i) in FIG. 13, the foam height H1 is largest in example 1 in which the pouring angle was 0°, larger in sequence of examples 5, 2, 3 and 6, and smallest in examples 4 and 7 and comparative examples 1 and 2.

Figure 14:
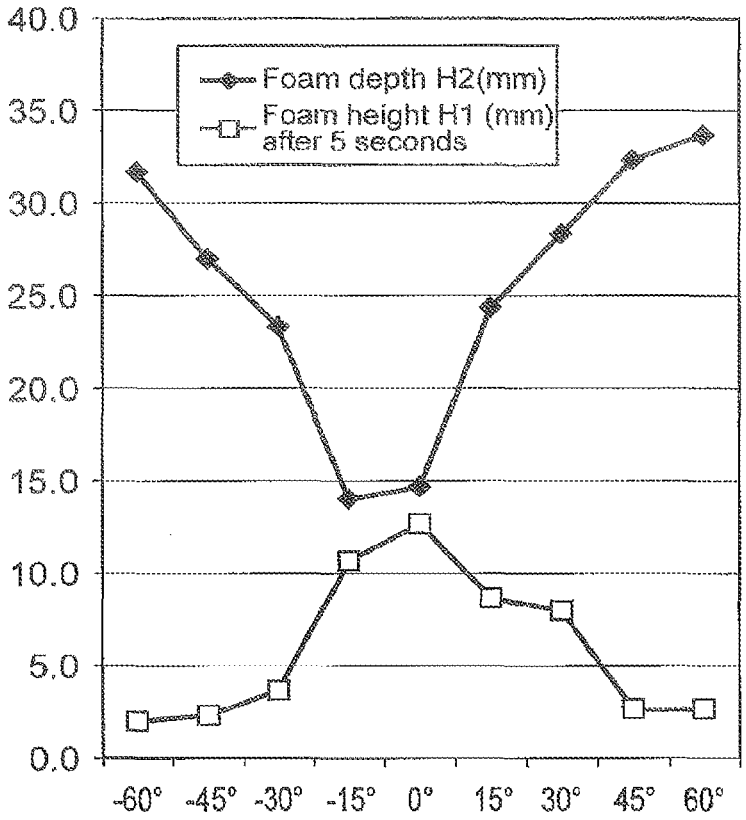
FIG. 14 is a graph showing a foam depth and a foam height of the foam body in the experiment of FIG. 12.

Specifically, as shown in the graph of FIG. 14 and Table 1, values of the foam height H1 and the foam depth H2 were as follows.

TABLE 1

| | Foam height after 5 seconds H1 (mm) | Foam depth H2 (mm) |
|---|---|---|
| Example 1 (0°) | 12.7 | 14.7 |
| Example 2 (15°) | 8.7 | 24.3 |
| Example 3 (30°) | 8.0 | 28.3 |
| Example 4 (45°) | 2.7 | 32.3 |
| Example 5 (−15°) | 10.7 | 14.0 |
| Example 6 (−30°) | 3.7 | 23.3 |
| Example 7 (−45°) | 2.3 | 27.0 |
| Comparative example 1 (60°) | 2.7 | 33.7 |
| Comparative example2(−60°) | 2.0 | 31.7 |

In this way, in comparison with the case of comparative example 1 in which the pouring angle of the beer foam B was 60°, in the case of example 4 in which the pouring angle was 45°, a value of the foam depth H2 can be reduced. In addition, in comparison with the case of comparative example 2 in which the pouring angle was −60°, even in the case of example 7 in which the pouring angle was −45°, a value of the foam depth H2 can be reduced. Accordingly, the foam is considered not to be easily mixed with the liquid when the pouring angle of the beer foam B is set to −45° to 45°.

Then, in the case of example 3 in which the pouring angle was 30° and the case of example 6 in which the pouring angle was −30°, the value of the foam depth H2 was reduced and the value of the foam height H1 was increased in comparison with examples 4 and 7, and in the case of example 2 in which the pouring angle was 15° and the case of example 5 in which the pouring angle was −15°, the value of the foam depth H2 was further reduced and the value of the foam height H1 was further increased. Accordingly, it was seen that an effect of preventing the foam from being easily mixed with the liquid was exhibited when the pouring angle of the beer foam B was set to −30° to 30°, and the effect was more remarkably exhibited when the pouring angle was set to −15° to 15°.

Further, in example 1 in which the pouring angle of the beer foam B was 0°, it was seen that, since the value of the foam height H1 was largest, the effect of preventing the foam from being easily mixed and the effect of improving the design characteristic of the foam can be further improved.

(Second Example)

Next, a second example in which the beverage of the fourth embodiment is generated will be described with reference to FIGS. 19 and 20. Further, the present invention is not limited to the following second example. In the second example, experiment 1 and experiment 2 using a black liquid E1 shown in FIG. 19, a gold liquid E2 shown in FIG. 20 and having a smaller specific gravity than the liquid E1, and a foam body F generated from a mixed liquid of the liquid E1 and the liquid E2 were performed. Further, the specific gravity of the black liquid E1 was larger than the specific gravity of the gold liquid E2, and a difference between the specific gravity of the black liquid E1 and the specific gravity of the gold liquid E2 was less than 0.01. In addition, a dark beer was used as the liquid E1, and a light beer such as Pilsner beer was used as the liquid E2.

Figure 19:
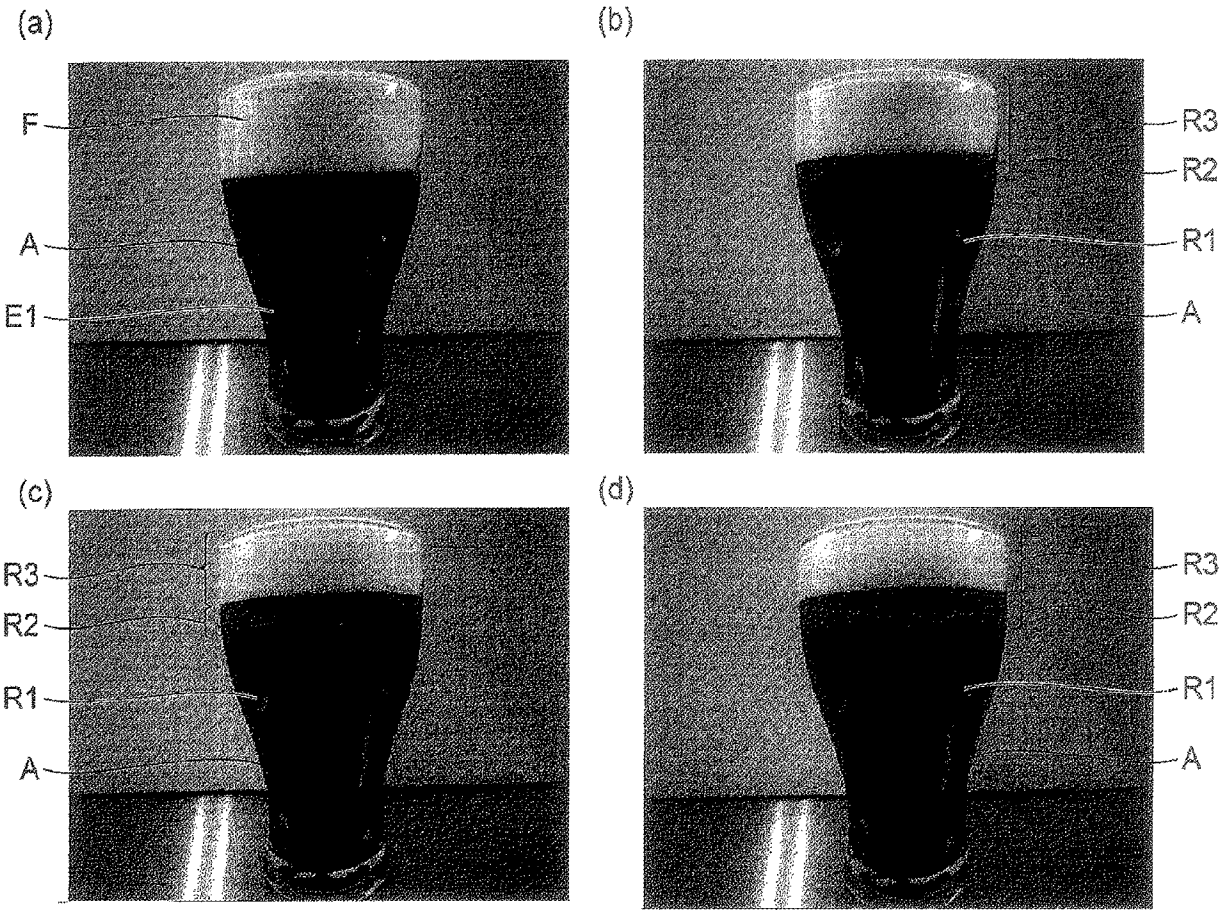
FIG. 19 is a view showing state transition after the foam body is poured on the liquid.

In experiment 1, as shown in FIG. 19, the foam body F generated from the mixed liquid was poured onto the black liquid E1 in the beverage container A, and then a situation in the beverage container A was observed. (a) in FIG. 19 shows a situation in the beverage container A immediately after pouring the foam body F, (b) in FIG. 19 shows a situation 30 seconds after the pouring of the foam body F, (c) in FIG. 19 shows a situation 1 minute after the pouring of the foam body F, and (d) in FIG. 19 shows a situation 2 minutes after the pouring of the foam body F.

As shown in (b) to (d) in FIG. 19, when 30 seconds or more elapsed from the pouring of the foam body F, the first layer R1 formed of the liquid E1, the second layer R2 formed of the liquid obtained from the foam body F and the third layer R3 formed of the foam body F were formed in the beverage container A. In addition, as the foam body F was liquefied according to the lapse of time from the pouring of the foam body F, a thickness of the third layer R3 was reduced and a thickness of the second layer R2 was increased.

Figure 20:
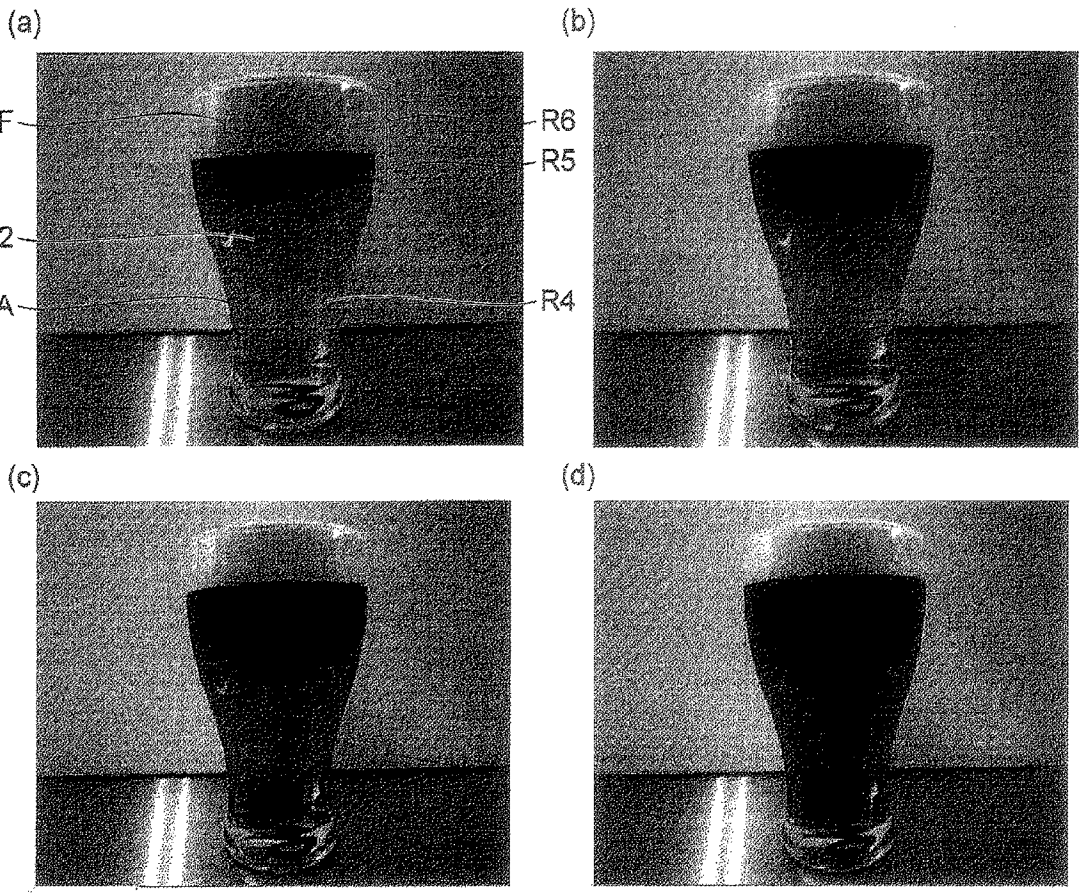
FIG. 20 is a view showing the state transition after the foam body is poured on the liquid.

In experiment 2, as shown in FIG. 20, the foam body F generated from the mixed liquid was poured onto the gold liquid E2 in the beverage container A, and then a situation in the beverage container A was observed. (a) in FIG. 20 shows a situation in the beverage container A immediately after pouring the foam body F, (b) in FIG. 20 shows a situation 30 seconds after the pouring of the foam body F, (c) in FIG. 20 shows a situation 1 minute after the pouring of the foam body F, and (d) in FIG. 20 shows a situation 2 minutes after the pouring of the foam body F.

As shown in (a) in FIG. 20, in experiment 2, immediately after pouring the foam body F, a first layer R4 formed of the liquid E2, a second layer R5 formed of the liquid obtained from the foam body F and a third layer R6 formed of the foam body F were formed in the beverage container A. Then, the second layer R5 was diffused in an aura shape as time elapsed, and as shown in (d) in FIG. 20, the second layer R5 was hardly visible when 2 minutes elapsed from the pouring of the foam body F.

As described above, in the second example, it was confirmed that the first layers R1 and R4 formed of the liquids E1 and E2, the second layers R2 and R5 formed of the liquid obtained from the foam body F, and the third layer formed of the foam body F were formed.

Then, in experiment 1 in which the foam body F formed of the mixed liquid was poured onto the liquid E1 having a larger specific gravity than the mixed liquid of the liquid E1 and the liquid E2, it was seen that the second layers R2 and R5 were formed as time elapsed as shown in FIG. 19, and a beautiful stripe pattern was formed. In addition, in experiment 1, it is considered that, while the thickness of the third layer R3 was reduced and the thickness of the second layer R2 was increased as the foam body F was liquefied according to the lapse of time from the pouring of the foam body F, in the case in which the beverage was to be provided after completely making the second layer R2, when the foam body F was further poured onto the third layer R3 after 2 minutes elapsed from the pouring of the foam body F and the thickness of the second layer R2 was increased, the beverage having a large thickness of both of the second layer R2 and the third layer R3 can be provided.

Meanwhile, in experiment 2 in which the foam body F formed of the mixed liquid was poured onto the liquid E2 having a smaller specific gravity than the mixed liquid of the liquid E1 and the liquid E2, it was seen that the second layer R5 was formed immediately after pouring the foam body F as shown in FIG. 20, and then the second layer R2 was hardly visible as time elapsed. Accordingly, it is considered that, when the beverage can be provided immediately after an order is received or when the beverage is provided in a store with relatively good illumination, since the second layer R5 is beautifully formed, beverage having a good design characteristic and favorability can be provided.

(Third Example)

Next, a third example in which foam durability was measured using the tap of the embodiment (for example the tap 10 shown in FIG. 2) configured to pour the beer foam B along the liquid surface S and the tap of the related art configured to pour the beer foam in a downward direction will be described. In the third example, a tumbler of 380 ml was used as the beverage container A, and for example, pouring of the beer liquid L and foaming of the beer foam B were performed in the beverage container A as shown in (a) to (c) in FIG. 5. Then, a foam-lowering amount after a lapse of a predetermined time on the top surface of the beer foam B was measured. Further, an amount of the beer liquid L was adjusted at each tap such that a boundary line between the beer liquid L and the beer foam B after a lapse of 1 minute from the pouring of the beer foam B was disposed at a predetermined height of the beverage container A.

The foam-lowering amounts of the beer foam B after a lapse of 80 seconds from the pouring of the beer liquid L and the beer foam B are shown in the following Table 2. Table 2 shows average values (a unit is mm) of the foam-lowering amounts of the beer foam B when pouring of the beer liquid L and the beer foam B were repeated six times. In addition, beer A to beer E represent various kinds of beers.

TABLE 2

| | Embodiment | Related art | Difference |
|---|---|---|---|
| Beer A | −4.2 | −5.0 | 0.8 |
| Beer B | −4.1 | −4.8 | 0.7 |
| Beer C | −4.7 | −5.8 | 1.1 |
| Beer D | −5.0 | −6.1 | 1.1 |
| Beer E | −4.8 | −5.8 | 1.0 |

As shown in Table 2, in the tap of the embodiment, in comparison with the tap of the related art, in all of beer A to beer E, the foam-lowering amount of the beer foam B was suppressed. In this way, in the tap of the embodiment configured to pour the beer foam B along the liquid surface S, in comparison with the tap of the related art, foam durability of the beer foam B in all kinds of liquids is improved.

(Fourth Example)

Next, a fourth example in which a quantity of reproduction of the foam was measured using the tap of the embodiment configured to pour the beer foam B along the liquid surface S and the tap of the related art configured to pour the beer foam in a downward direction will be described. In the fourth example, a tumbler of 380 ml was used as the beverage container A, and for example, pouring of the beer liquid L and foaming of the beer foam B were performed as shown in (a) to (c) in FIG. 5. Then, after a lapse of 60 seconds from the foaming of the beer foam B, the beverage container A was inclined to pour the beer foam B and the beer liquid L from the beverage container A such that an angle of the beverage container A with respect to the horizontal plane was 65°, the inclination of the beverage container A was returned to a vertical posture after 2 seconds, and a thickness of the newly made beer foam B (a quantity of reproduction of the beer foam B) was immediately measured.

Further, the foaming was adjusted at each tap such that the beer foam B was disposed at a predetermined height of the beverage container A after a lapse of 1 minute from the pouring of the beer foam B into the beverage container A. In addition, the pouring of the beer foam B and the beer liquid L from the beverage container A was performed with respect to a pouring cap having a cutout portion configured under the assumption that the beverage is drunk from the mouth, and flow rate control of the beer foam B and the beer liquid L poured using the cap was performed.

Measurements of the thicknesses of the beer foam B under the above-mentioned conditions are shown in the following Table 3. Table 3 shows average values of the quantity of reproduction of the beer foam B (a unit is mm) when measurement of the thickness of beer B was repeated five times. In addition, beer A to beer E represent the kinds of beers, like the third example.

TABLE 3

| | Embodiment | Related art | Difference |
|---|---|---|---|
| Beer A | 68.2 | 63.8 | 4.4 |
| Beer B | 68.9 | 64.5 | 4.4 |

TABLE 3-continued

| | Embodiment | Related art | Difference |
|---|---|---|---|
| Beer C | 66.4 | 63.7 | 2.7 |
| Beer D | 67.4 | 62.6 | 4.8 |
| Beer E | 66.7 | 63.3 | 3.4 |

As shown in Table 3, in the tap of the embodiment, in comparison with the tap of the related art, in all of beer A to beer E, the thickness of the beer foam B was increased. In this way, in the tap of the embodiment configured to pour the beer foam B along the liquid surface S, in comparison with the tap of the related art, the quantity of reproduction of the beer foam B in all kinds of liquids can be increased.

(Eighth Embodiment)

Figure 42:
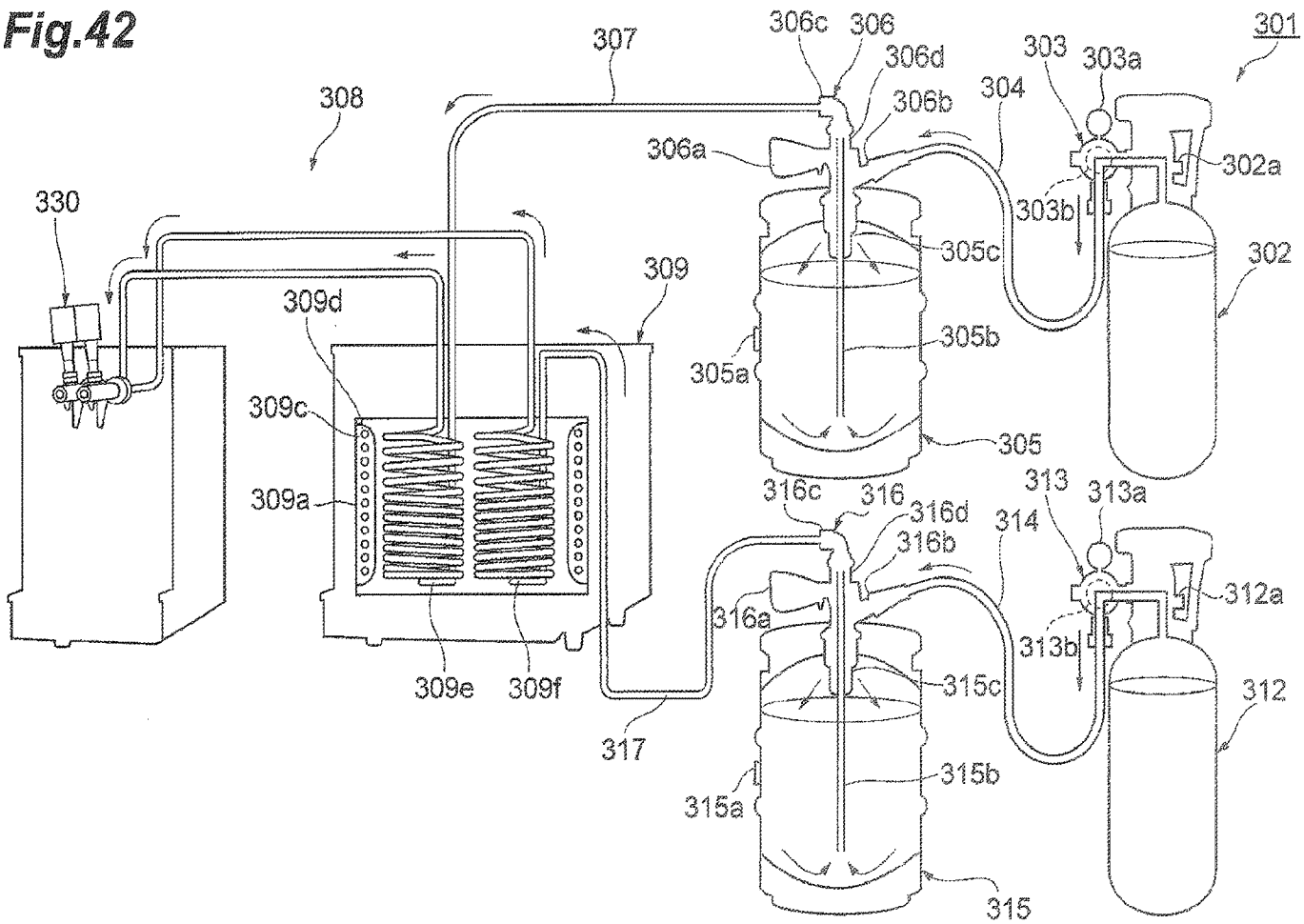
FIG. 42 is a view showing a configuration of a beverage vending apparatus including a tap unit of a seventh embodiment.

FIG. 42 shows the entire configuration of a beverage vending apparatus 301 for providing a cereal-based foaming beverage including a server 308 and a tap unit 330 of an eighth embodiment. Here, the cereal-based foaming beverage is a foaming beverage formed of a cereal as a raw material, for example, beer, low-malt beer, or the like, and the cereal includes one or more selected from the group consisting of, for example, barley, wheat, rice, maize, beans, and root vegetables. Further, cereal-based foaming beverages also include a beverage that does not include alcohol, in addition to an alcoholic beverage. In the embodiments, the case in which beer is provided as the cereal-based foaming beverage will be described. The beverage vending apparatus 301 is an apparatus installed in; for example, a restaurant and configured to pour beer from the tap unit 330 according to an order or the like of a customer. The tap unit 330 can pour a first beer liquid (for example, a light beer such as Pilsner beer, and hereinafter, a color of the light beer is referred to as gold), a second beer liquid (for example, a dark beer, and hereinafter, a color of the dark beer is referred to as brown or black), a first beer foam obtained by foaming the first beer liquid (for example, a white beer foam), and a second beer foam obtained by foaming the second beer liquid (for example, a light brown beer foam). First, the entire configuration of the beverage vending apparatus 301 will be described. The beverage vending apparatus 301 includes, in addition to the tap unit 330 and the server 308 of the embodiment, a carbon dioxide bottle 302, a decompression valve 303, a carbon dioxide hose 304, a beer barrel 305, a head 306 and a beer hose 307 that are configured to guide the first beer liquid to the tap unit 330, and a carbon dioxide bottle 312, a decompression valve 313, a carbon dioxide hose 314, a beer barrel 315, a head 316 and a beer hose 317 that are configured to guide the second beer liquid to the tap unit 330. The same bottle as the carbon dioxide bottle 2 of the first embodiment can be used as the carbon dioxide bottle 302, and the same valve as the decompression valve 3 of the first embodiment can be used as the decompression valve 303.

The beer barrel 305 is a container in which the first beer liquid is filled. Since the inside of the beer barrel 305 is sealed, unwanted bacteria or the like cannot enter the beer barrel 305. In addition, for example a card-shaped liquid temperature detection unit **305*a* can be attached to a surface of the beer barrel 305, and a temperature of the first beer liquid in the beer barrel 305 can be detected by the liquid temperature detection unit 305*a*. In addition to the temperature of the first beer liquid in the beer barrel 305, an optimal value of the gas pressure according to the detected temperature of the first beer liquid is displayed on the liquid temperature detection unit 305***a*. Accordingly, a user can set the gas pressure in the beer barrel 305 to an optimal value by manipulating a manipulation unit 303*b* of the decompression valve 303 while the gas pressure is displayed on the liquid temperature detection unit 305*a*. In addition, the beer barrel 305 includes a tube 305*b* through which the first beer liquid flows, and a mouthpiece (also referred to as a fitting valve) 305*c*. The tube 305*b* of the beer barrel 305 extends vertically in the beer barrel 305, and the mouthpiece 305*c* is installed at the upper end of the tube 305*b*.

The head 306 has a function of sending carbon dioxide gas in the carbon dioxide bottle 302 into the beer barrel 305 via the decompression valve 303 and the carbon dioxide hose 304 and sending the first beer liquid in the beer barrel 305 to the server 308. The head 306 includes a manipulation handle 306*a* configured to open/close the flow path of the carbon dioxide gas and the first beer liquid through vertical movement, a gas joint 306*b* connected to the carbon dioxide hose 304, and a beer joint 306*c* connected to the beer hose 307. The lower section of the head 306 is connected to the mouthpiece 305*c* of the beer barrel 305, the flow path of the carbon dioxide hose 304 and the beer hose 307 is opened by lowering the manipulation handle 306*a* of the head 306 in a state in which the lower section of the head 306 is connected to the mouthpiece 305*c*, and the flow path of the carbon dioxide hose 304 and the beer hose 307 is closed by raising the manipulation handle 306*a* of the head 306. Further, because the gas joint 306*b* and the beer joint 306*c* are detachably attached to a main body section 306*d* extending vertically at the central section of the head 306 and the gas joint 306*b*, the beer joint 306*c* and the main body section 306*d* can be disassembled, the head 306 has a structure that can be easily cleaned.

The carbon dioxide bottle 312, the decompression valve 313, the carbon dioxide hose 314, the beer barrel 315, the head 316 and the beer hose 317 that are configured to guide the second beer liquid to the server 308 have the same configurations as the carbon dioxide bottle 302, the decompression valve 303, the carbon dioxide hose 304, the beer barrel 305, the head 306 and the beer hose 307 that are configured to guide the first beer liquid, and are different in that the beer liquid accommodated in the beer barrel 315 is the second beer liquid. In addition, a residual quantity indication meter 312*a*, a residual pressure indication meter 313*a*, a manipulation unit 313*b*, a liquid temperature detection unit 315*a*, a tube 315*b*, a mouthpiece 315*c*, a manipulation handle 316*a*, a gas joint 316*b*, a beer joint 316*c* and a main body section 316*d* shown in FIG. 42 have the same functions as all of the residual quantity indication meter 302*a*, residual pressure indication meter 303*a*, the manipulation unit 303*b*, the liquid temperature detection unit 305*a*, the tube 305*b*, the mouthpiece 305*c*, the manipulation handle 306*a*, the gas joint 306*b*, the beer joint 306*c* and the main body section 306*d*.

The server 308 is connected to the head 306 via the beer hose 307 through which the first beer liquid flows, and connected to the head 316 via the beer hose 317 through which the second beer liquid flows. The server 308 is a so-called electric cooling type and instant cooling type server. The server 308 includes a cooling apparatus 309 configured to cool the first beer liquid and the second beer liquid sent from the beer barrels 305 and 315 via the heads 306 and 316 and the beer hoses 307 and 317, and the tap unit 330. The cooling apparatus 309 functions as a supply device configured to supply a beverage into a first tap 340 and a second, tap 350 (see FIG. 43) that constitute the tap unit 330. The cooling apparatus 309 includes a cooling pool 309*a* configured to accommodate cooling water, a beer pipe 309*e* connected to the beer hose 307 through which the first beer liquid flows and spirally formed in the cooling pool 309*a*, and a beer pipe 309*f* connected to the beer hose 317 through which the second beer liquid flows and spirally formed in the cooling pool 309*a*.

A refrigerant pipe 309*c* connected to a freezing cycle apparatus (not shown) of the cooling apparatus 309 continues vertically to the inner side surface of the cooling pool 309*a*, ice 309*d* is formed at the refrigerant pipe 309*c* by a freezing cycle in the freezing cycle apparatus, water in the cooling pool 309*a* is cooled, and further, the first and second beer liquids in the beer pipes 309*e* and 309*f* are cooled. Since the beer pipes 309*e* and 309*f* are formed in spiral shapes and the flow paths of the first and second beer liquids in the cooling pool 309*a* are lengthily secured, the first and second beer liquids in the beer pipes 309*e* and 309*f* can be more appropriately instantly cooled in the cooling apparatus 309.

Further, in the embodiment, an example in which the beer barrels 305 and 315 are installed outside the cooling apparatus 309 and the server 308 is the electric cooling type and instant cooling type server will be described. However, instead of the electric cooling type and instant cooling type server, the ice cooling type and instant cooling type server, or a barrel housing type server in which the beer barrels 305 and 315, the heads 306 and 316 and the beer hoses 307 and 317 are installed in a refrigerator may be used. Here, the ice cooling type and instant cooling type server is a server in which ice is formed in a cooling pool and a beer pipe is cooled by the ice via a cold plate (not shown). In addition, the barrel housing type server is a server including a structure in which a beer barrel, a head and a beer hose are housed in a refrigerator and the beer hose is cooled by the refrigerator. In addition, while the cooling apparatus 309 is separately installed from the tap unit 330 in FIG. 42, the cooling apparatus 309 may be integrated with the tap unit 330.

Here, the tap unit 330 configured to pour the beer cooled by the cooling apparatus 309 will be described in detail.

Figure 43:
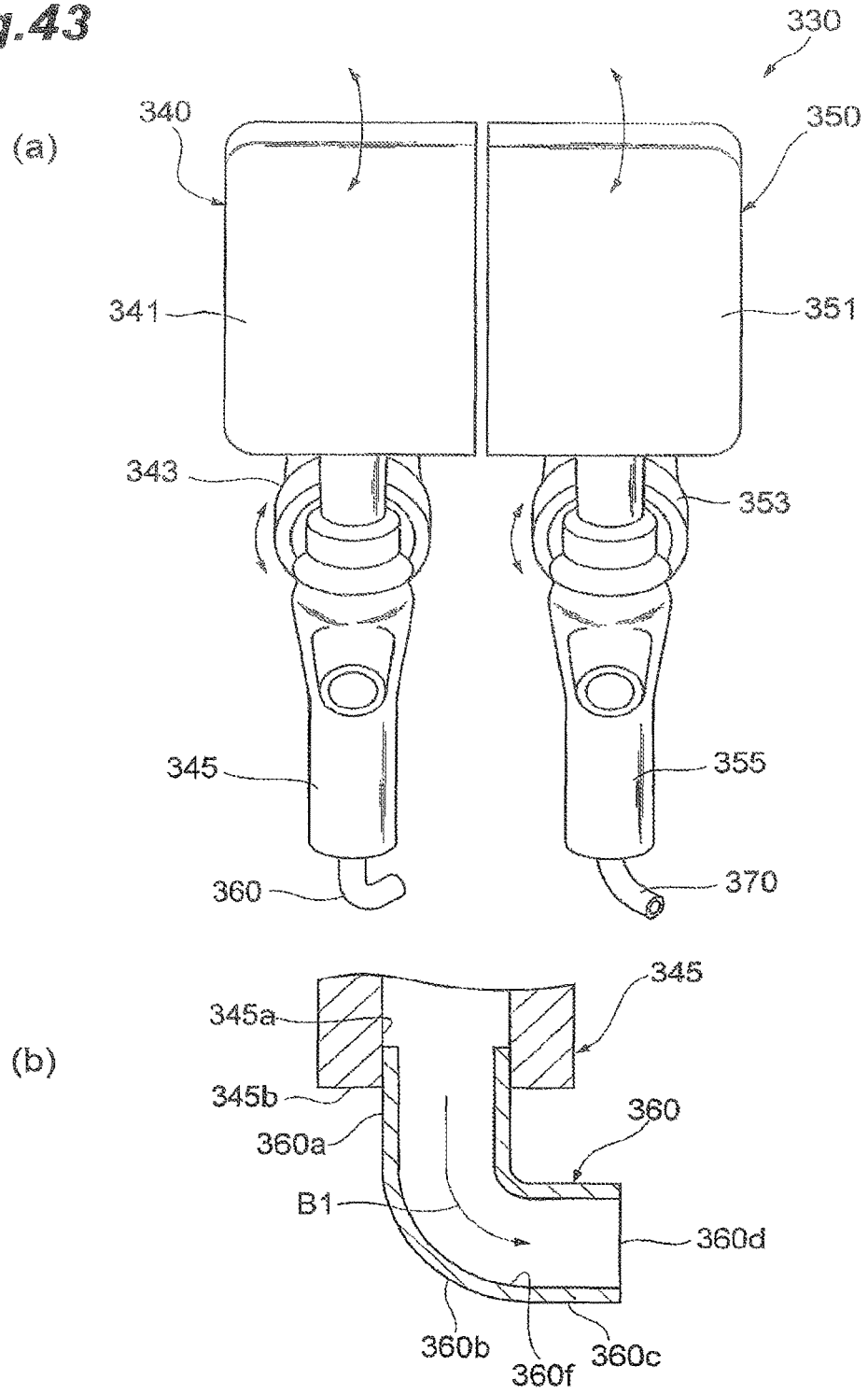
FIG. 43 is a view showing a tap that constitutes the tap unit of FIG. 42.
Figure 46:
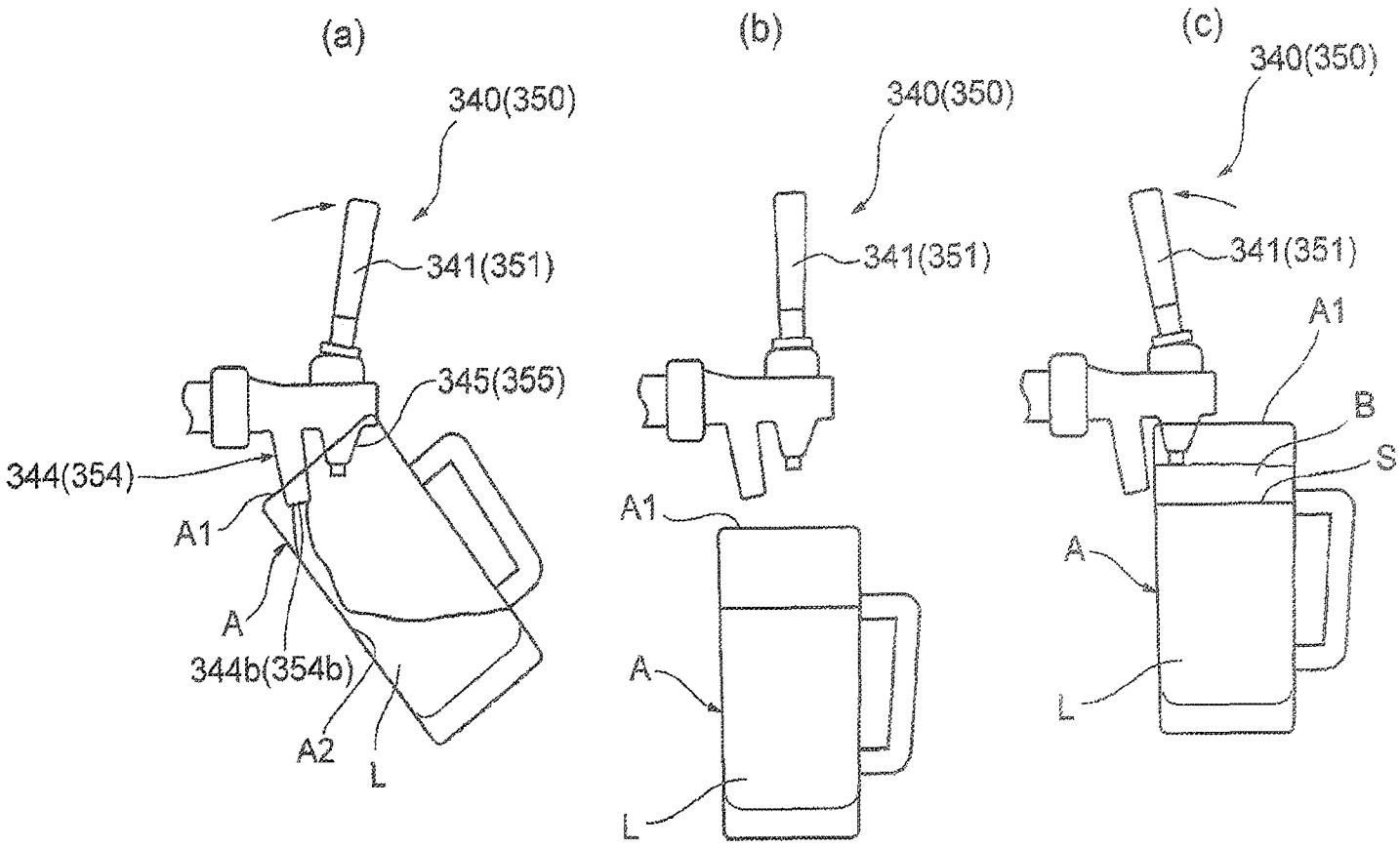
FIG. 46 is a view showing a flow of pouring of beer using the tap unit of FIG. 42.

As shown in FIG. 43, the tap unit 330 includes the first tap 340 configured to pour the first beer and the second tap 350 configured to pour the second beer, and a distance between the first tap 340 and the second tap 350 is smaller than a diameter of the opening A1 of the beverage container A (see FIG. 46). Accordingly, when the beverage container A is disposed under the first and second taps 340 and 350 and the first and second taps 340 and 350 are simultaneously manipulated, the first and second beers can be simultaneously poured into the beverage container A. Further, only the first tap 340 or only the second tap 350 can be manipulated, in which case either the first beer or the second beer can be poured into the beverage container A.

Figure 44:
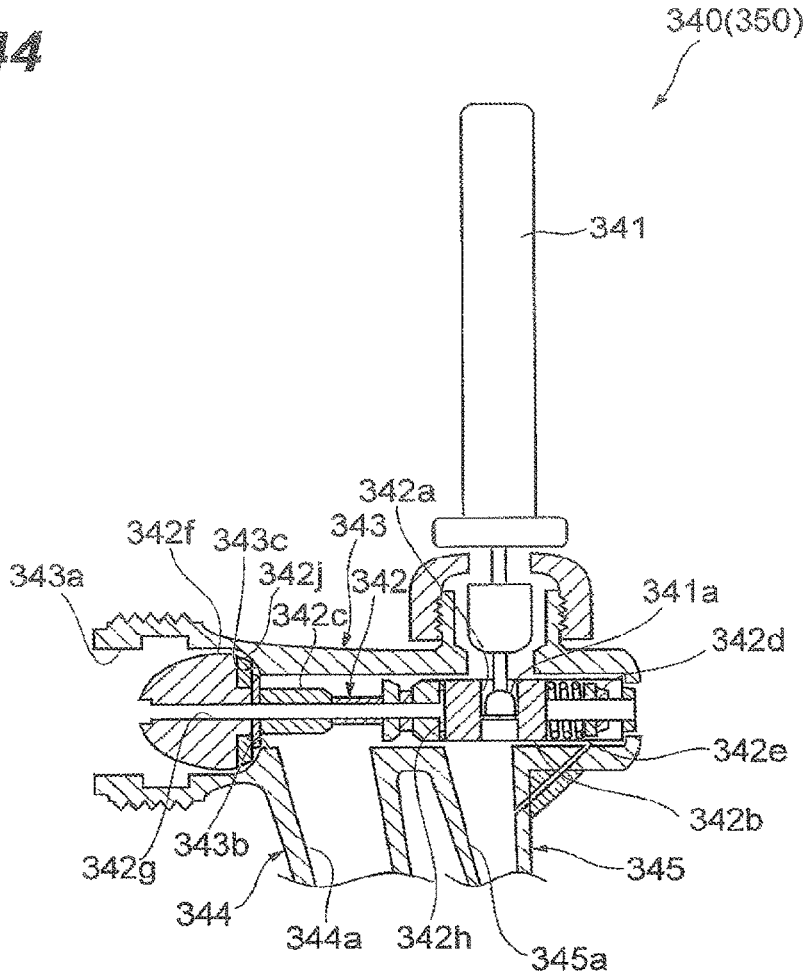
FIG. 44 is a cross-sectional view showing a flow path in the tap of FIG. 42.
Figure 45:
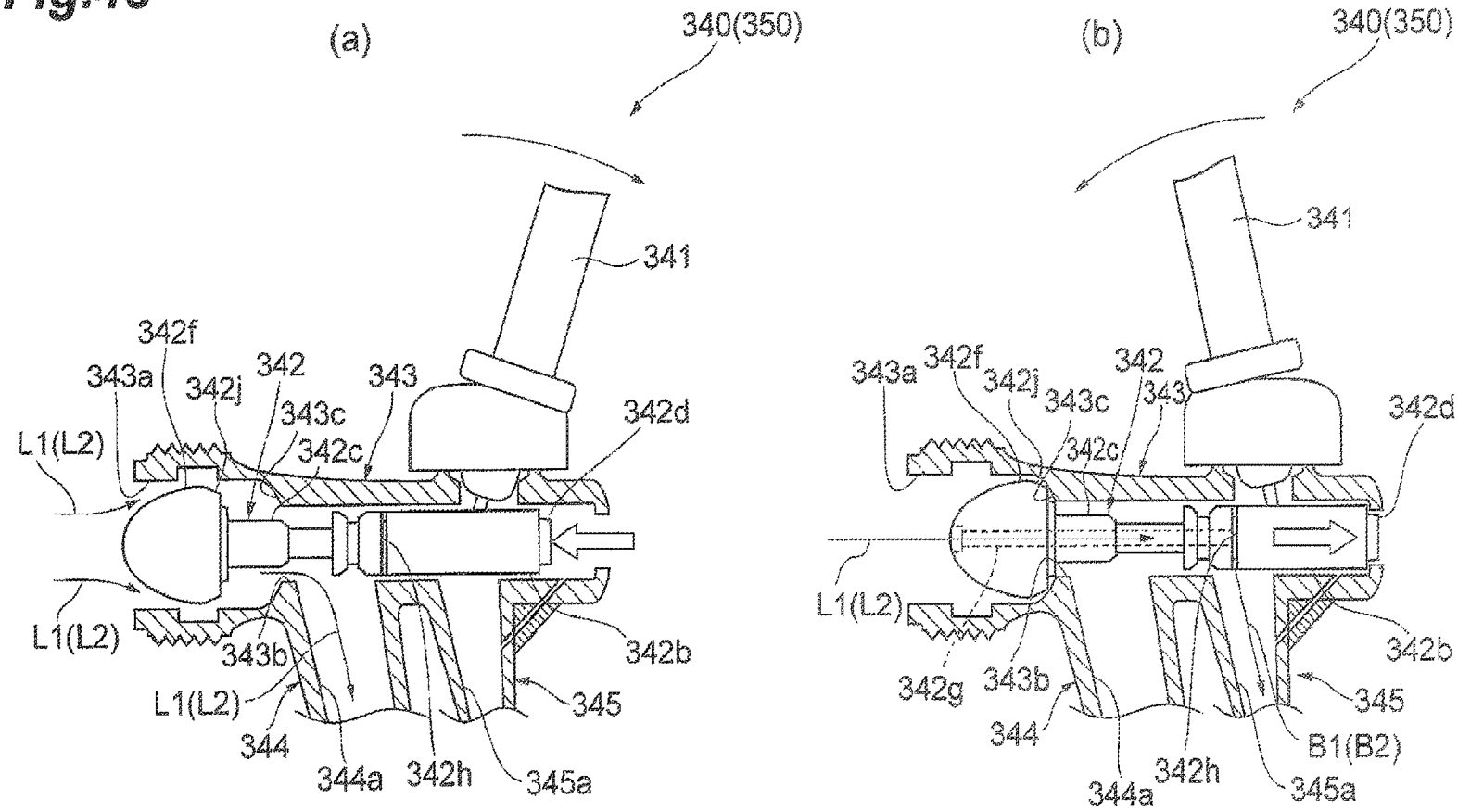
FIG. 45 is a cross-sectional view showing a relation of a lever manipulation with flows of a beer liquid and a foam body.

As shown in FIGS. 43 to 45, the first tap 340 includes a lever 341 that can be movably manipulated by hand, a slide valve 342 configured to open/close a flow path of the first beer in the first tap 340 by manipulation of the lever 341, a tap main body 343 configured to movably hold the slide valve 342 therein, and a nozzle 344 for a liquid and a nozzle 345 for a foam body extending from the tap main body 343 in an inclined downward direction. In addition, since the second tap 350 has the same configuration as the first tap 340, description of overlapping parts with the first tap 340 will be omitted.

The lever 341 of the first tap 340 is movable toward both of a back side and a front side of (a) in FIG. 43 in a state in which a user is positioned at the front side of (a) in FIG. 43. Hereinafter, the front side of FIG. 43 is simply referred to as a front side, and the back side of FIG. 43 is simply referred to as a back side. The lever 341 of the first tap 340 has a plate shape integrated with a lever 351 of the second tap 350, and has a shape such that the first and second taps 340 and 350 can be easily pushed and pulled simultaneously.

A lower end 341*a* (see FIG. 44) of the first lever 341 is engaged with an engaging concave section 342*a* formed in a surface of the slide valve 342. The slide valve 342 includes a valve main body 342*b* formed in a substantially columnar shape and having the engaging concave section 342*a* on a surface thereof, a shaft section 342*c* configured to movably support the valve main body 342*b* at the front side, a spring 342*e* configured to bias the valve main body 342*b* installed between an end section 342*d* of the front side of the shaft section 342*c* and the valve main body 342*b* toward the front side and the back side, and a diameter expanding section 342*f* fixed to the back side of the shaft section 342*c* and having a diameter increased with respect to the shaft section 342*c*.

As shown in FIG. 44 and (b) in FIG. 45, a flow path 342*g* through which the first beer liquid L1 and a first beer foam (a first foam body) B1 flow is formed in the valve main body 342*b*, the shaft section 342*c* and the diameter expanding section 342*f* of the slide valve 342. In addition, a foam charge hole 342*h* configured to eject the first beer foam B1 is formed in an end section of the front side of the flow path 342*g*. The foam charge hole 342*h* is configured to be opened only when the valve main body 342*b* moves to the front side with respect to the shaft section 342*c*, and eject the first beer foam B1 to the nozzle 345 for a foam body (the first nozzle 345 for a foam body) when opened. The tap main body 343 includes a first beer liquid flow path 343*a* disposed at the end section of the back side of the tap main body 343 and in communication with the beer pipe 309*e* of the cooling apparatus 309, and a second beer liquid flow path 343*b* having a diameter that increases at the front side of the beer liquid flow path 343*a*.

The nozzle 344 for a liquid extends from the tap main body 343 in an inclined downward direction, and includes a flow path 344*a* for a liquid formed in the nozzle 344 for a liquid, in communication with the second beer liquid flow path 343*b* in the tap main body 343 and through which the beer liquid L1 flows. The nozzle 345 for a foam body extends from the tap main body 343 at the front side of the nozzle 344 for a liquid in an inclined downward direction, and a flow path 345*a* for a foam body through which the first beer foam B1 poured from the foam charge hole 342*h* flows is formed in the nozzle 345 for a foam body. Further, the first beer foam B1 is a liquid foam body that includes air bubbles formed from a film of the first beer liquid.

The second beer foam B2 flows through a nozzle 355 for a foam body (see FIG. 43) of the second tap 350, and the second beer foam B2 is a liquid foam body that includes air bubbles formed from a film of the second beer liquid. In addition, as shown in (a) in FIG. 43, since the tap main body 343 of the first tap 340 and a tap main body 353 of the second tap 350 are rotatable together, a distance between the front ends of the nozzles for a liquid and a distance between the front ends of the nozzles for a foam body can be appropriately varied.

As shown in FIG. 43, a tubular pouring member 360 configured to pour the first beer foam B1 in the flow path 345*a* for a foam body into the beverage container A is installed at a front end section 345*b* of the flow path 345*a* for a foam body of the nozzle 345 for a foam body. The pouring member (a first pouring member) 360 includes a first extension section 360*a* attached to the inner side surface of the flow path 345*a* for a foam body of the nozzle 345 for a foam body and extending downward from the front end section 345*b* of the nozzle 345 for a foam body, a folded section 360*b* folded at the lower end of the first extension section 360*a*, and a second extension section 360*c* extending from the folded section 360*b* in the horizontal direction. In addition, a flow path 360*f* in communication with the flow path 345*a* for a foam body of the nozzle 345 for a foam body and through which the first beer foam B1 passes is formed inside the pouring member 360. An outlet port 360*d* through which the first beer foam B1 is discharged to the outside is formed at the front end section of the second extension section 360*c*.

In addition, the pouring member 360 has the folded section 360*b* at the lower end of the first extension section 360*a*, and thus the front end section of the flow path 360*f* through which the first beer foam B1 flows is curved along the liquid surface S (see FIG. 47) of the beer liquid L in the beverage container A. That is, the front end section of the flow path 360*f* is curved to form an angle of 0° or more and 45° or less upward and downward with respect to the liquid surface S of the beer liquid L, and the flow path 360*f* is formed such that the pouring angle of the first beer foam B1 is an angle of 0° or more and 45° or less upward and downward with respect to the liquid surface S. In addition, the front end section configured to pour the beer foam B1 in the flow path 360*f* through which the first beer foam B1 flows is oriented in a direction of 0° or more and 45° or less upward and downward with respect to the liquid surface S of the beer liquid L. Here, the angle is preferably 0° or more and 30° or less upward with respect to the liquid surface S or 0° or more and 30° or less downward with respect to the liquid surface S, and more preferably 0° or more and 15° or less upward with respect to the liquid surface S or 0° or more and 15° or less downward with respect to the liquid surface S. Further, the direction along the liquid surface S and the direction along the horizontal direction are shown as the same direction.

Here, the front end section of the flow path 360*f* and the front end section configured to pour the beer foam B1 are the folded section 360*b* and the second extension section 360*c*, respectively. In addition, the case in which the flow path 360*f* is curved along the liquid surface S also includes, in addition to the case in which the second extension section 360*c* is curved in the horizontal direction, the case in which the second extension section 360*c* is curved upward or downward with respect to the horizontal plane, and for example, is referred to as the case in which the folded section 360*b* and the second extension section 360*c* serving as the front end section of the flow path 360*f* are curved to form an angle of 0° or more and 45° or less upward and downward with respect to the liquid surface S of the beer liquid L. Here, the angle is preferably 0° or more and 30° or less upward with respect to the liquid surface S or 0° or more and 30° or less downward with respect to the liquid surface S, and more preferably 0° or more and 15° or less upward with respect to the liquid surface S or 0° or more and 15° or less downward with respect to the liquid surface S. Further, in FIG. 43, an example in which the second extension section 360*c* is curved in the horizontal direction is shown.

In addition, a tubular pouring member (a second pouring member) 370 configured to pour the second beer foam B2 into the beverage container A is installed at the front end section of the nozzle 355 for a foam body through which the second beer foam B2 flows, and the pouring member 370 has the same configuration as the pouring member 360 configured to pour the first beer foam B1. That is, the flow path of the pouring member 370 through which the second beer foam B2 flows is curved along the liquid surface S of the beer liquid L in the beverage container A. Then, a direction in which the pouring member 360 pours the first beer foam B1 is an opposite direction of a direction in which the pouring member 370 pours the second beer foam B2 with respect to a straight line X (see (b) in FIG. 47) that connects the pouring member 360 (the first extension section 360*a*) and the pouring member 370 (a first extension section 370*a*). Further, in FIG. 47, while the beer foams B1 and B2 are poured clockwise when seen in a plan view, the beer foams B1 and B2 may be poured counterclockwise.

Next, operations of the components when the beer serving as the cereal-based foaming beverage is poured into the beverage container A using the tap unit 330 will be described with reference to FIGS. 44 to 46. First, in a state in which a user of the beverage vending apparatus 301 does not manipulate the levers 341 and 351, an end surface 342*j* of the front side of the diameter expanding section 342*f* in the slide valve 342 abuts a wall surface 343*c* in the tap main body 343, and the first beer liquid flow path 343*a* and the second beer liquid flow path 343*b* in the tap main body 343 are blocked.

In this state, as shown in (a) in FIG. 46, the user of the beverage vending apparatus 301 positions the beverage container A at lower sections of taps 340 and 350 such that the opening A1 of the upper end of the beverage container A is inclined at the back side by about 45 degrees. Then, when the user moves the levers 341 and 351 toward the front side in this state, as shown in (a) in FIG. 45, the slide valve 342 moves toward the back side. When the slide valve 342 moves toward the back side, the end surface 342*j* of the diameter expanding section 342*f* is separated from the wall surface 343*c* in the tap main body 343, and the first beer liquid flow path 343*a* and the second beer liquid flow path 343*b* come in communication with each other. When the first beer liquid flow path 343*a* and the second beer liquid flow path 343*b* come in communication with each other, the first beer liquid L1 and the second beer liquid L2 are guided to the flow path 344*a* for a liquid of the nozzle 344 for a liquid through the first beer liquid flow path 343*a* and the second beer liquid flow path 343*b*, respectively. Then, the first beer liquid L1 and the second beer liquid L2 guided to the flow path 344*a* for a liquid of the nozzle 344 for a liquid are poured from lower ends 344*b* and 354*b* (see (a) in FIG. 46) of the nozzle 344 for a liquid toward the inner side surface A2 of the beverage container A inclined toward the back side by 45 degrees. In this way, the beer liquid L obtained by mixing the first beer liquid L1 and the second beer liquid is poured into the beverage container A. In this way, as the beer liquid L is poured in a state in which the beverage container A is inclined, an impulsive force on the inner side surface A2 of the beverage container A can be reduced, and generation of the initial foam upon the pouring of the beer liquid L can be suppressed.

As shown in FIG. 44 and (b) in FIG. 46, when the pouring of the beer liquid L into the beverage container A is terminated, the user returns the levers 341 and 351 to their original positions by vertically erecting the beverage container A such that the opening A1 is directed upward. Here, since the end surface 342*j* of the diameter expanding section 342*f* in the slide valve 342 abuts the wall surface 343*c* in the tap main body 343, as the first beer liquid flow path 343*a* and the second beer liquid flow path 343*b* are blocked, the pouring of the beer liquid L into the beverage container A is blocked.

Then, as shown in (b) in FIG. 45 and (c) in FIG. 46, the user of the beverage vending apparatus 301 pushes the levers 341 and 351 of the taps 340 and 350 toward the back side to generate the beer foam B constituted by the first beer foam B1 and the second beer foam B2 on the liquid surface S of the beer liquid L in the beverage container A in a state in which the beverage container A stands vertically. When the levers 341 and 351 are pushed toward the back side, the valve main body 342*b* of the slide valve 342 moves toward the front side with respect to the shaft section 342*c*, and the foam charge hole 342*h* is opened. When the foam charge hole 342*h* is opened, the first beer liquid L1 and the second beer liquid L2 enter the flow path 342*g* of the slide valve 342 from the first beer liquid flow path 343*a* of the tap main body 343. The first beer liquid L1 and the second beer liquid L2 entering the flow path 342*g* arrive at the foam charge hole 342*h*, and the first beer liquid L1 and the second beer liquid L2 arriving at the foam charge hole 342*h* are converted into the beer foam B1 and B2 and ejected downward toward the flow path 345*a* for a foam body of the nozzles 345 and 355 for a foam body from the foam charge hole 342*h*.

Figure 47:
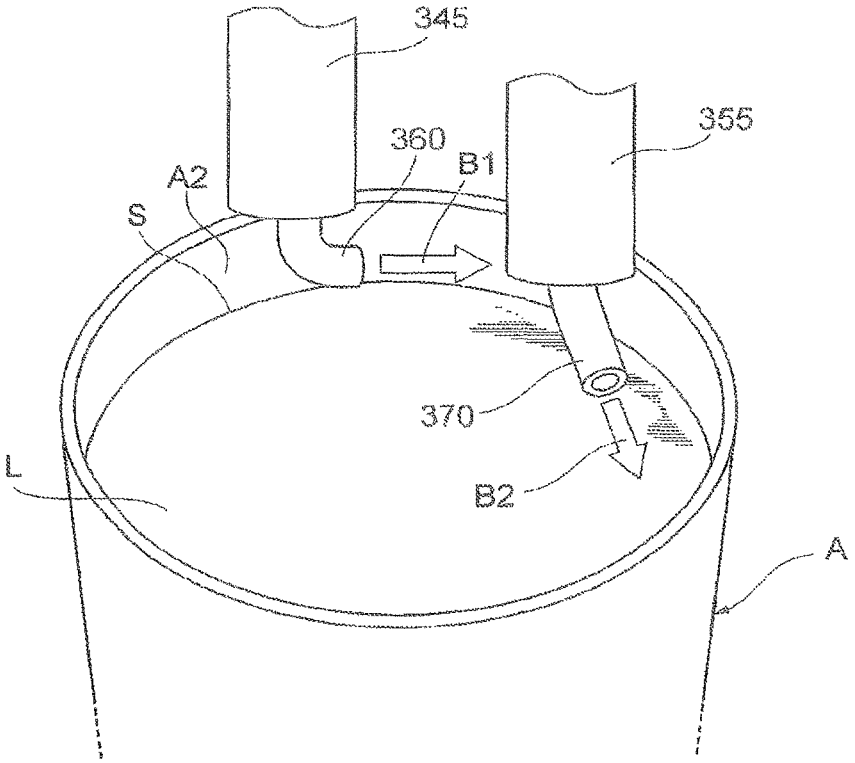
FIG. 47 is a view showing generation of the foam body using the tap unit of FIG. 42.
Figure 47:
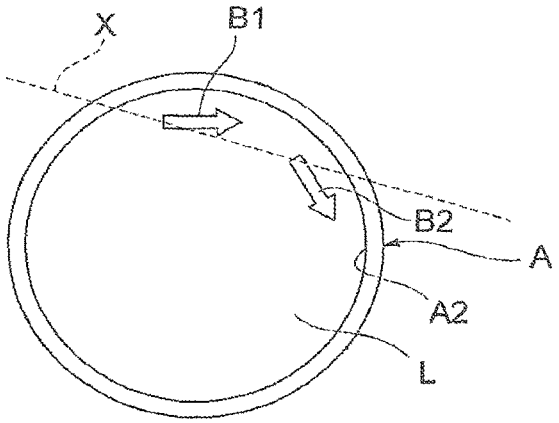

Here, as shown in FIGS. 43 and 47, when the beer foam B is generated on the liquid surface S of the beer liquid L in the beverage container A, the second extension section is folded to extend in substantially a horizontal direction by folded sections of the pouring members 360 and 370. That is, since the second extension sections of the pouring members 360 and 370 are curved along the liquid surface S of the beer liquid L in the beverage container A, the first and second beer foams B1 and B2 in the nozzles 345 and 355 for a foam body are poured from the outlet ports of the pouring members 360 and 370 along the liquid surface S of the beer liquid L.

In this way, according to the tap unit 330 and the server 308 of the embodiment, the front end section of the flow path through which the beer foams B1 and B2 flow is curved along the liquid surface S of the beer liquid L. Accordingly, when the first and second beer foams B1 and B2 having different kinds of liquids are poured onto the liquid to generate the beer foams B1 and B2 on the upper section of the beer liquid L, the first and second beer foams B1 and B2 are poured along the liquid surface S. In this way, as the beer foams B1 and B2 are poured along the liquid surface S, the beer foams B1 and B2 are not easily mixed with the beer liquid L when the beer foams B1 and B2 having different kinds of liquids are poured. Accordingly, a mixed state of the beer foams B1 and B2 having various kinds of liquids can be easily controlled, and favorability of the beer can be increased while improving a design characteristic of the beer.

In addition, the front end sections of the flow paths through which the beer foams B1 and B2 pass are curved to form an angle of 0° or more and 45° or less upward and downward with respect to the liquid surface S of the beer liquid L, the pouring member 360 configured to pour the beer foam B1 is installed at the first tap 340, the pouring member 370 configured to pour the beer foam B2 is installed at the second tap 350, and the front end sections of the flow paths through which the foam bodies pass in the pouring members 360 and 370 are curved along the liquid surface S of the beer liquid L. In this way, since the flow paths in the pouring members 360 and 370 are curved along the liquid surface S, the beer foams B1 and B2 are poured along the liquid surface S, and since the beer foam cannot be easily mixed with the beer liquid L, the mixed state of the beer foams B1 and B2 can be easily controlled to improve a design characteristic and favorability of the beverage.

In addition, in the tap unit 330 of the embodiment, the flow paths through which the beer foams B1 and B2 pass are formed such that the pouring angles of the beer foams B1 and B2 are angles of 0° or more and 45° or less upward and downward with respect to the horizontal direction. In this way, since the flow paths are formed such that the pouring angles of the beer foams B1 and B2 are angles of 0° or more and 45° or less upward and downward with respect to the horizontal direction, the beer foams B1 and B2 can be poured along the liquid surface S, and the mixed state of the beer foams B1 and B2 can be easily controlled.

In addition, in the tap unit 330, the front end section configured to pour the beer foam B1 and the front end section configured to pour the beer foam B2 are oriented in a direction of 0° or more and 45° or less upward and downward with respect to the liquid surface S of the beer liquid L. In this way, since the front end sections of the flow paths of the beer foams B1 and B2 are oriented in a direction of 0° or more and 45° or less upward and downward with respect to the liquid surface S, the beer foams B1 and B2 can be poured along the liquid surface S, and the mixed state of the beer foams B1 and B2 can be easily controlled.

Figure 51:
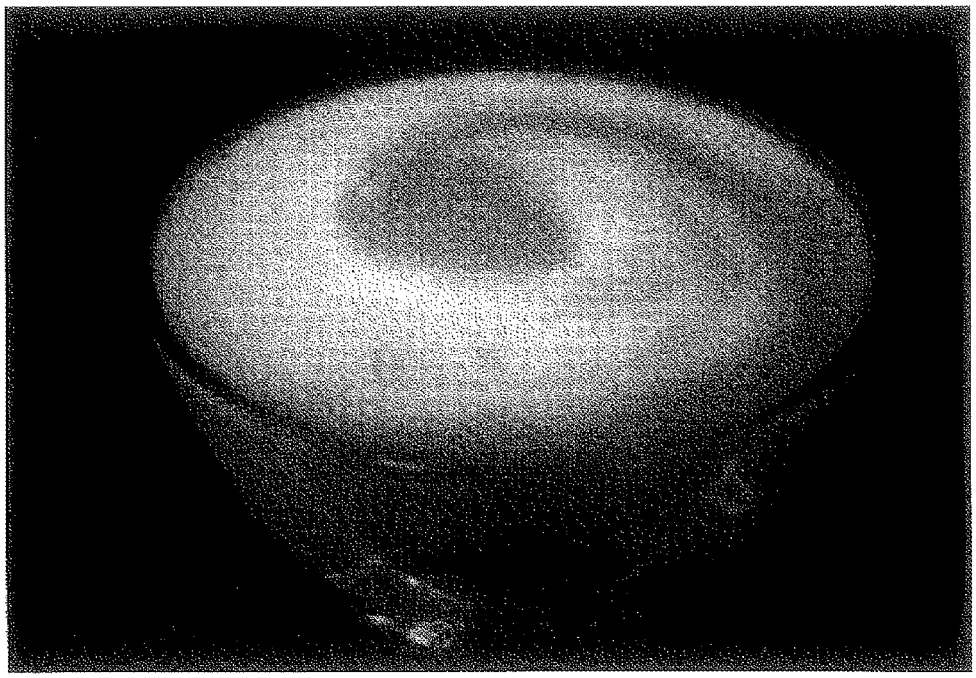
FIG. 51 is a photograph showing the generated foam body.

In addition, the direction of pouring the beer foam B1 from the first tap 340 and the direction of pouring the beer foam B2 from the second tap 350 are directions in which the poured beer foams B1 and B2 form a spiral shape as shown in FIG. 51. In this way, the pouring directions of the beer foams B1 and B2 are determined such that the beer foams B1 and B2 form a spiral shape. Accordingly, in the beverage of the embodiment, when seen in a plan view, since the beer foam B1 and the beer foam B2 form a vortex shape, the beverage having a good appearance and an improved design characteristic is provided.

In addition, since the beer foams B1 and B2 are poured along the beer liquid L from the pouring members 360 and 370 of the nozzles 345 and 355 for a foam body, the impulsive force to the beer liquid L generated when the beer foams B1 and B2 are poured from the nozzles 345 and 355 for a foam body can be reduced. Accordingly, generation of rough foam when the beer foams B1 and B2 are poured can be suppressed, and generation of a situation in which the beer foams B1 and B2 are irregularly agitated can be avoided. Accordingly, the beer foams B1 and B2 can be beautifully poured onto the liquid surface S without being covered with the rough foam.

In addition, since the pouring members 360 and 370 are formed in a tubular shape folded along the beer liquid L in the beverage container A, as the pouring members 360 and 370 are folded along the liquid surface S of the beer liquid L in the beverage container A, a configuration suppressing generation of the rough foam can be easily realized.

In addition, as shown in (b) in FIG. 47, the direction in which the pouring member 360 pours the first beer foam B1 is an opposite direction of a direction in which the pouring member 370 pours the second beer foam B2 with respect to the straight line X that connects the pouring member 360 (the first extension section 360*a*) and the pouring member 370 (the first extension section 370*a*). Accordingly, the first beer foam B1 can be poured by the pouring member 360 in a direction along the inner side surface A2 of the beverage container A, and the second beer foam B2 can be poured by the pouring member 370 in a direction along the inner side surface A2 and a direction different from the direction in which the first beer foam B1 is poured. As such pouring is performed, the first beer foam B1 and the second beer foam B2 are moved in the spiral shape in the beverage container A.

Further, when the first beer foam B1 and the second beer foam B2 are poured along the inner wall of the beverage container A while abutting the inner wall of the beverage container A, a force of the first beer foam B1 and the second beer foam B2 moving in a circular direction in the beverage container A is increased. Accordingly, the first beer foam B1 and the second beer foam B2 can easily form a vortex shape. In addition, since a force of the beer foams B1 and B2 applied to the beer liquid L is relatively small, the beer foams B1 and B2 are not easily mixed with the beer liquid L.

Here, as the first beer foam B1 and the second beer foam B2 are moved in the spiral shape in the beverage container A, when the first beer foam B1 and the second beer foam B2 are beautifully mixed and moved, the vortex shape as shown in FIG. 51 can be formed by the first and second beer foams B1 and B2. In addition, a marble-like marble form can be formed by the first beer foam B1 and the second beer foam B2 even when the first beer foam B1 and the second beer foam B2 do not move in the spiral shape on the way. That is, designs like in latte art can be formed by the first and second beer foams B1 and B2. As the first and second beer foams B1 and B2 are poured such that the first and second beer foams B1 and B2 are moved in the spiral shape, a design characteristic can be improved while improving an appearance of the beer.

(Ninth Embodiment)

Next, a tap unit, a server, a pouring member and a beverage of a ninth embodiment will be described with reference to FIGS. 48 to 50. A tap unit 375 of the ninth embodiment is the same as the tap unit 330 of the eighth embodiment and is installed at the beverage vending apparatus 301, and the flow paths of the carbon dioxide gas and the beer liquid are the same as those of the eighth embodiment. The tap unit 375 of the ninth embodiment is distinguished from the tap unit 330 of the eighth embodiment in that taps 380 and 390 having the pouring members 400 and 410 extending downward in linear shapes are used instead of the taps 340 and 350 having the tubular pouring members 360 and 370 folded at the folded sections, and other details are the same. Accordingly, in the ninth embodiment, only the pouring members 400 and 410 formed in the linear shapes extending downward will be described in detail, and description of other configurations will be omitted. In addition, since the pouring member 410 configured to pour the second beer foam B2 has the same configuration as the pouring member 400 configured to pour the first beer foam B1, description of overlapping parts of the pouring member 410 will be omitted.

Figure 48:
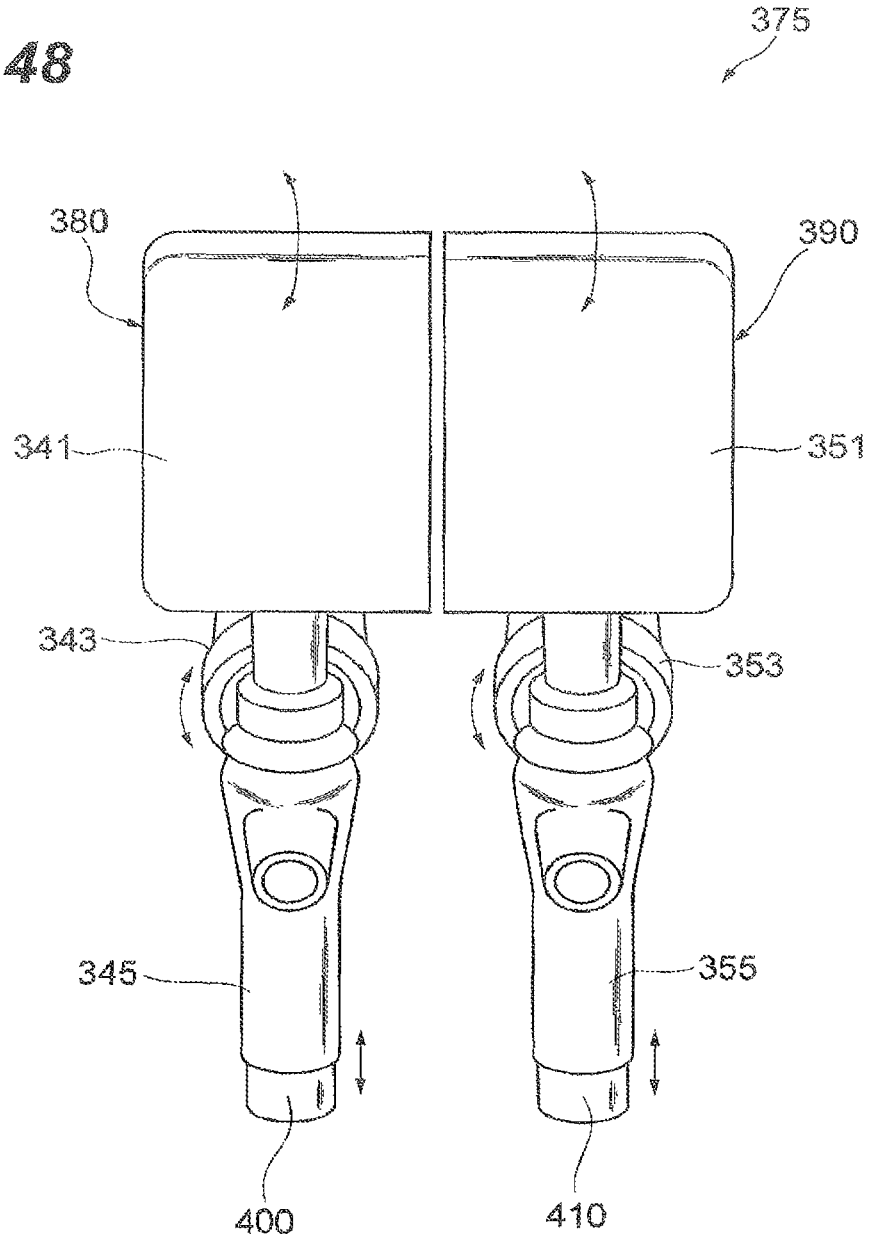
FIG. 48 is a perspective view showing a tap that constitutes a tap unit of an eighth embodiment.
Figure 49:
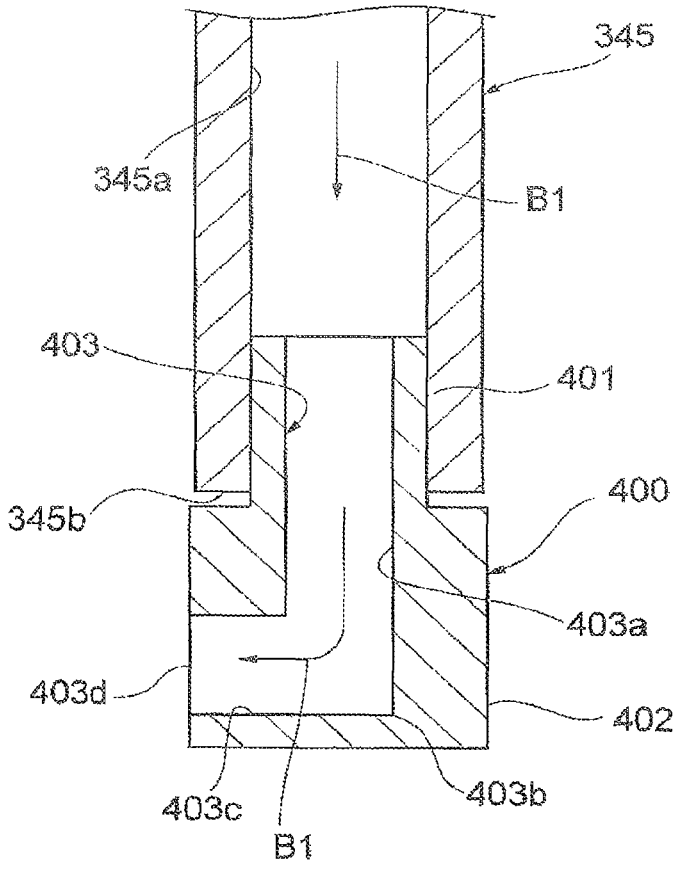
FIG. 49 is a cross-sectional view showing a flow path of a foam body in a pouring member of the tap unit of FIG. 48.

As shown in FIGS. 48 and 49, the pouring member 400 of the ninth embodiment includes a columnar fitting protrusion 401 fitted into the front end section 345*b* of the nozzle 345 for a foam body, and a columnar flow path conversion section 402 having a diameter that increases at the lower section of the fitting protrusion 401. The pouring member 400 of the ninth embodiment is attached to the nozzle 345 for a foam body by fitting the fitting protrusion 401 into the front end section 345*b* of the nozzle 345 for a foam body. In addition, the pouring member 400 can be removed from the nozzle 345 for a foam body by pulling the flow path conversion section 402 from below, and can be detachably attached to the nozzle 345 for a foam body. A flow path 403 through which the first beer foam B1 flows is formed in the fitting protrusion 401 and the flow path conversion section 402, and the flow path 403 of the pouring member 400 includes a first extension section 403*a* extending downward from the upper end of the fitting protrusion 401, a folded section 403*b* folded at the lower end of the first extension section 403*a*, and a second extension section 403*c* extending from the folded section 403*b* in a substantially horizontal direction. An outlet port 403*d* configured to discharge the first beer foam B1 to the outside is formed at the end section of the second extension section 403*c*.

In addition, the pouring member 400 of the ninth embodiment has the folded section 403*b* at the lower end of the first extension section 403*a*, and the front end section of the flow path 403 through which the first beer foam B1 flows is curved along the liquid surface S (see FIG. 47) of the beer liquid L in the beverage container A. That is, the front end section of the flow path 403 is curved to form an angle of 0° or more and 45° or less upward and downward with respect to the liquid surface S of the beer liquid L, and the flow path 403 is formed such that the pouring angle of the beer foam B1 is an angle of 0° or more and 45° or less upward and downward with respect to the horizontal direction. In addition, the front end section configured to pour the beer foam B1 in the flow path 403 through which the beer foam B1 flows is oriented in a direction of 0° or more and 45° or less upward and downward with respect to the liquid surface S of the beer liquid L. Here, the angle is preferably 0° or more and 30° or less upward with respect to the liquid surface S or 0° or more and 30° or less downward with respect to the liquid surface S, and more preferably 0° or more and 15° or less upward with respect to the liquid surface S or 0° or more and 15° or less downward with respect to the liquid surface S.

Here, the front end section of the flow path 403 and the front end section configured to pour the beer foam B1 are the folded section 403*b* and the second extension section 403*c*, respectively. In addition, the case in which the flow path 403 is curved along the liquid surface S also includes, like the eighth embodiment, the case in which the second extension section 403*c* is curved upward or downward with respect to the horizontal plane, and for example, is referred to as the case in which the folded section 403*b* and the second extension section 403*c* serving as the front end section of the flow path 403 are curved to form an angle of 0° or more and 45° or less upward and downward with respect to the liquid surface S of the beer liquid L. Here, the angle is preferably 0° or more and 30° or less upward with respect to the liquid surface S or 0° or more and 30° or less downward with respect to the liquid surface S, and further, more preferably, 0° or more and 15° or less upward with respect to the liquid surface S and 0° or more and 15° or less downward with respect to the liquid surface S. Further, in FIG. 49, an example in which the second extension section 403*c* is curved in the horizontal direction is shown.

Figure 50:
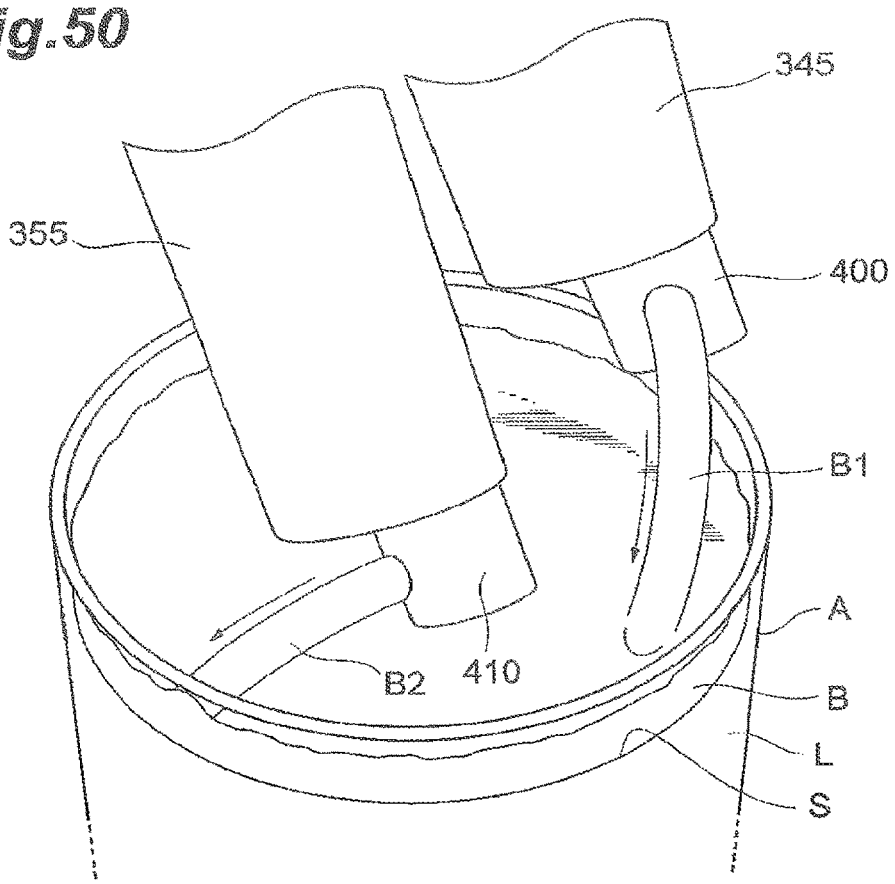
FIG. 50 is a perspective view showing generation of the foam body using the tap unit of FIG. 48.

Here, as shown in FIGS. 49 and 50, since the second extension sections of the flow paths are folded at the folded sections in the pouring members 400 and 410, the first and second beer foams B1 and B2 are poured from the outlet port along the liquid surface S of the beer liquid L. Accordingly, according to the tap unit 375 and the server of the ninth embodiment, as the beer foams B1 and B2 are poured along the liquid surface S, the beer foams B1 and B2 are not easily mixed with the beer liquid L when the different kinds of beer foams B1 and B2 are poured. Accordingly, the mixed state of the beer foams B1 and B2 having different kinds of liquids can be easily controlled, and in the tap unit, the server, the pouring member and the beverage of the ninth embodiment, favorability can be increased while improving a design characteristic, and the same effect as in the eighth embodiment can be obtained.

In addition, since the pouring members 400 and 410 of the ninth embodiment are detachably attached, the pouring members 400 and 410 can be attached to the nozzle for a foam body of the related art and the beer foams B1 and B2 can be poured along the liquid surface S of the beer liquid L. Then, since the pouring members 400 and 410 can be removed from the nozzles 345 and 355 for a foam body and cleaned, the pouring members 400 and 410 can be handled more sanitarily.

Further, as the beer foams B1 and B2 are poured along the liquid surface S, an impulsive force on the liquid surface S generated when the beer foams B1 and B2 are poured from the nozzles 345 and 355 for a foam body can be reduced. Accordingly, generation of the rough foam when the beer foams B1 and B2 are poured can be suppressed, and generation of a situation in which the beer foams B1 and B2 are irregularly agitated can be avoided. Accordingly, the beer foams B1 and B2 can be beautifully poured on the liquid surface S without being covered with the rough foam, and further, since the mixed state of the beer foams B1 and B2 can be controlled, a design characteristic of the beer can be improved to increase favorability.

In addition, as the pouring members 400 and 410 are formed in linear shapes extending downward, the shapes of the pouring members 400 and 410 can be simplified to simplify manufacture of the pouring members 400 and 410. In addition, since the pouring members 400 and 410 are not formed in curved shapes, the exteriors of both of the nozzles 345 and 355 for a foam body can remain relatively unchanged from the related art.

(Tenth Embodiment)

Hereinafter, a tap unit, a server, a pouring member and a beverage of a tenth embodiment will be described. The tap unit of the tenth embodiment uses a nozzle for a foam body and a pouring member configured to pour a plurality of kinds of frozen foam bodies (frozen foams), instead of the nozzles 345 and 355 for a foam body and the pouring members 360 and 370 of the eighth embodiment configured to pour the liquid foam body. The tap unit of the tenth embodiment is distinguished from the tap unit 330 of the eighth embodiment in that the foam body is the frozen foam body as described above, and other details are the same as above.

In the tenth embodiment, a plurality of kinds of frozen foam bodies are generated by the beverage vending apparatus main body, and the generated frozen foam bodies are poured into the beverage container A through the nozzle for a foam body. The tubular pouring member as described in the eighth embodiment or a linear pouring member according to the ninth embodiment is installed at the front end section of the nozzle for a foam body, and the flow path in the pouring member is curved along the horizontal plane. Accordingly, when the plurality of frozen foam bodies are poured from the nozzle for a foam body onto the beer liquid L poured into the beverage container A to generate a frozen foam body on the upper section of the beer liquid L, the frozen foam body is poured from the pouring member of the nozzle for a foam body along the liquid surface S. Accordingly, when the plurality of kinds of frozen foam bodies are poured, these frozen foam bodies are not easily mixed with the beer liquid L. Accordingly, the mixed state of the frozen foam bodies can be easily controlled, and in the tap unit, the server, the pouring member and the beverage of the tenth embodiment, favorability can be increased while improving a design characteristic, and the same effect as in the eighth embodiment is obtained.

Further, in the tenth embodiment, since the frozen foam body is poured along the liquid surface S, an impulsive force on the liquid surface S generated when the frozen foam body is poured from the nozzle for a foam body can be reduced, generation of the rough foam when the frozen foam body is poured can be suppressed, and generation of a situation in which the plurality of kinds of frozen foam bodies are irregularly agitated can be avoided. Accordingly, the plurality of kinds of frozen foam bodies can be beautifully poured onto the liquid surface S without being covered with the rough foam, and further, since the mixed state of the frozen foam bodies can be controlled, favorability can be increased while improving a design characteristic of the beverage.

(Eleventh Embodiment)

In an eleventh embodiment, the beverage poured from the tap unit will be described. The beverage of the eleventh embodiment is, for example, the beer as shown in (c) in FIG. 46, the beer liquid L is poured into the beverage container A, and the beer foam B is formed of the first and second beer foams B1 and B2 poured onto the beer liquid L. Here, the eleventh embodiment is distinguished from the eighth to tenth embodiments in that the beer liquid L and the beer foam B have different kinds of liquids, and for example, as shown in (d) in FIG. 61, the second layer R2 formed of the liquid obtained from the beer foam B is formed between the first layer R1 serving as the layer of the beer liquid L and the third layer R3 serving as the layer of the beer foam B.

The second layer R2 formed of the liquid obtained from the beer foam B is formed as the poured beer foam B is gradually varied to the liquid on the beer liquid L. Here, when the specific gravity of the type of liquid of the beer liquid L is lower than the specific gravity of the type of liquid that forms the beer foam B, since the beer foam B that becomes the liquid is likely to be diffused, while the second layer R2 is formed immediately after the pouring of the beer foam B, the second layer R2 does not easily thin as time elapses thereafter. Meanwhile, when the specific gravity of the type of liquid of the beer liquid L is higher than the specific gravity of the type of liquid that forms the beer foam B, since the beer foam B is not easily diffused into the beer liquid L even when the beer foam B becomes the liquid, the second layer R2 is more noticeably formed as time elapses. In addition, while the liquid obtained by liquefying the beer foam B sinks to a lower side of the beer foam B, a liquefaction rate of the beer foam B is small and a lowering speed of the beer foam B is also extremely small. For this reason, when the specific gravity of the beer liquid L is higher than the specific gravity of the beer foam B, the second layer R2 can be formed even when a difference between the specific gravity of the beer liquid L and the specific gravity of the beer foam B is extremely small. Meanwhile, when the specific gravity of the beer liquid L is lower than the specific gravity of the beer foam B, while the second layer R2 cannot be held for a long time, the second layer R2 can be formed immediately after the beer foam B is poured.

The beverage of the eleventh embodiment has a first layer R1 formed of the beer liquid L, a second layer R2 formed by liquefying the beer foam B, and a third layer R3 formed of the beer foam B. Accordingly, since a beautiful stripe pattern can be formed by the first layer R1 of the beer liquid L, the second layer R2 formed of the liquid obtained from the beer foam B and the third layer R3 of the beer foam B, the beverage in which contrast becomes clear to improve the appearance and a design characteristic is enhanced is provided.

In addition, the beverage of the eleventh embodiment can be manufactured as will be described below. First, the first beer foam B1 and the second beer foam B2 are poured onto the beer liquid L. Next, the beverage is left for a predetermined time. Then, the first beer foam B1 and the second beer foam B2 are liquefied, and a layer corresponding to the above-mentioned second layer R2 can be formed. Here, the standing time is preferably 20 seconds or more, more preferably 30 seconds or more, more preferably 1 minute or more, and most preferably 2 minutes or more. In this way, the beer foam B (the first and second beer foams B1 and B2) is liquefied by increasing the standing time, and the second layer R2 can be securely formed. In addition, the standing time may be 5 minutes or more. As the standing time is set as described above, the second layer R2 can be formed while the third layer R3 serving as the layer of the beer foam B remains.

In addition, the beverage container A having a small diameter at the height position of the second layer R2 may be used as the beverage container A. As the above-mentioned beverage container is used, the second layer R2 can thicken even when a liquefaction amount of the beer foam B is small, and further, the second layer R2 can be formed in a short time.

In addition, in the eleventh embodiment, when the beer foam B is poured using all of the tap unit, the server and the pouring member of the eighth to tenth embodiments, since the beer foam B is poured along the liquid surface S of the beer liquid L and the beer foam B is not easily mixed with the beer liquid L, contrast of the first layer R1, the second layer R2 and the third layer R3 can become clearer. Further, while the beverage of the eleventh embodiment can be realized even when a nozzle configured to pour the beer foam B in a downward direction is used, the beverage may be manufactured using the tap unit, the server and the pouring member of the eighth to tenth embodiments for the above-mentioned reason.

In addition, in the eleventh embodiment, as the liquid that constitutes the first layer R1, in addition to the beer liquid L, various kinds of liquids such as water, liqueurs, or the like, may be used, or a single kind of liquid may be used, and a mixed liquid of the plurality of kinds of liquids may be used. Further, in addition to the beer foam B, various kinds of foam bodies may be used as the foam body that constitutes the third layer R3.

(Twelfth Embodiment)

In a twelfth embodiment, for example, a guide section installed at the server 308 shown in FIG. 42 and configured to position the beverage container A at a predetermined position when the foam body is poured into the beverage container A will be described with reference to FIGS. 57 and 58.

Figure 57:
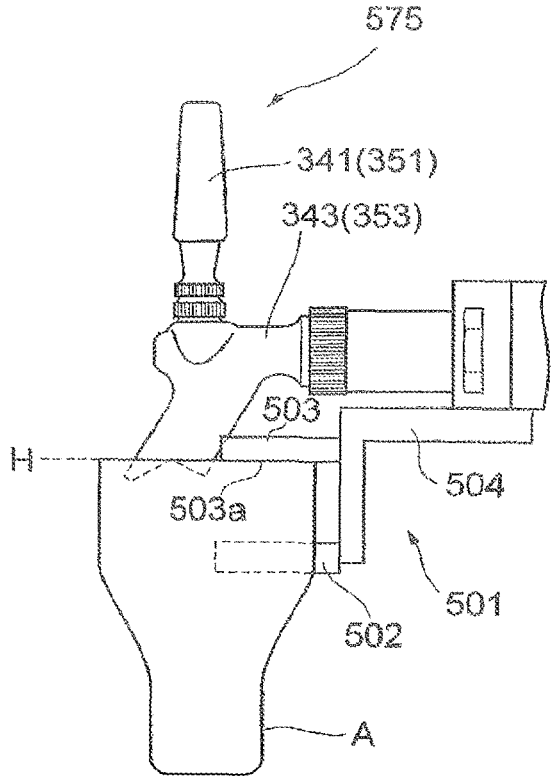
FIG. 57 shows a side view and plan views showing a guide section.
Figure 57:
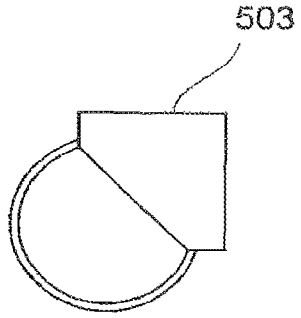
Figure 57:
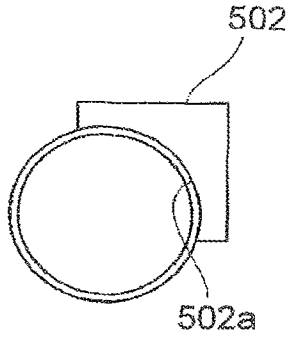

As shown in (a) in FIG. 57, each tap of a tap unit 575 including a guide section 501 includes a lever 341 (351) and a tap main body 343 (353), like the eighth embodiment. The guide section 501 includes a support member 504 supported at a lower section of the tap main body 343 (353), extending toward the front side and folded downward at the end section of the front side, a height position adjustment member 503 extending from the support member 504 toward the front side and configured to adjust a height of the beverage container A to the predetermined height H or less, and a horizontal position adjustment member 502 extending from the lower end of the support member 504 toward the front side and configured to adjust a position in the horizontal direction of the beverage container A.

As shown in (b) and (c) in FIG. 57, the horizontal position adjustment member 502 has a curved section 502*a* formed along the outer circumference of the beverage container A when seen in a plan view, and fixes a position in the horizontal direction of the beverage container A by pushing the outer circumference of the beverage container A against the curved section 502*a*. The height position adjustment member 503 has an abutting section 503*a* formed at a lower surface thereof that the beverage container A abuts when the beverage container A is moved upward in a state in which the outer circumference of the beverage container A is pushed against the curved section 502*a* of the horizontal position adjustment member 502 as described above. As the beverage container A abuts the abutting section 503*a* of the height position adjustment member 503, a height position of the beverage container A is fixed.

Figure 58:
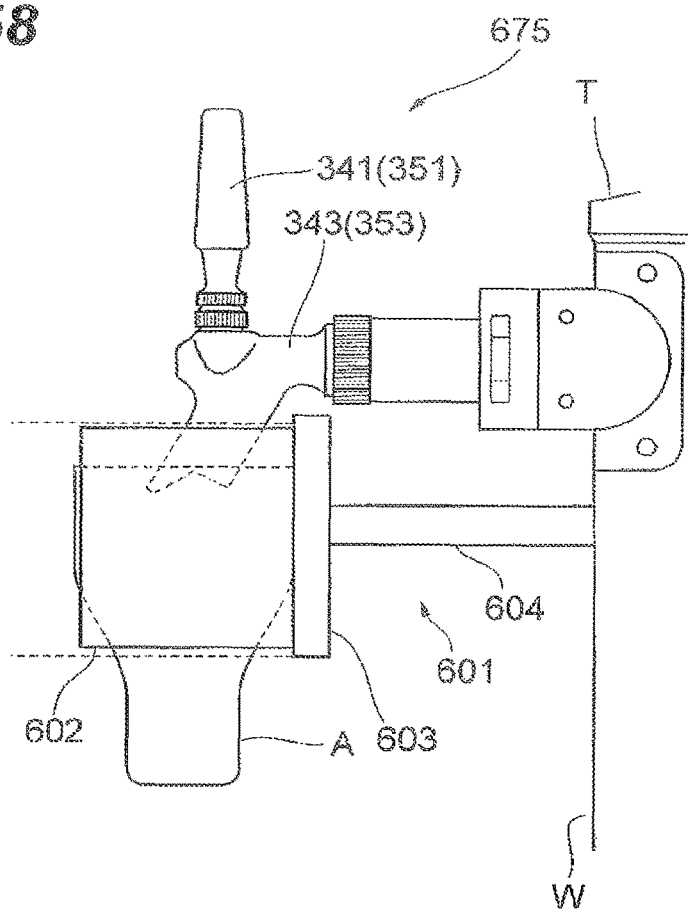
FIG. 58 is a side view and a plan view of a guide section.
Figure 58:
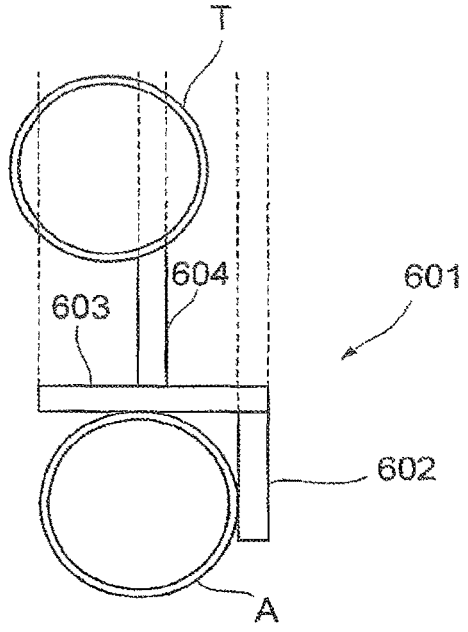

In addition, as shown in FIG. 58, in a tap unit 675 including a guide section 601 in a tower type server having a tower T, the guide section 601 includes an extension section 604 extending from the front sidewall section W of the tower T toward the front side, a flat plate-shaped first position adjustment member (a horizontal position adjustment member) 603 attached to the end section of the front side of the extension section 604, and a flat plate-shaped second position adjustment member (a horizontal position adjustment member) 602 extending from one end of the first position adjustment member 603 further toward the front side. As shown in (b) in FIG. 58, a position in forward and rearward directions of the beverage container A is fixed by pushing the beverage container A against the first position adjustment member 603, and a position in the leftward and rightward directions of the beverage container A is fixed by pushing the beverage container A against the second position adjustment member 602. Further, the tap unit 675 shown in FIG. 58 may also be used with respect to a server, other than the tower type server.

As described above, the guide section 601 includes the position adjustment members 602 and 603 configured to position the beverage container A at a predetermined position with respect to each tap of the tap unit 675 configured to pour the beer foam B1 and B2 onto the beer liquid L, and adjust a horizontal position of the beverage container A with respect to each tap of the tap unit 675. Accordingly, the horizontal position of the beverage container A can be disposed at an optimal position when the beer foam B1 and B2 are poured. Accordingly, the pouring of the beer foam B1 and B2 can be smoothly performed, and the flow of the beer foam B1 and B2 with respect to the beverage container A can always be constant.

In addition, the above-mentioned guide section 501 shown in FIG. 57 includes, in addition to the horizontal position adjustment member 502, the height position adjustment member 503 configured to adjust a height position of the beverage container A with respect to each tap of the tap unit 575. Accordingly, since the height position of the beverage container A can be disposed at an optimal position upon the pouring of the beer foam B1 and B2, the pouring of the beer foam B1 and B2 can be more smoothly performed, and a difference in elevation between the tap of the tap unit 575 and the beverage container A can always be constant.

In addition, as guide sections 501 and 601 come in contact with at least a portion of an end of the beverage container A using the guide section 501 or the guide section 601, a position of the beverage container A with respect to at least one of the nozzle for a foam body and the pouring member can be fixed. A position of the beverage container A fixed as described above may be a position at which the beer foams B1 and B2 can be prevented from being scattered to the outside of the beverage container A when the beer foams B1 and B2 are poured into the beverage container A. As the guide section is provided as described above, since the beverage container A can be disposed at an optimal position upon the pouring of the beer foams B1 and B2, the beer foams B1 and B2 can be beautifully formed with a simple manipulation.

While preferable embodiments of the present invention have been described above, the present invention is not limited to the embodiments. That is, the tap unit, the server, the pouring member, the guide section and the beverage according to the present invention may be modified from the tap units, the servers, the pouring members, the guide sections and the beverages according to the embodiments or may be applied to other matters without departing from the spirit disclosed in the claims.

Figure 52:
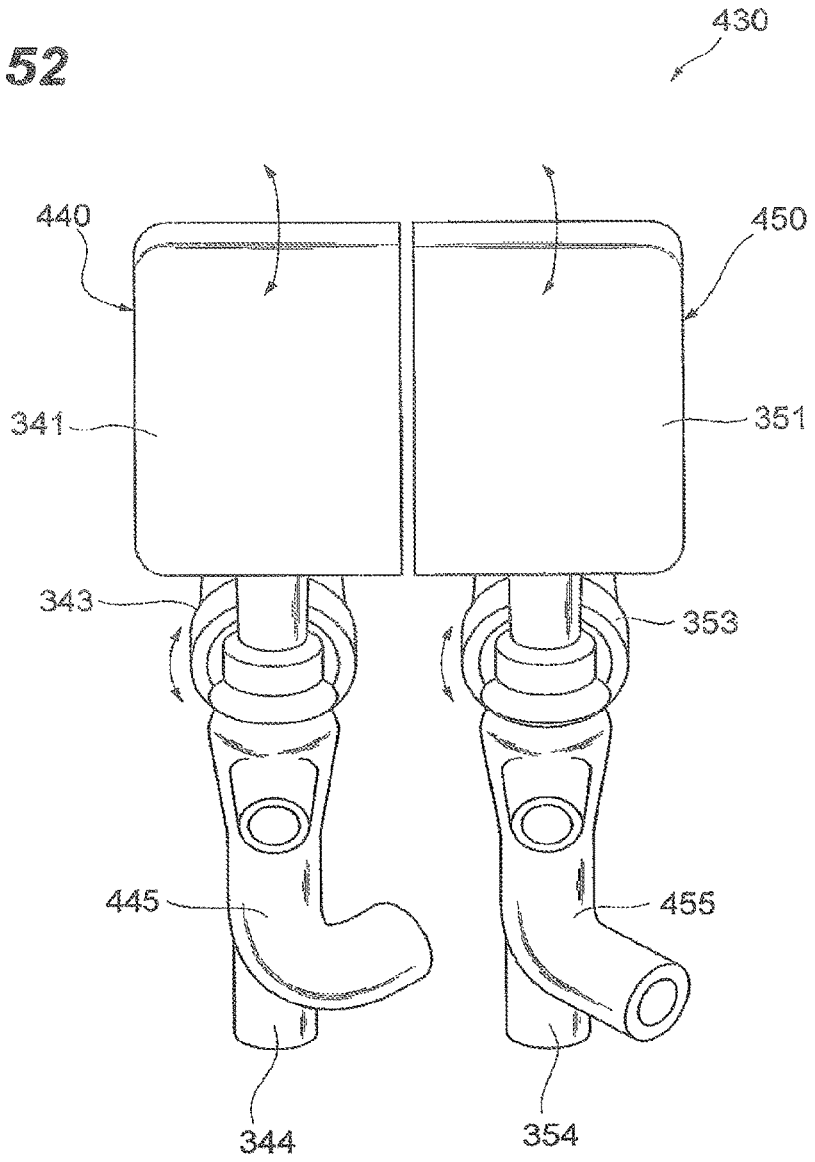
FIG. 52 is a perspective view showing a tap unit according to a variant.

For example, as shown in FIG. 52, instead of the tap including the above-mentioned nozzle for a foam body and pouring member, taps 440 and 450 including nozzles 445 and 455 for a foam body in which front end sections of flow paths through which a foam body flows are curved can be used without installing the pouring member. In a tap unit 430 including the taps 440 and 450 according to the variant, the front end sections of the nozzles 445 and 455 for a foam body of the taps 440 and 450 are curved along the liquid surface, i.e., to form an angle of 0° or more and 45° or less upward and downward with respect to the horizontal direction. Accordingly, the same effect as with the tap unit of the embodiment is obtained.

Figure 53:
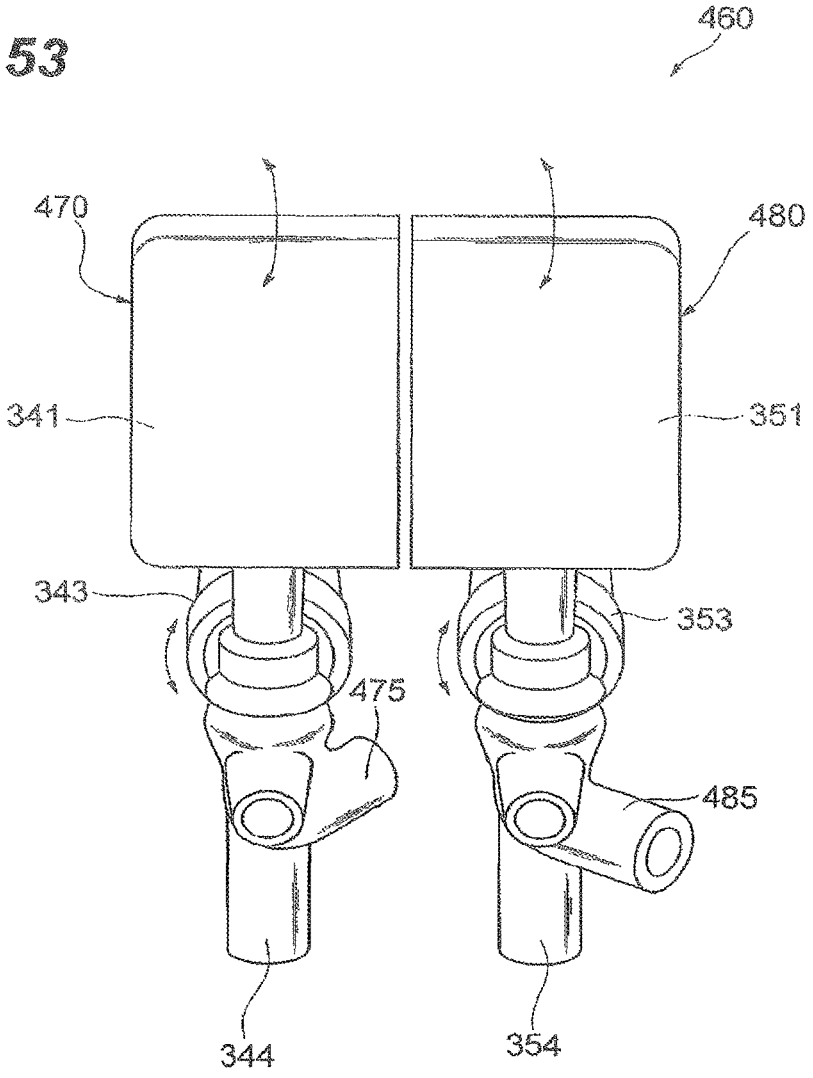
FIG. 53 is a perspective view showing a tap unit according to a variant.

In addition, as shown in FIG. 53, instead of the tap including the above-mentioned nozzle for a foam body and pouring member, without installing the pouring member, taps 470 and 480 including nozzles 475 and 485 for a foam body extending such that flow paths are formed along the liquid surface can be used. In a tap unit 460 including the taps 470 and 480 according to the variant, the nozzles 475 and 485 for a foam body are formed along the liquid surface. That is, since the flow paths in the nozzles 475 and 485 for a foam body are oriented in a direction that forms an angle of 0° or more and 45° or less upward and downward with respect to the horizontal direction, the same effect as in the embodiment is obtained.

Further, a foam splash prevention section configured to prevent the beer foams B1 and B2 from being scattered may be provided. The foam splash prevention section will be described below with reference to FIGS. 59 and 60.

Figure 59:
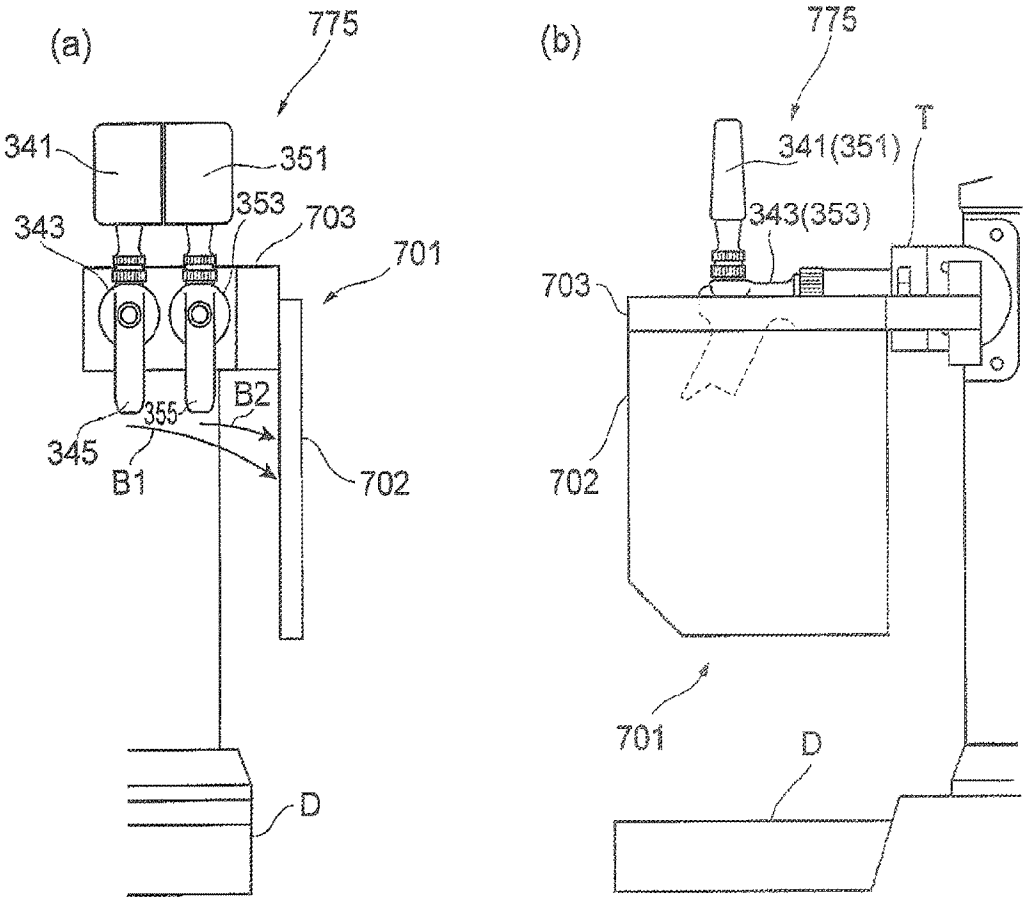
FIG. 59 is a side view showing a foam splash prevention guide.

As shown in FIG. 59, in a tap unit 775 including a foam splash prevention section 701, the foam splash prevention section 701 includes a support member 703 attached to a position adjacent to the tap main body 353, and a flat plate-shaped foam receiving section 702 fixed to the support member 703 and extending downward from the support member 703 toward the front side. As shown in (a) in FIG. 59, the beer foams B1 and B2 scattered upon the pouring are scattered toward the inner side surface of the foam receiving section 702, and the beer foams B1 and B2 scattered to the inner side surface of the foam receiving section 702 drop to the receptacle D.

Figure 60:
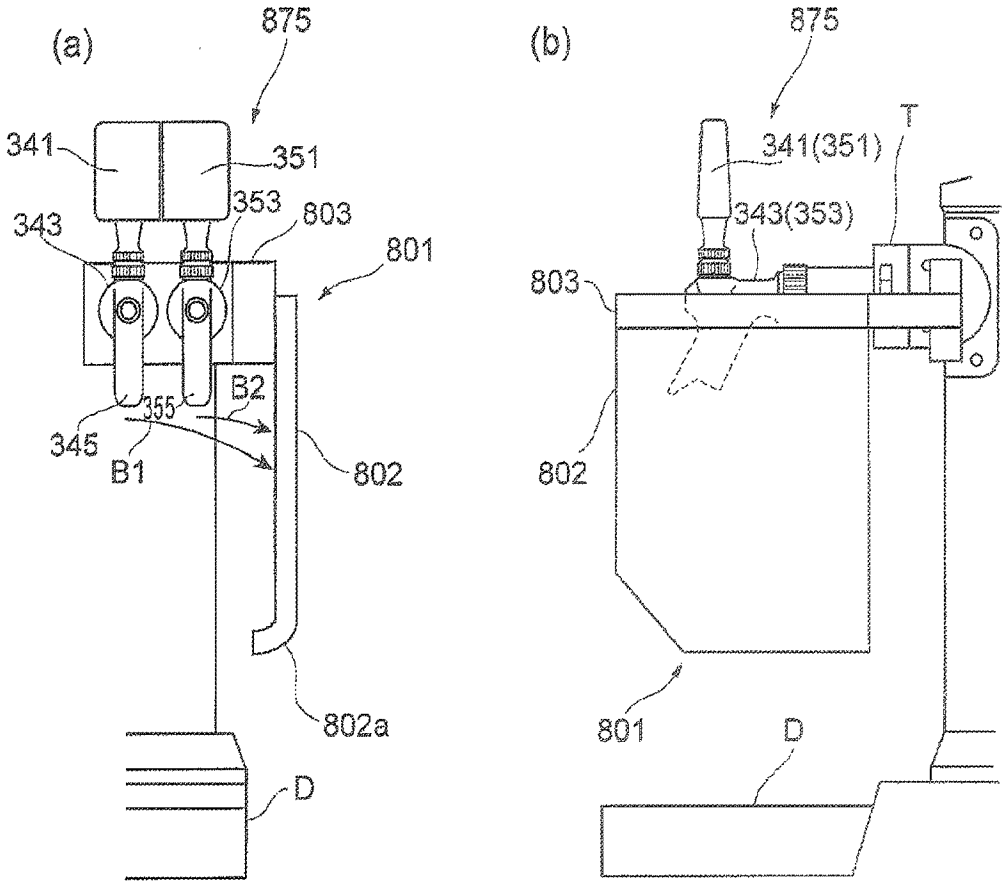
FIG. 60 is a side view showing a foam splash prevention guide.

In addition, in a tap unit 875 including a foam splash prevention section 801 shown in FIG. 60, the foam splash prevention section 801 includes a support member 803 and a foam receiving section 802 that are similar to the foam splash prevention section 701, and a curved section 802*a* that is curved inward is formed at a lower end of the foam receiving section 802. As the above-mentioned curved section 802*a* is provided at the lower end of the foam receiving section 802, the beer foams B1 and B2 scattered to the inner side surface of the foam receiving section 802 can be more easily guided to the receptacle D.

As the above-mentioned the foam splash prevention section 701 or the foam splash prevention section 801 is provided, the beer foams B1 and B2 can be prevented from being scattered to the outside of the apparatus upon the pouring. Further, in the foam splash prevention section 701 shown in FIG. 59, while the flat plate-shaped foam receiving section 702 extends downward from the support member 703 adjacent to the tap main body 353, instead of the foam receiving section 702, a foam receiving section fixed to the receptacle D and extending upward from the receptacle D may be used. As the foam receiving section extending upward from the receptacle D is provided, the beer foams B1 and B2 can be securely guided to the receptacle D even when the beer foams B1 and B2 drop further downward.

In addition, as shown in FIGS. 48 and 49, the pouring members 400 and 410 detachably attached to the nozzles 345 and 355 for a foam body may have a positioning means configured to orient outlet ports of the pouring members 400 and 410 to desired positions when attached to the front end sections of the nozzles 345 and 355 for a foam body. For example, the positioning means may be configured using a non-circular fitting structure of the pouring members 400 and 410 and the nozzles 345 and 355 for a foam body such that a direction of the outlet port is necessarily determined when the pouring members 400 and 410 are fitted into the nozzles 345 and 355 for a foam body. In addition, the positioning means may be marks attached to the pouring members 400 and 410 and the nozzles 345 and 355 for a foam body, and in this case, the direction of the outlet port is automatically determined as the marks of the pouring members 400 and 410 are matched to the marks of the nozzles 345 and 355 for a foam body. As the above-mentioned positioning means is provided, since the pouring directions of the beer foams B1 and B2 are necessarily determined by only attaching the pouring members 400 and 410 to the taps 380 and 390, a configuration for beautifully pouring the beer foams B1 and B2 can be easily realized.

In addition, in the embodiment, the tap unit 330 including the nozzle 345 for a foam body configured to pour the first beer foam B1 and the nozzle 355 for a foam body configured to pour the second beer foam B2, and configured to pour two kinds of liquids has been described. However, the present invention may be applied to a tap unit configured to pour three or more kinds of liquids.

In addition, although an example in which the tap 340 includes both of the nozzle 344 for a liquid and the nozzle 345 for a foam body has been described in the embodiment, the nozzle 344 for a liquid may not be provided.

In addition, while the example in which the pouring members 400 and 410 formed in the linear shapes extending downward are detachably attached to the nozzles 345 and 355 for a foam body has been described in the embodiment, the tubular pouring members 360 and 370 may be detachably attached to the nozzles 345 and 355 for a foam body. In addition, the pouring members 400 and 410 of the ninth embodiment may not be detachably attached.

In addition, while the example in which the tap is installed in the beverage vending apparatus 301 has been described in the embodiment, the apparatus configuration of the beverage vending apparatus 301 is not limited to the embodiment but may be appropriately varied.

In addition, while the example in which the tap unit 330 is installed at the beverage vending apparatus 301 for providing the beer has been described in the embodiment, the tap unit of the present invention may also be applied to a beverage vending apparatus for providing a beverage other than beer.

In addition, while two nozzles for a foam body are installed in the embodiment, three or more nozzles for a foam body may be installed. In addition, the heights of the front end sections of the plurality of nozzles may be equal to each other or may be different from each other. However, when the two or more kinds of liquids having different specific gravities are poured from above the beverage container, the nozzle configured to pour the liquid having a lower specific gravity may be higher than the nozzle configured to pour the liquid having a higher specific gravity. In this way, as the front end section of the nozzle configured to pour the liquid having a lower specific gravity is disposed higher, a force corresponding to the difference in elevation is applied when the liquid having a lower specific gravity is poured, and a magnitude of the force when the liquid having the lower specific gravity is poured is substantially equal to a magnitude of the force when the liquid having the higher specific gravity is poured. Accordingly, when the liquids having different specific gravities are poured, since the liquid having the lower specific gravity does not easily float on the liquid having the higher specific gravity, a more beautiful spiral shape or marble shape can be formed by the plurality of liquids having different specific gravities.

In addition, in the embodiment, the beverage formed in a spiral shape or a marble shape obtained as the directions of the first beer foam B1 and the second beer foam B2 poured by the nozzle for a foam body are designed has been described. Hereinafter, for example, the condition in which the beautiful spiral shape is formed using the pouring members 400 and 410 (see FIGS. 48 to 50) of the ninth embodiment will be described.

Figure 63:
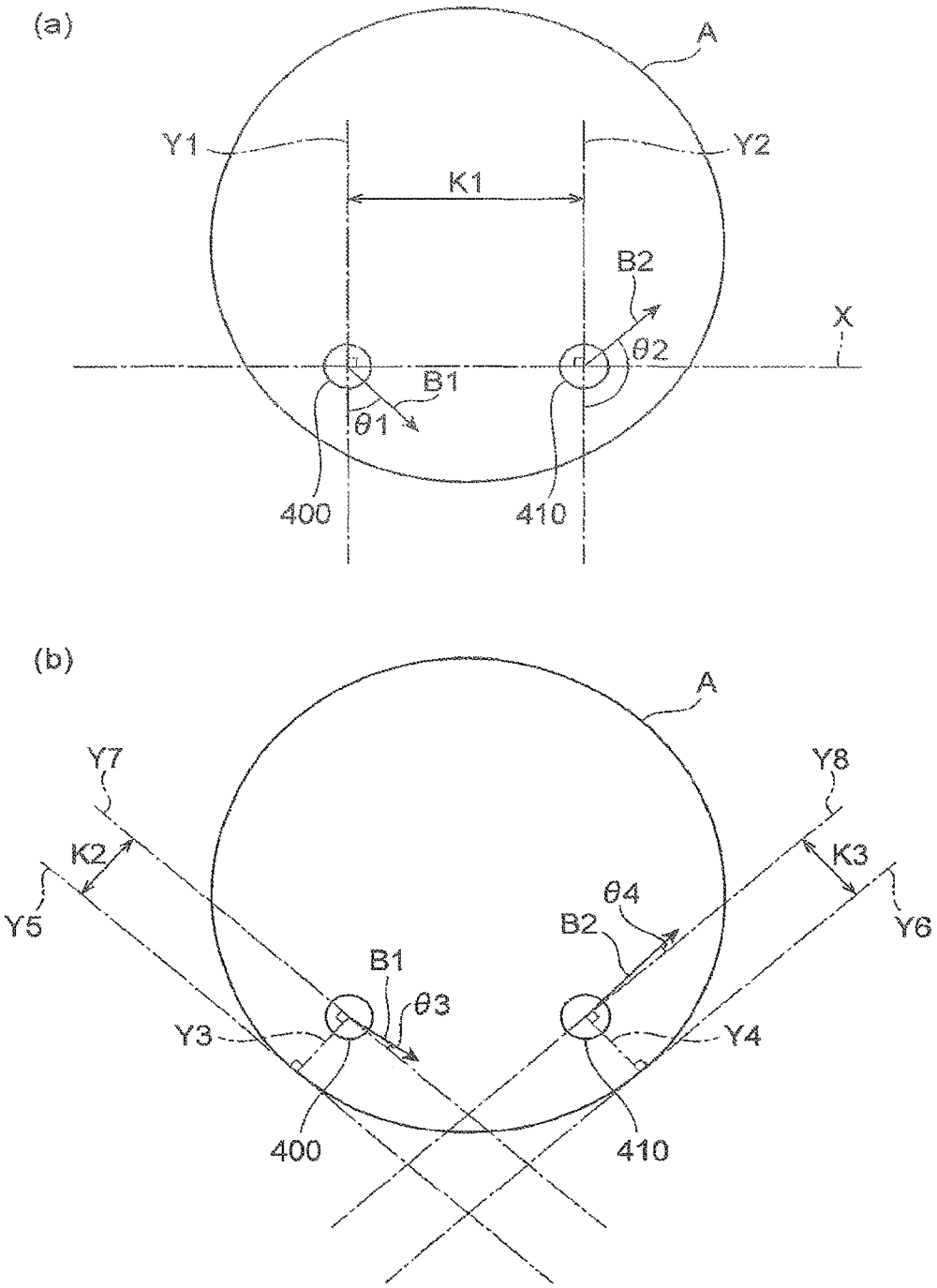
FIG. 63 is a plan view showing a position relation of a pouring member in a beverage container.

(a) and (b) in FIG. 63 are plan views showing a position relation between the pouring members in the beverage container. Here, the outlet port through which the first beer foam B1 is discharged is disposed at a center of the pouring member 400. In addition, the outlet port through which the second beer foam B1 is discharged is disposed at a center of the pouring member 410.

First, as shown in (a) in FIG. 63, when seen in a plan view, the straight line X that connects the outlet port of the first beer foam B1 and the outlet port of the second beer foam B2, the straight line Y1 perpendicular to the straight line X and passing through the outlet port of the first beer foam B1, and the straight line Y2 perpendicular to the straight line X and passing through the outlet port of the second beer foam B2 are fixed, an angle between the pouring direction of the first beer foam B1 and the straight line Y1 when seen in a plan view is referred to as θ1, and an angle between the pouring direction of the second beer foam B2 and the straight line Y2 when seen in a plan view is referred to as θ2. Here, the pouring direction of the first beer foam B1 and the pouring direction of the second beer foam B2 are directions shown by arrows in (a) in FIG. 63. In addition, θ1 is an angle of the outlet port side of the beer foam B2 with respect to the straight line Y1. Here, the straight line Y1 extends from the outlet port of the beer foam B1 toward the beverage container A close to the outlet port of the beer foam B1. θ2 is an angle of an opposite side of the outlet port of the beer foam B1 with respect to the straight line Y2. Here, the straight line Y2 extends from the outlet port of the beer foam B2 toward the beverage container A close to the outlet port of the beer foam B2.

Here, θ1 is preferably within a range of 45±20 (°), and in order to form a more beautiful vortex shape, θ1 is preferably within a range of 45±10 (°). Further, in order to securely form the more beautiful vortex shape, θ1 is preferably within a range of 45±5 (°). In addition, θ2 is preferably within a range of 130±20 (°), and in order to form a more beautiful vortex shape, θ2 is preferably within a range of 130±10 (°). Further, in order to securely form the more beautiful vortex shape, θ2 may be within a range of 130±5 (°).

In addition, as shown in (b) in FIG. 63, when seen in a plan view, the line segment Y3 that connects the outlet port of the first beer foam B1 and the wall section of the beverage container A closest to the outlet port of the first beer foam B1, the line segment Y4 that connects the outlet port of the second beer foam B2 and the wall section of the beverage container A closest to the outlet port of the second beer foam B2, the straight line Y5 serving as a tangential line of the beverage container A in the wall section of the beverage container A closest to the outlet port of the first beer foam B1, the straight line Y6 serving as a tangential line of the beverage container A in the wall section of the beverage container A closest to the outlet port of the second beer foam B2, the straight line Y7 parallel to the straight line Y5 and passing through the outlet port of the first beer foam B1, and the straight line Y8 parallel to the straight line Y6 and passing through the outlet port of the second beer foam B2 are fixed. Here, the pouring direction of the first beer foam B1 and the pouring direction of the second beer foam B2 are directions shown by arrows in (b) in FIG. 63. In addition, an angle of the pouring direction of the first beer foam B1 with respect to the straight line Y7 is referred to as θ3, and an angle of the pouring direction of the second beer foam B2 with respect to the straight line Y8 is referred to as θ4.

Here, θ3 is preferably within a range of 0±20(°), and in order to form a more beautiful vortex shape, θ3 is more preferably within a range of 0±10(°). Further, in order to securely form the more beautiful vortex shape, θ3 is preferably within a range of 0±5(°). In addition, θ4 is preferably within a range of 0±20(°), and in order to form a more beautiful vortex shape, θ4 is preferably within a range of 0±10(°). Further, in order to securely form the more beautiful vortex shape, θ4 is preferably within a range of 0±5(°). Further, a state in which θ3 is 0(°) is a state in which the pouring direction of the first beer foam B1 is parallel to the straight line Y5. In addition, a state in which θ4 is 0(°) is a state in which the pouring direction of the second beer foam B2 is parallel to the straight line Y6. In addition, a state in which θ3 is 0+y(°) is a state in which the pouring direction of the first beer foam B1 is deviated from the straight lines Y7 and Y8 toward opposite sides of the straight lines Y5 and Y6 by y (°). In addition, a state in which θ4 is 0−y(°) is a state in which the pouring direction of the second beer foam B2 is deviated from the straight lines Y7 and Y8 toward the straight lines Y5 and Y6 by y(°). In (b) in FIG. 63, θ3 and θ4 show states in which slightly deviated from 0(°) toward a + side.

In addition, each of the distance K2 between the outlet port of the first beer foam B1 and the wall section of the beverage container A closest to the outlet port of the first beer foam B1 (a length of the line segment Y3/a distance between the straight line Y5 and the straight line Y7) and the distance K3 between the outlet port of the second beer foam B2 and the wall section of the beverage container A closest to the outlet port of the second beer foam B2 (a length of the line segment Y4/a distance between the straight line Y6 and the straight line Y8) is preferably about 2 mm. Further, the beverage container A may be formed in a circular shape when seen in a plan view, and a hole diameter of the beverage container A may be 60 mm or more and 100 mm or less. Then, in this case, the distance K1 between the straight line Y1 and the straight line Y2 (the distance between the nozzles) is preferably 30 mm or more and 50 mm or less.

(Fifth Example)

Next, a fifth example of the tap unit 375 including the pouring member 400 (410) of the ninth embodiment will be described with reference to FIGS. 54 to 56. Further, the present invention is not limited to the following fifth example. In the experiment of the fifth example, the lever 341 (351) was pulled down to pour the beer foam B for 5 seconds in a state in which water M was poured into the beverage container A to a level of 25 mm, and a relation between the pouring angle of the beer foam B with respect to the liquid surface S of the water M of the beverage container A and the state of the beer foam B was verified. In addition, a half pint glass having a hole diameter of about 77 mm was used as the beverage container A. Then, a diameter of the outlet port 403*d* (see FIG. 49) of the pouring member 400 (410) was 5 mm, a distance between the outlet port 403*d* and the liquid surface S of the water M was 15 mm, a temperature of the beer barrel was 20° C., and a gas pressure was 0.25 MPa.

Figure 54:
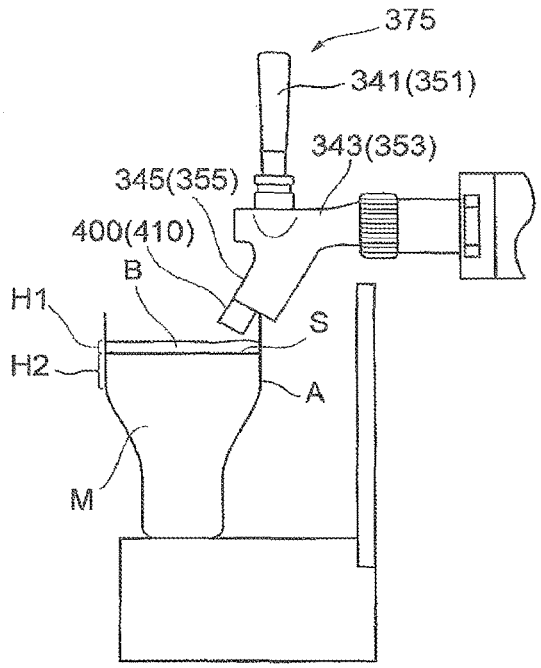
FIG. 54 is a view showing a condition of an experiment performed using the tap unit of FIG. 48.

In the experiment, as shown in (a) in FIG. 54, the case in which the beer foam B was poured in a downward direction with respect to the liquid surface S by X° was referred to as X°, and the case in which the beer foam B was poured in an upward direction with respect to the liquid surface S by X° was referred to as −X°. Then, the case in which the pouring angle of the beer foam B with respect to the liquid surface S was 0° was referred to as example 8, the case of 15° was referred to as example 9, the case of 30° was referred to as example 10, the case of 45° was referred to as example 11, the case of −15° was referred to as example 12, the case of −30° was example 13, the case of −45° was referred to as example 14, the case of 60° was referred to as comparative example 3, and the case of −60° was referred to as comparative example 4. Further, in examples 13 and 14 and comparative example 4 of −30°, −45° and −60°, since the beer foam B was prevented from being scattered to the outside, the experiment in which the pouring member 400 (410) was extracted to the outside of the beverage container A to deviate the outlet port 403*d* to the outside of the beverage container A by about 10 mm and a distance between the liquid surface S and the outlet port 403*d* is 35 mm was performed.

In the experiment, as shown in (b) in FIG. 54, the foam height H1 5 seconds after the beginning of the pouring onto the liquid surface S of the beer foam B when the beer foam B was poured onto the liquid surface S and the foam depth H2 immediately after the beginning of the pouring in the lower section of the liquid surface S were measured. In general, the foam height H1 is larger than the foam depth H2 when an impulsive force of the beer foam B on the liquid surface S of the beer liquid L is small, and the foam depth H2 is larger than the foam height H1 when the impulsive force is large.

Figure 55:
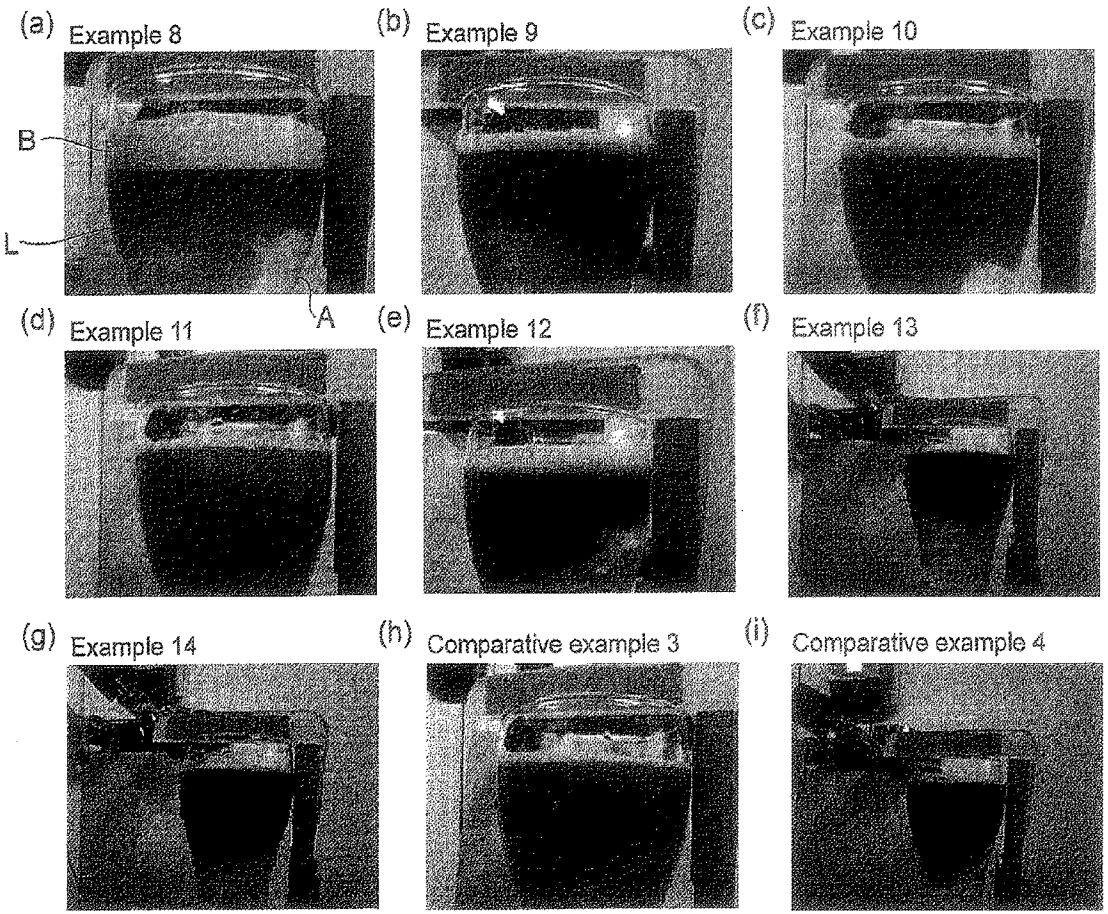
FIG. 55 is a view showing a beer liquid and a foam body in the experiment of FIG. 54.

(a) in FIG. 55 is a photograph of example 8, (b) in FIG. 55 is a photograph of example 9, (c) in FIG. 55 is a photograph of example 10, (d) in FIG. 55 is a photograph of example 11, (e) in FIG. 55 is a photograph of example 12, (f) in FIG. 55 is a photograph of example 13, (g) in FIG. 55 is a photograph of example 14, (h) in FIG. 55 is a photograph of comparative example 3, and (i) in FIG. 55 is a photograph of comparative example 4, after the pouring of the beer foam B. As shown in Figs. (a) to (i) in FIG. 55, the foam height H1 is greatest in example 8 in which the pouring angle was 0°, followed by examples 12, 9, 10 and 13 in order, and least in examples 11 and 14 and comparative examples 3 and 4.

Figure 56:
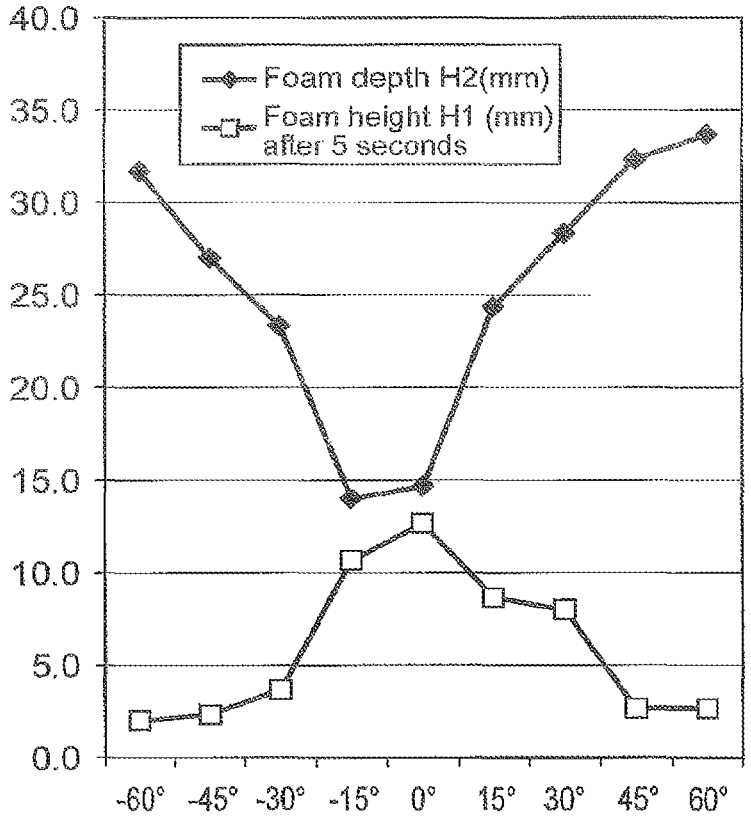
FIG. 56 is a graph showing a foam depth and a foam height of the foam body in the experiment of FIG. 54.

Specifically, as shown in the graph of FIG. 56 and Table 4, values of the foam height H1 and the foam depth H2 are as follows.

TABLE 4

| | Foam height after 5 seconds H1(mm) | Foam depth H2 (mm) |
|---|---|---|
| Example 8 (0°) | 12.7 | 14.7 |
| Example 9 (15°) | 8.7 | 24.3 |
| Example 10 (30°) | 8.0 | 28.3 |
| Example 11 (45°) | 2.7 | 32.3 |
| Example 12 (−15°) | 10.7 | 14.0 |
| Example 13 (−30°) | 3.7 | 23.3 |
| Example 14 (−45°) | 2.3 | 27.0 |
| Comparative example 3 (60°) | 2.7 | 33.7 |
| Comparative example 4 (−60°) | 2.0 | 31.7 |

In this way, in the case of example 11 in which the pouring angle was 45°, the value of the foam depth H2 can be reduced in comparison with the case of the comparative example 3 in which the pouring angle of the beer foam B was 60°, and in the case of example 14 in which the pouring angle was −45°, the value of the foam depth H2 can also be reduced in comparison with the case of the comparative example 4 in which the pouring angle was −60°. Accordingly, the foam is considered not to be easily mixed with the liquid when the pouring angle of the beer foam B is between −45° and 45°.

Then, in the case of example 10 in which the pouring angle was 30° and the case of example 13 in which the pouring angle was −30°, the value of the foam depth H2 is further reduced and the value of the foam height H1 is increased in comparison with examples 11 and 14, and in the case of example 9 in which the pouring angle was 15° and the case of example 12 in which the pouring angle was −15°, the value of the foam depth H2 is further reduced and the value of the foam height H1 is further increased. Accordingly, it was seen that an effect of preventing the foam from being easily mixed with the liquid is exhibited when the pouring angle of the beer foam B is −30° to 30° and the effect is more remarkably exhibited when the pouring angle is −15° to 15°.

Further, in example 8 in which the pouring angle of the beer foam B was 0°, since the value of the foam height H1 is greatest, it was seen that the effect of preventing the foam from mixing and the effect of improving a design characteristic of the foam can be further increased.

(Sixth Example)

Next, a sixth example in which the beverage of the eleventh embodiment is generated will be described with reference to FIGS. 61 and 62. The present invention is not limited to the following sixth example. In the sixth example, experiment 3 and experiment 4 using the black liquid E1 shown in FIG. 61, the gold liquid E2 having a lower specific gravity than the liquid E1 shown in FIG. 62, and the foam body F formed of a mixed liquid of the liquid E1 and the liquid E2 were performed. Further, the specific gravity of the black liquid E1 was also higher than the specific gravity of the gold liquid E2, and a difference between the specific gravity of the black liquid E1 and the specific gravity of the gold liquid E2 was less than 0.01. In addition, a dark beer was used as the liquid E1, and a light beer such as Pilsner beer was used as the liquid E2.

Figure 61:
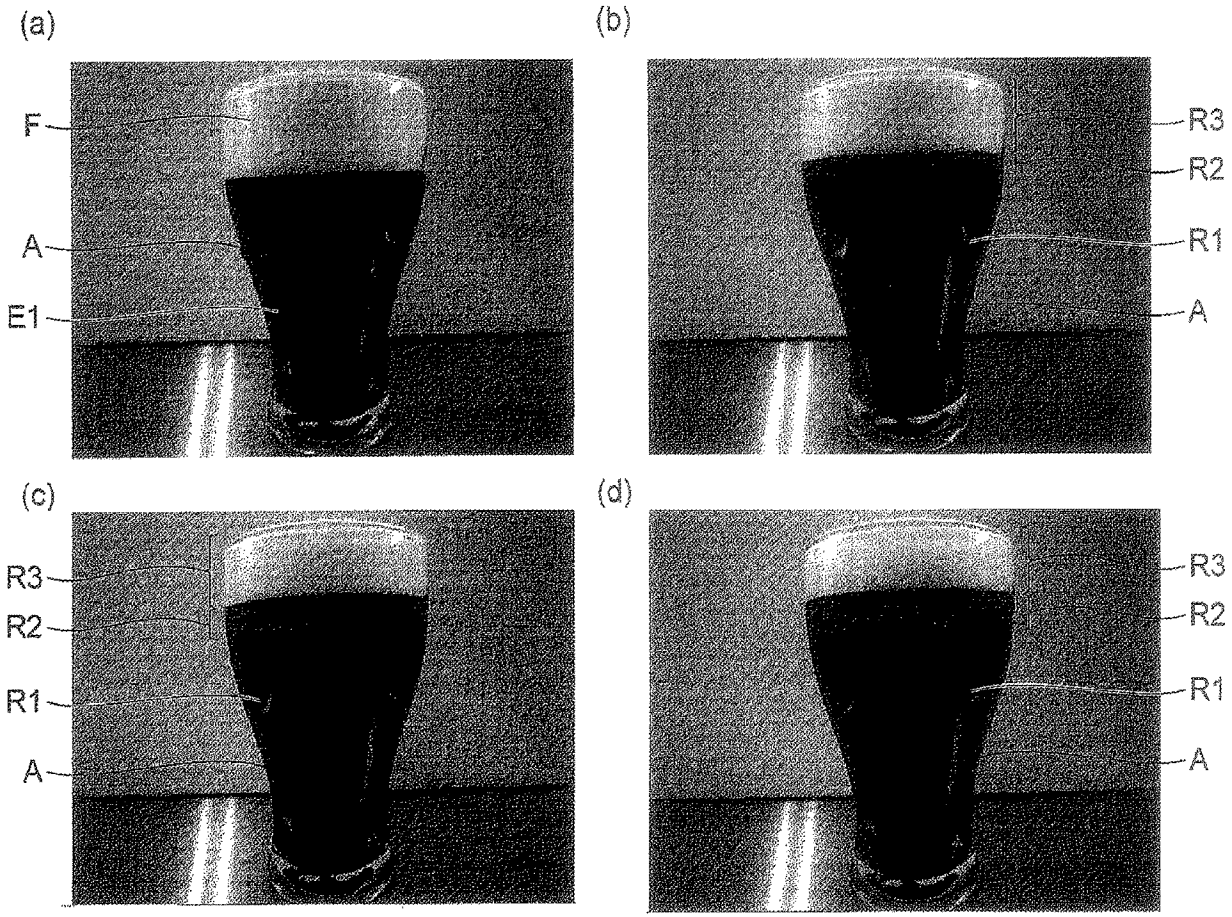
FIG. 61 is a view showing state transition after a foam body is poured on a liquid.

In experiment 3, as shown in FIG. 61, the foam body F formed of the mixed liquid was poured onto the black liquid E1 in the beverage container A, and then the situation in the beverage container A was observed. (a) in FIG. 61 shows a situation in the beverage container A immediately after the foam body F was poured, (b) in FIG. 61 shows a situation 30 seconds after the pouring of the foam body F, (c) in FIG. 61 shows a situation 1 minute after the pouring of the foam body F, and (d) in FIG. 61 shows a situation 2 minutes after the pouring of the foam body F.

As shown in (b) to (d) in FIG. 61, when 30 seconds or more elapsed from the pouring of the foam body F, the first layer R1 formed of the liquid E1, the second layer R2 formed of the liquid obtained from the foam body F, and the third layer R3 formed of the foam body F were formed in the beverage container A. In addition, as the foam body F was liquefied according to the lapse of time from the pouring of the foam body F, the thickness of the second layer R2 increased while the thickness of the third layer R3 decreased.

Figure 62:
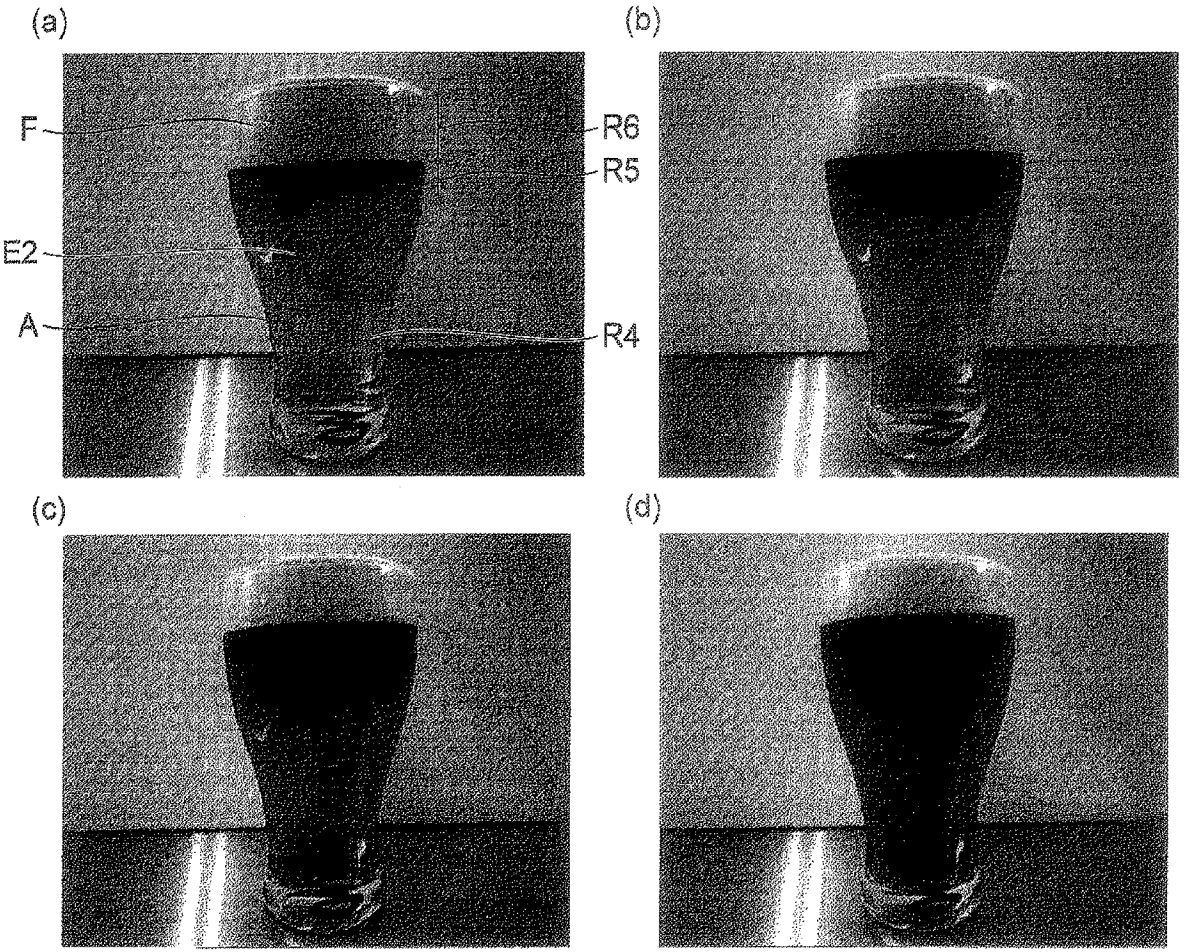
FIG. 62 is a view showing state transition after the foam body is poured on the liquid.

In experiment 4, as shown in FIG. 62, the foam body F generated from the mixed liquid was poured onto the gold liquid E2 in the beverage container A, and then a situation in the beverage container A was observed. (a) in FIG. 62 shows a situation in the beverage container A immediately after the foam body F was poured, (b) in FIG. 62 shows a situation 30 seconds after the pouring of the foam body F, (c) in FIG. 62 shows a situation 1 minute after the pouring of the foam body F, and (d) in FIG. 62 shows a situation 2 minutes after the pouring of the foam body F.

As shown in (a) in FIG. 62, in experiment 4, immediately after the pouring of the foam body F, the first layer R4 formed of the liquid E2, the second layer R5 formed of the liquid obtained from the foam body F and the third layer R6 formed of the foam body F were formed in the beverage container A. Then, the second layer R5 was diffused in an aurora shape according to the lapse of time, and the second layer R5 was not seen after 2 minutes had elapsed from the pouring of the foam body F as shown in (d) in FIG. 62.

As described above, in the sixth example, it was confirmed that the first layers R1 and R4 formed of the liquids E1 and E2, the second layers R2 and R5 formed of the liquid obtained from the foam body F, and the third layer formed of the foam body F are formed.

Then, in experiment 3 in which the foam body F formed of the mixed liquid was poured onto the liquid E1 having a higher specific gravity than the mixed liquid of the liquid E1 and the liquid E2, it was seen that the second layers R2 and R5 are formed according to the lapse of time as shown in FIG. 61 and a beautiful stripe pattern is formed. In addition, in experiment 3, it is considered that, as the foam body F is liquefied according to the lapse of time from the pouring of the foam body F, while the thickness of the third layer R3 is reduced and the thickness of the second layer R2 is increased, when the beverage is to be provided after completely making the second layer R2, if the foam body F is further poured onto the third layer R3 after the thickness of the second layer R2 is increased as 2 minutes elapses from the pouring of the foam body F, the beverage in which both of the second layer R2 and the third layer R3 are thickened can be provided.

Meanwhile, in experiment 4 in which the foam body F formed of the mixed liquid was poured onto the liquid E2 having a lower specific gravity than the mixed liquid of the liquid E1 and the liquid E2, it was seen that the second layer R5 is formed immediately after the pouring of the foam body F as shown in FIG. 62, and then the second layer R2 is not seen according to the lapse of time. Accordingly, it is considered that, when the beverage can be provided immediately after reception of an order or when the beverage is provided in a store with relatively good illumination, since the second layer R5 is beautifully formed, the beverage having a good design characteristic and high favorability can be provided.

While some or all of the above-mentioned embodiments and examples can be represented by (Supplementary note 1) to (Supplementary note 38) that are described below, the embodiments and examples are not limited to the following disclosure.

(Supplementary Note 1)

A tap configured to pour a foam body of a beverage onto a liquid, the tap having a flow path through which the foam body flows, wherein a front end section of the flow path is curved along a liquid surface of the liquid.

(Supplementary Note 2)

The tap according to Supplementary note 1, wherein the front end section of the flow path is curved to form an angle of 0° or more and 45° or less upward and downward with respect to the liquid surface of the liquid.

(Supplementary Note 3)

A tap configured to pour a foam body of a beverage onto a liquid, the tap having a flow path through which the foam body flows, wherein the flow path is formed such that a pouring angle of the foam body is an angle of 0° or more and 45° or less upward and downward with respect to a liquid surface of the liquid.

(Supplementary Note 4)

A tap configured to pour a foam body of a beverage onto a liquid, the tap having a flow path through which the foam body flows, wherein a front end section of the flow path is oriented in a direction of 0° or more and 45° or less upward and downward with respect to a liquid surface of the liquid.

(Supplementary Note 5)

The tap according to any one of Supplementary notes 1 to 4, wherein a liquid guide section configured to guide an adhesion liquid attached to the tap to avoid an outlet port of the foam body is provided.

(Supplementary Note 6)

The tap according to any one of Supplementary notes 1 to 5, wherein a nozzle configured to form the front end section of the flow path is provided.

(Supplementary Note 7)

The tap according to any one of Supplementary notes 1 to 5, wherein a nozzle configured to form at least a portion of the flow path and a pouring member configured to form the front end section of the flow path are provided.

(Supplementary Note 8)

The tap according to Supplementary note 7, wherein the pouring member is detachably attached to the nozzle.

(Supplementary Note 9)

The tap according to Supplementary note 8, wherein the pouring member includes a positioning means that is able to be attached such that a pouring direction of the foam body becomes a desired direction.

(Supplementary Note 10)

The tap according to any one of Supplementary notes 1 to 9, wherein the beverage is a cereal-based foaming beverage.

(Supplementary Note 11)

The tap according to any one of Supplementary notes 1 to 10, wherein the flow path includes a first flow path and a second flow path, and a direction of pouring the foam body when the foam body is poured from the first flow path into a beverage container and a direction of pouring the foam body when the foam body is poured from the second flow path into the beverage container become a direction in which the foam body poured from the first flow path and the foam body poured from the second flow path form a spiral shape in the beverage container.

(Supplementary Note 12)

A server including:

the tap according to any one of Supplementary notes 1 to 11; and a supply device configured to supply the beverage into the tap.

(Supplementary Note 13)

The server according to Supplementary note 12, further including a guide section configured to position the beverage container at a predetermined position when the foam body is poured from the tap into a beverage container.

(Supplementary Note 14)

A pouring member attached to a tap configured to pour a foam body of a beverage onto a liquid, and configured to pour the foam body, the pouring member having a flow path through which the foam body passes, wherein a front end section of the flow path is curved along a liquid surface of the liquid.

(Supplementary Note 15)

A pouring member attached to a tap configured to pour a foam body of a beverage onto a liquid, and configured to pour the foam body, the pouring member having a flow path through which the foam body passes, wherein the flow path is formed such that a pouring angle of the foam body is an angle of 0° or more and 45° or less upward and downward with respect to a liquid surface of the liquid.

(Supplementary Note 16)

A pouring member attached to a tap configured to pour a foam body of a beverage onto a liquid, and configured to pour the foam body, the pouring member having a flow path through which the foam body passes, wherein a front end section of the flow path is oriented in a direction of 0° or more and 45° or less upward and downward with respect to a liquid surface of the liquid.

(Supplementary Note 17)

The pouring member according to any one of Supplementary notes 14 to 16, wherein a liquid guide section configured to guide an adhesion liquid attached to the tap is provided to avoid an outlet port of the foam body.

(Supplementary Note 18)

An attachment/detachment tool including a pair of clipping sections configured to sandwich a pouring member attached to a tap configured to pour a foam body of a beverage onto a liquid, wherein the pouring member is detachably attached to the tap while the pouring member is sandwiched between the pair of clipping sections.

(Supplementary Note 19)

A guide section configured to position a beverage container at a predetermined position with respect to a tap configured to pour a foam body onto a liquid, the guide section including a horizontal position adjustment member configured to adjust a horizontal position of the beverage container with respect to the tap.

(Supplementary Note 20)

The guide section according to Supplementary note 19, including a height position adjustment member configured to adjust a height position of the beverage container with respect to the tap.

(Supplementary Note 21)

A beverage having:

a liquid poured into a beverage container; and a foam body poured onto the liquid, wherein a first layer formed of the liquid, a second layer formed by liquefying the foam body on the first layer, and a third layer formed of the foam body on the second layer are formed.

(Supplementary Note 22)

A tap unit including a first tap configured to pour a first foam body formed of a first liquid onto the first liquid and a third liquid, and a second tap configured to pour a second foam body formed of a second liquid onto the second liquid and the third liquid, wherein the first tap has a flow path for a first liquid through which the first liquid is poured and a flow path for a first foam body through which the first foam body is poured, the second tap has a flow path for a second liquid through which the second liquid is poured and a flow path for a second foam body through which the second foam body is poured, and a front end section of the flow path for the first foam body and a front end section of the flow path for the second foam body are curved along a liquid surface of the third liquid.

(Supplementary Note 23)

The tap unit according to Supplementary note 22, wherein the front end sections of the flow path for the first foam body and the flow path for the second foam body are curved to form an angle of 0° or more and 45° or less upward and downward with respect to the liquid surface of the third liquid.

(Supplementary Note 24)

A tap unit including a first tap configured to pour a first foam body formed of a first liquid onto the first liquid and a third liquid, and a second tap configured to pour a second foam body formed of a second liquid onto the second liquid and the third liquid, wherein the first tap has a flow path for a first liquid through which the first liquid is poured and a flow path for a first foam body through which the first foam body is poured, the second tap has a flow path for a second liquid through which the second liquid is poured and a flow path for a second foam body through which the second foam body is poured, and the flow path for the first foam body and the flow path for the second foam body are formed such that a pouring angle of the first foam body and the second foam body is an angle of 0° or more and 45° or less upward and downward with respect to a liquid surface of the third liquid.

(Supplementary Note 25)

A tap unit including a first tap configured to pour a first foam body formed of a first liquid onto the first liquid and a third liquid, and a second tap configured to pour a second foam body formed of a second liquid onto the second liquid and the third liquid, wherein the first tap has a flow path for a first liquid through which the first liquid is poured and a flow path for a first foam body through which the first foam body is poured, the second tap has a flow path for a second liquid through which the second liquid is poured and a flow path for a second foam body through which the second foam body is poured, and the front end section of the flow path for the first foam body and the front end section of the flow path for the second foam body are oriented in a direction of 0° or more and 45° or less upward and downward with respect to a liquid surface of the third liquid.

(Supplementary Note 26)

The tap unit according to any one of Supplementary notes 22 to 25, wherein a first nozzle configured to form the front end section of the flow path for the first foam body and a second nozzle configured to form the front end section of the flow path for the second foam body are provided.

(Supplementary Note 27)

The tap unit according to any one of Supplementary notes 22 to 25, having: a first nozzle configured to form at least a portion of the flow path for the first foam body;

a second nozzle configured to form at least a portion of the flow path for the second foam body;

a first pouring member configured to form the front end section of the flow path for the first foam body; and a second pouring member configured to form the front end section of the flow path for the second foam body.

(Supplementary Note 28)

The tap unit according to Supplementary note 27, wherein the first pouring member is detachably attached to the first nozzle, and the second pouring member is detachably attached to the second nozzle.

(Supplementary Note 29)

The tap unit according to Supplementary note 28, wherein the first pouring member includes a first positioning means that is able to be attached such that a direction of pouring the first foam body becomes a desired direction, and the second pouring member includes a second positioning means that is able to be attached such that a direction of pouring the second foam body becomes a desired direction.

(Supplementary Note 30)

The tap unit according to any one of Supplementary notes 22 to 29, wherein a direction of pouring the first foam body from the first tap and a direction of pouring the second foam body from the second tap become a direction in which the poured first foam body and the poured second foam body form a spiral shape in a beverage container.

(Supplementary Note 31)

The tap unit according to any one of Supplementary notes 22 to 30, wherein the first liquid and the second liquid are cereal-based foaming beverages.

(Supplementary Note 32)

A server including:

a first tap according to any one of Supplementary notes 22 to 31;

a second tap according to any one of Supplementary notes 22 to 31; and a supply device configured to supply beverages into the first tap and the second tap.

(Supplementary Note 33)

The server according to Supplementary note 32, further including a guide section configured to position the beverage container at a predetermined position when the first foam body and the second foam body are poured from the first tap and the second tap into a beverage container.

(Supplementary Note 34)

A pouring member attached to at least one of a flow path for a first foam body and a flow path for a second foam body of a tap unit including:

a first tap configured to pour a first foam body formed of a first liquid onto the first liquid and a third liquid, and having a flow path for a first liquid through which the first liquid is poured, and a flow path for a first foam body through which the first foam body is poured; and a second tap configured to pour a second foam body formed of a second liquid onto the second liquid and the third liquid, and having a flow path for a second liquid through which the second liquid is poured and a flow path for a second foam body through which the second foam body is poured, wherein the pouring member has a flow path for a third foam body through which the first foam body or the second foam body is poured, and a front end section of the flow path for the third foam body is curved along a liquid surface of the third liquid.

(Supplementary Note 35)

A pouring member attached to at least one of a flow path for a first foam body and a flow path for a second foam body of a tap unit including:

a first tap configured to pour a first foam body formed of a first liquid onto the first liquid and a third liquid, and having a flow path for a first liquid through which the first liquid is poured, and a flow path for a first foam body through which the first foam body is poured; and a second tap configured to pour a second foam body formed of a second liquid onto the second liquid and the third liquid, and having a flow path for a second liquid through which the second liquid is poured and a flow path for a second foam body through which the second foam body is poured, wherein the pouring member has a flow path for a third foam body through which the first foam body or the second foam body is poured, and the flow path for the third foam body is formed such that a pouring angle of the first foam body and the second foam body is an angle of 0° or more and 45° or less upward and downward with respect to the liquid surface of the third liquid.

(Supplementary Note 36)

A pouring member attached to at least one of a flow path for a first foam body and a flow path for a second foam body of a tap unit including:

a first tap configured to pour a first foam body formed of a first liquid onto the first liquid and a third liquid, and having a flow path for a first liquid through which the first liquid is poured, and a flow path for a first foam body through which the first foam body is poured; and a second tap configured to pour a second foam body formed of a second liquid onto the second liquid and the third liquid, and having a flow path for a second liquid through which the second liquid is poured and a flow path for a second foam body through which the second foam body is poured, wherein the pouring member has a flow path for a third foam body through which the first foam body or the second foam body is poured, and a front end section of the flow path for the third foam body is oriented in a direction of 0° or more and 45° or less upward and downward with respect to a liquid surface of the third liquid.

(Supplementary Note 37)

A guide section configured to position a beverage container at a predetermined position with respect to a first tap configured to pour a first foam body onto a liquid and a second tap configured to pour a second foam body onto a liquid, the guide section including:

a horizontal position adjustment member configured to adjust a horizontal position of the beverage container with respect to the first tap and the second tap, wherein the horizontal position adjustment member adjusts a horizontal position of the beverage container such that the first foam body poured from the first tap and the second foam body poured from the second tap are poured onto the liquid in the beverage container.

(Supplementary Note 38)

The guide section according to Supplementary note 37, including a height position adjustment member configured to adjust a height position of the beverage container with respect to the first tap and the second tap, wherein the height position adjustment member has an abutting section that the beverage container abuts.

REFERENCE SIGNS LIST

1, 301 . . . beverage vending apparatus, 10, 30, 50, 60, 75, 90, 100 . . . tap, 20, 40, 110, 120 . . . pouring member, 20*b*, 360*b* . . . folded section (front end section), 20*c*, 360*c* . . . second extension section (front end section), 20*f*, 43, 360*f*, 403 . . . flow path, 71, 81, 501, 601 . . . guide section, 72, 82, 83, 502, 602, 603 . . . horizontal position adjustment member, 73, 503 . . . height position adjustment member, 111, 121 . . . liquid guide section, 123 . . . coating layer (liquid guide section), 190, 195 . . . pouring member, 192*a*, 197*a* . . . tubular flow path (first flow path), 192*b*, 197*b* . . . tubular flow path (second flow path), 330, 375, 430, 460, 575, 675 . . . tap unit, 345, 355 . . . nozzle for foam body, 345*b* . . . front end section, 360, 400 . . . pouring member (first pouring member), 370, 410 . . . pouring member (second pouring member) A . . . beverage container, B . . . beer foam (foam body), B1 . . . first beer foam (first foam body), B2 . . . second beer foam (second foam body), C, E1, E2 . . . liquid, F . . . foam body, L . . . beer liquid (liquid), R1, R4 . . . first layer, R2, R5 . . . second layer, R3, R6 . . . third layer, S . . . liquid surface

The invention claimed is:

1. A tap configured to pour a foam body of a beverage onto a liquid, the tap comprising:

a foam flow path through which the foam body flows;

a liquid flow path through which a liquid of the beverage is poured, the foam flow path being separate from the liquid flow path;

a tubular pouring member provided as part of the foam flow path for the foam body, a length of the pouring member being shorter than a length of the foam flow path for the foam body; and a nozzle that is part of the flow path for the foam body, an end of the tubular pouring member being inserted into the nozzle, wherein a front end section of the foam flow path is oriented in a direction of 0° or more and 45° or less upward and downward with respect to a liquid surface of the liquid.

2. The tap according to claim 1, wherein a liquid guide section in which at least a lower side of an outlet port of the foam body protrudes outward is provided.

3. A server comprising:

the tap according to claim 1; and a supply device configured to supply the beverage into the tap.

4. A pouring member attached to a tap configured to pour a foam body of a beverage onto a liquid, and configured to pour the foam body, the pouring member comprising:

a flow path through which the foam body flows, wherein a front end section of the flow path is curved along a liquid surface of the liquid, wherein the pouring member is detachably attached to the tap at a first extension section of the pouring member, the first extension section extending downward from the tap, wherein the pouring member includes a folded section extending from the first extension section, and wherein the pouring member includes a second extension section extending from the folded section.

5. A pouring member attached to a tap configured to pour a foam body of a beverage onto a liquid, and configured to pour the foam body, the pouring member comprising:

a flow path through which the foam body flows, wherein a front end section of the flow path is oriented in a direction of 0° or more and 45° or less upward and downward with respect to a liquid surface of the liquid, and wherein the pouring member includes a columnar fitting protrusion that is detachably attached to the tap, wherein the pouring member includes a columnar flow path conversion section, an exit opening of the flow path through which the foam body flows to outside of the pouring member is located at a side of the columnar flow path conversion section.

6. The pouring member according to claim 5, wherein a liquid guide section in which at least a lower side of an outlet port of the foam body protrudes outward is provided.

7. The pouring member according to claim 5, wherein the pouring member is attached such that a pouring direction of the foam body is a desired direction.

8. The tap according to claim 1, wherein the front end section of the foam flow path is curved to form an angle of 0° or more and 45° or less upward and downward with respect to the liquid surface of the liquid.

9. The tap according to claim 1, wherein the foam flow path includes a first flow path and a second flow path, and a direction of pouring the foam body when the foam body is poured from the first flow path into a beverage container and a direction of pouring the foam body when the foam body is poured from the second flow path into the beverage container become a direction in which the foam body poured from the first flow path and the foam body poured from the second flow path form a spiral shape in the beverage container.

10. The tap according to claim 1, wherein an inner diameter of the nozzle is larger than an inner diameter of the tubular pouring member.

* * * * *